US009711112B2

(12) United States Patent
Ooga

(10) Patent No.: US 9,711,112 B2
(45) Date of Patent: Jul. 18, 2017

(54) CONTROL SIGNAL GENERATION CIRCUIT AND CONTROL SIGNAL GENERATION METHOD FOR CONTROLLING LUMINANCE IN A DISPLAY DEVICE

(71) Applicant: NLT Technologies, Ltd., Kanagawa (JP)

(72) Inventor: Kouichi Ooga, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 93 days.

(21) Appl. No.: 14/722,777

(22) Filed: May 27, 2015

(65) Prior Publication Data

US 2015/0348506 A1 Dec. 3, 2015

(30) Foreign Application Priority Data

May 27, 2014 (JP) ..... 2014-108654
Feb. 24, 2015 (JP) ..... 2015-034452

(51) Int. Cl.
*G09G 3/36* (2006.01)
*G09G 5/10* (2006.01)
(Continued)

(52) U.S. Cl.
CPC ..... *G09G 5/10* (2013.01); *G09G 3/2003* (2013.01); *G09G 3/2074* (2013.01);
(Continued)

(58) Field of Classification Search
CPC ..... G09G 3/34; G09G 3/3413; G09G 3/3426; G09G 5/02; G09G 5/10; G09G 3/2003; G09G 3/2074; G09G 3/3611
(Continued)

(56) References Cited

U.S. PATENT DOCUMENTS 8,743,152 B2 6/2014 Sakaigawa
2005/0231534 A1* 10/2005 Lee ..... G09G 3/2003 345/690
(Continued)

FOREIGN PATENT DOCUMENTS

JP 2007-010753 1/2007
JP 2008-131349 6/2008
(Continued)

OTHER PUBLICATIONS

Japanese Official Action—2015-034452—Sep. 6, 2016.

*Primary Examiner* — Adam J Snyder
(74) *Attorney, Agent, or Firm* — Young & Thompson

(57) ABSTRACT

A control signal generation circuit includes: a first circuit unit which controls, according to inputted video signals, light-up amount of each pixel of a display panel where a plurality of pixels constituted by including a white sub-pixel are disposed; and a second circuit unit which controls luminance of a backlight that lights up the display panel from a back surface. The second circuit unit calculates a saturation feature value in one frame from the saturation value of each pixel, generates a signal for controlling the luminance of the backlight based thereupon, and calculates a luminance increase rate by using the saturation value of each pixel and the saturation feature value. The first circuit unit performs luminance decreasing processing of each pixel according to the luminance increase rate, and supplements the saturation of each pixel according to the light-up amount of the white sub-pixels.

25 Claims, 25 Drawing Sheets

(51) Int. Cl.
*G09G 5/02* (2006.01)
*G09G 3/20* (2006.01)
*G09G 3/34* (2006.01)

(52) U.S. Cl.
CPC ..... *G09G 3/3413* (2013.01); *G09G 3/3426* (2013.01); *G09G 3/3611* (2013.01); *G09G 5/02* (2013.01); *G09G 2300/0408* (2013.01); *G09G 2300/0426* (2013.01); *G09G 2300/0452* (2013.01); *G09G 2300/0465* (2013.01); *G09G 2330/021* (2013.01)

(58) Field of Classification Search
USPC ..... 345/102
See application file for complete search history.

(56) References Cited

U.S. PATENT DOCUMENTS

2007/0279372 A1* 12/2007 Brown Elliott ..... G09G 3/3426 345/102
2009/0174638 A1* 7/2009 Brown Elliott ..... G09G 3/3426 345/88
2009/0207182 A1* 8/2009 Takada ..... G09G 3/3406 345/589
2009/0284545 A1* 11/2009 Watanabe ..... G09G 3/3406 345/102
2010/0103187 A1* 4/2010 Linssen ..... G09G 3/3406 345/88
2011/0043533 A1* 2/2011 Han ..... G09G 5/02 345/589
2011/0043552 A1* 2/2011 Brown Elliott ..... G09G 3/3406 345/694
2011/0148910 A1* 6/2011 Botzas ..... G09G 5/02 345/600
2012/0001947 A1* 1/2012 Chu-Ke ..... G09G 3/3406 345/690
2012/0013649 A1* 1/2012 Higashi ..... G09G 3/3426 345/690
2012/0154451 A1* 6/2012 Kao ..... G09G 5/10 345/690
2014/0267471 A1* 9/2014 Harada ..... G09G 3/342 345/694

FOREIGN PATENT DOCUMENTS

JP 2009-047775 3/2009
JP 2009-210924 9/2009
JP 2009-217052 9/2009
JP 2010-020241 1/2010
JP 2011-221172 11/2011
JP 2013-33088 2/2013

* cited by examiner

CASE OF PARTIALLY DISPLAYING PRIMARY COLOR IN ALL-WHITE DISPLAY

REGARDING LUMINANCE RATIO OF WHITE DISPLAY PART AND PRIMARY COLOR DISPLAY PART
(CASE OF INCREASING WHITE LUMINANCE)

REGARDING LUMINANCE RATIO OF WHITE DISPLAY PART AND PRIMARY COLOR DISPLAY PART
(CASE OF NOT INCREASING WHITE LUMINANCE)

FIG. 8

TABLE 1 VARIOUS KINDS OF ASSUMED SCREENS AND SETTINGS FOR CALCULATING SATURATION FEATURE VALUE

| | CASE [I] (CONTAINING PRIMARY COLOR) | CASE [II] (PRIMARY COLOR ON WHITE) | CASE [III] (LOW SATURATION) |
|---|---|---|---|
| SATURATION OF FIRST PIXEL | 0. 6 | 0 (WHITE) | 0. 15 |
| SATURATION OF SECOND PIXEL | 1 (PRIMARY COLOR) | 0 (WHITE) | 0. 2 |
| SATURATION OF THIRD PIXEL | 0. 1 | 1 (PRIMARY COLOR) | 0. 3 |
| SATURATION OF FOURTH PIXEL | 0. 7 | 0 (WHITE) | 0. 2 |
| SATURATION OF FIFTH PIXEL | 0 (WHITE) | 0 (WHITE) | 0. 25 |
| RESOLUTION | 5 | | |
| COEFFICIENT A | 0. 5 | | |
| COEFFICIENT B | 0. 5 | | |
| COEFFICIENT C | 1. 5 | | |

FIG. 13

TABLE 2 VARIOUS KINDS OF ASSUMED SCREENS AND SETTINGS FOR CALCULATING SATURATION FEATURE VALUE

| | CASE [I] (CONTAINING PRIMARY COLOR) | CASE [II] (PRIMARY COLOR ON WHITE) | CASE [III] (LOW SATURATION) |
|---|---|---|---|
| SATURATION OF FIRST PIXEL | 0. 6 | 0 (WHITE) | 0. 15 |
| SATURATION OF SECOND PIXEL | 1 (PRIMARY COLOR) | 0 (WHITE) | 0. 2 |
| SATURATION OF THIRD PIXEL | 0. 1 | 1 (PRIMARY COLOR) | 0. 3 |
| SATURATION OF FOURTH PIXEL | 0. 7 | 0 (WHITE) | 0. 2 |
| SATURATION OF FIFTH PIXEL | 0 (WHITE) | 0 (WHITE) | 0. 25 |
| RESOLUTION | 5 | | |
| COEFFICIENT A | 0. 125 | | |
| COEFFICIENT B | 0. 875 | | |
| COEFFICIENT C | 1. 5 | | |

FIG. 21

TABLE 3 PIXEL SATURATION CALCULATED FROM INPUTTED LUMINANCE SIGNALS (RL, GL, BL) OF EACH PIXEL AND EXPRESSION 4

| | CASE IV | | CASE V | | CASE VI | |
|---|---|---|---|---|---|---|
| FIRST PIXEL | (255,0,0) | SATURATION=1 | (1,0,0) | SATURATION=1 | (1,0,0) | SATURATION=1 |
| SECOND PIXEL | (255,0,0) | SATURATION=1 | (3,0,0) | SATURATION=1 | (3,0,0) | SATURATION=1 |
| THIRD PIXEL | (255,0,0) | SATURATION=1 | (0,2,0) | SATURATION=1 | (0,2,0) | SATURATION=1 |
| FOURTH PIXEL | (255,0,0) | SATURATION=1 | (0,1,3) | SATURATION=1 | (0,1,3) | SATURATION=1 |
| FIFTH PIXEL | (255,0,0) | SATURATION=1 | (0,0,3) | SATURATION=1 | (128,128,128) | SATURATION=0 |
| SIXTH PIXEL | (255,0,0) | SATURATION=1 | (0,0,0) | SATURATION=0 | (128,128,128) | SATURATION=0 |
| SEVENTH PIXEL | (255,0,0) | SATURATION=1 | (0,0,0) | SATURATION=0 | (0,0,0) | SATURATION=0 |
| EIGHTH PIXEL | (255,0,0) | SATURATION=1 | (0,0,0) | SATURATION=0 | (0,0,0) | SATURATION=0 |
| NINTH PIXEL | (255,0,0) | SATURATION=1 | (0,0,0) | SATURATION=0 | (0,0,0) | SATURATION=0 |
| TENTH PIXEL | (255,0,0) | SATURATION=1 | (0,0,0) | SATURATION=0 | (0,0,0) | SATURATION=0 |
| RESOLUTION | 10 | | | | | |

CASE IV

ALL-RED SOLID DISPLAY

BETTER NOT TO DECREASE B/L

CASE V

ALMOST BLACK DISPLAY
(CONTAINING IMAGE NOISE)

NO PROBLEM
TO DECREASE B/L

CASE VI

HALFTONE COLOR IN
ALMOST BLACK DISPLAY
(CONTAINING IMAGE NOISE)

NO PROBLEM
TO DECREASE B/L

FIG. 23

TABLE 4 PIXEL SATURATION CALCULATED FROM INPUTTED LUMINANCE SIGNALS (RL, GL, BL) OF EACH PIXEL AND EXPRESSION 26

| | CASE IV | CASE V | CASE VI |
|---|---|---|---|
| FIRST PIXEL | (255,0,0) SATURATION=1 | (1,0,0) SATURATION=0 | (1,0,0) SATURATION=0 |
| SECOND PIXEL | (255,0,0) SATURATION=1 | (3,0,0) SATURATION=0 | (3,0,0) SATURATION=0 |
| THIRD PIXEL | (255,0,0) SATURATION=1 | (0,2,0) SATURATION=0 | (0,2,0) SATURATION=0 |
| FOURTH PIXEL | (255,0,0) SATURATION=1 | (0,1,3) SATURATION=0 | (0,1,3) SATURATION=0 |
| FIFTH PIXEL | (255,0,0) SATURATION=1 | (0,0,3) SATURATION=0 | (128,128,128) SATURATION=0 |
| SIXTH PIXEL | (255,0,0) SATURATION=1 | (0,0,0) SATURATION=0 | (128,128,128) SATURATION=0 |
| SEVENTH PIXEL | (255,0,0) SATURATION=1 | (0,0,0) SATURATION=0 | (0,0,0) SATURATION=0 |
| EIGHTH PIXEL | (255,0,0) SATURATION=1 | (0,0,0) SATURATION=0 | (0,0,0) SATURATION=0 |
| NINTH PIXEL | (255,0,0) SATURATION=1 | (0,0,0) SATURATION=0 | (0,0,0) SATURATION=0 |
| TENTH PIXEL | (255,0,0) SATURATION=1 | (0,0,0) SATURATION=0 | (0,0,0) SATURATION=0 |
| RESOLUTION | 10 | | |

CONTROL SIGNAL GENERATION CIRCUIT AND CONTROL SIGNAL GENERATION METHOD FOR CONTROLLING LUMINANCE IN A DISPLAY DEVICE

CROSS-REFERENCE TO RELATED APPLICATION

This application is based upon and claims the benefit of priority from Japanese patent application No. 2014-108654, filed on May 27, 2014 and Japanese patent application No. 2015-034452, filed on Feb. 24, 2015, the disclosure of which is incorporated herein in its entirety by reference.

BACKGROUND OF THE INVENTION

1. Field of the Invention

The present invention relates to a control technique based on video signals. More specifically, the present invention relates to a control signal generation circuit, a video display device, and a control signal generation method for controlling luminance by executing signal processing according to video signals inputted from outside.

2. Description of the Related Art

Recently, regarding the power consumed in thin-type display devices, low power consumption is becoming advanced by employing LED for backlight (B/L), etc. However, the proportion of the power consumption of the backlight in the total power consumption is still great in such thin-type display devices. Therefore, for the liquid crystal in which the backlight is used by being lighted at all times, employed is a technique which controls the luminance of the backlight (B/L luminance) according to the inputted video signals to lower the power consumption as the whole device.

Further, also known is a structure in which the above-described luminance control technique is applied to an RGBW-type liquid crystal display device (also referred to as RGBW product hereinafter) in which a single pixel is constituted with four sub-pixels acquired by adding W (White) to sub-pixels of R (Red), G (Green), and B (Blue) (hereinafter, each of the sub-pixels R, G, B, and W is simply expressed as R, G, B, and W).

That is, there is also a technique with which the power consumption of the backlight is decreased by constituting an RGBW-type display device through combining the technique regarding the RGBW-type liquid crystal display panel in which W is added to R, G, and B in order to improve the luminance with the technique for controlling the luminance of the backlight and by allotting the luminance amount improved by adding W to the luminance decreased amount of the backlight.

Here, the panel characteristic of the RGBW-type liquid crystal display device will be described in a specific manner.

When all-white display is performed in the RGBW-type liquid crystal display panel exhibiting the panel characteristic with which the ratio of the maximum white luminance of W and the maximum white luminance generated by RGB becomes 1:1, it is simply considered that the luminance thereof becomes twice that of the case using RGB only.

However, when comparing it with the same size and the same resolution of an RGB product (a display panel in which a single pixel is constituted with three sub-pixels of R, G, and B having no W sub-pixel), the area occupied by the other sub-pixels is decreased in the RGB product for the amount of the added W so that the area per sub-pixel is decreased to about ¾ since the structure that constitutes a single pixel with the three sub-pixels of R, G, and B is changed to the structure that constitutes a single pixel with the four sub-pixels of R, G, B, and W.

Further, in practice, there is also the area of the in-panel wiring and the like for driving the pixels, so that the area thereof per sub-pixel normally becomes smaller than ¾. Thus, strictly, it is necessary to think about it with the ratio of the numerical aperture areas where the light from the backlight can transmit through.

A strict value can be acquired by calculating the ratio of the numerical aperture of the sub-pixels of the RGB product and the numerical aperture area of the sub-pixels of the RGBW product as "Y" while assuming that the numerical aperture areas of the three sub-pixels constituting each pixel of the RGB product are the same and the numerical aperture areas of the four sub-pixels constituting each pixel of the RGBW product are the same. However, for convenience, the ratio is assumed as ¾ (=0.75) herein for explanation. The calculation method of "Y" and processing including those will be described later.

Assuming that the products are of the same size and the same resolution as described above, the ratio of the luminance of the RGBW with respect to the luminance of the RGB product in all-white display becomes 1.5 from "white of W+white of RGB=0.75+0.75", and becomes 0.75 in primary-color display (R only, G only, or B only).

As described, when all-white display is done in the RGBW product, the luminance of 50% is increased with respect to that of the RGB product. When primary-color display is done, the luminance of 25% is decreased with respect to that of the RGB product.

Therefore, in a case of an image where the luminance is increased as in the all-white display, for example, the B/L luminance can be decreased to 66.6% from 100% that is the original luminance ($1.5\times0.666\approx1$) for the amount of the increased luminance 50%. That is, with the RGBW-type display panel employing the technique for controlling the B/L luminance, it is possible to decrease the power consumption of the backlight by about 33.3% while keeping the similar luminance as that of the original image in a case of all-white display.

The above is the base of the principle for driving the RGBW-type display panel that employs the technique for controlling the B/L luminance, which is devised to achieve low power consumption by reducing the power required for lighting up the backlight through decreasing the B/L luminance according to the video signals.

In the RGBW-type display device employing such technique, employed is a method which specifies the pixel to be the reference when determining the luminance decrease amount of the backlight and decreases the B/L luminance by corresponding to a feature value of the specified pixel.

That is, it is necessary to determine the value (feature value) to be a feature among the video signals of the image in order to determine the luminance decrease amount of the backlight. The feature value of the video signal is the value referred when changing the luminance of the backlight, so that it influences the image quality greatly.

There are various kinds of possible methods for determining the feature value and methods of luminance decreasing processing based thereupon. For example, known is a method which is designed to display an image similar to the original image while decreasing the B/L luminance by taking the pixel whose light-up amount of W in one frame of a video signal (W minimum light-up pixel) is the smallest as the reference, decreasing the B/L luminance as whole for the increase amount of the luminance of that pixel, and decreasing the luminance of the other pixels whose luminance is larger than the W minimum light-up pixel (the light-up amount of W of the other pixels is naturally larger since the W minimum light-up pixel is taken as the reference) by gradation conversion.

The W minimum light-up pixel taken as the reference in this case is the pixel whose saturation is the highest in one frame. For example, W is not lighted up (light-up amount of W is 0) in the pixel displaying the primary color (primary-color pixel). Thus, such pixel corresponds to the pixel whose saturation is the highest in one frame (W minimum light-up pixel). Further, in all-white display, there is only low saturation white. Thus, the pixel whose saturation is the highest in one frame corresponds to each white pixel.

As described, the technical content in which the pixel whose saturation is the highest in one frame is taken as the reference and the B/L luminance is decreased according to that is disclosed in Japanese Unexamined Patent Publication 2007-10753 (Patent Document 1), for example.

The RGBW-type display device of Patent Document 1 is designed to achieve low power consumption by the drive including backlight control (B/L control). This display device is structured to increase the gradation expansion rate as much as possible by gradation conversion of each pixel through executing the conversion with which the data allotted to white pixels (W) does not become the maximum but the data maximum values of each color become almost equivalent so as to increase the effect of decreasing the power consumption of the backlight by taking the data maximum value in one screen as the reference of the power consumption decrease amount of the backlight.

Further, regarding a way of increasing the effect of decreasing the power consumption of the backlight, there is also considered a method which calculates an average value of the saturation of the entire pixels (entire screen) of one frame and determines the decrease amount of the B/L luminance by taking the average value as the reference. With this method, in a case of a screen on which primary colors are displayed partially on a white screen where almost all-white (white is low in saturation) occupies one frame, the average value of the saturation in the entire screen becomes low. Thus, the luminance amplification rate becomes large, so that the decrease amount of the B/L luminance can be increased.

As other technical documents related to the RGBW-type display device, Patent Documents 2 to 4 in the followings are known, for example.

The display device disclosed in Japanese Unexamined Patent Publication 2008-131349 (Patent Document 2) employs a structure which prevents the colors (yellow and the like) to which W is added with high luminance from becoming too white by using a technique which expands the saturation (without expanding W-value) of only the data corresponding to RGB within the image data to be inputted and adjusts the W-value by the expanded luminance value. LUT (3DLUT) is used herein for conversion of the colors.

Japanese Unexamined Patent Publication 2009-210924 (Patent Document 3) discloses saturation/luminance decreasing processing for the RGB signals to be inputted as a technique used in a display device that employs B/L control. Specifically, it is a technique which decreases the backlight value by executing processing with which only the saturation is decreased in a case where a desired backlight value or less can be acquired by decreasing only the saturation while the saturation is decreased to "0" and the luminance is decreased in a case where the desired backlight value or less cannot be acquired by decreasing only the saturation.

Japanese Unexamined Patent Publication 2009-217052 (Patent Document 4) discloses an RGBW-type display device employing a technique which executes saturation decreasing processing on the inputted RGB signals and performs processing for decreasing, increasing, or not changing the luminance. The display device employing the B/L control employs a structure which adjusts the changing degree of the saturation and the luminance by designation of the luminance adjusting parameter in order to decrease the backlight value more securely.

However, in a case where the structure such as the technique disclosed in Patent Document 1 with which the pixel to be the reference of the power consumption decrease amount of the backlight is determined based on the maximum value of the saturation in one screen, the power consumption of the backlight cannot be decreased when there is even one pixel of high saturation and high gradation (primary colors, for example) in a screen whose saturation is medium saturation as a whole, for example.

That is, as described above, in a case where there is even one point of pixel whose light-up amount of W is "0" (pixel where W is not lighted up) existing in a screen when employing the way of decreasing the B/L control by taking the pixel whose light-up amount of W is the smallest (W minimum light-up pixel) in one frame of a video signal as the reference, W for supplementing the luminance decrease amount of the backlight is not lighted up. Thus, the decreasing effect of the power consumption by the decrease of the B/L luminance may not be achieved.

Further, the method of determining the decrease amount of the B/L luminance by taking the average value of the saturation in one frame as the reference has such an issue that a sense of discomfort tends to be felt in the image quality.

For example, when a primary color is displayed partially in an all-white background, the average value of the saturation in the entire screen occupied by almost all-white (white is low in saturation) is an extremely small value. Thus, a sense of darkness and dullness in the color of the primary color display part is increased even though it is possible to increase the luminance decrease amount of the backlight. Therefore, a sense of discomfort in the image quality is felt with respect to the original image.

Such sense of darkness and dullness is caused when the light-up amount of W in the all-white display part is increased and the light-up amount of W in the primary-color display part becomes "0" (W is not lighted up).

That is, for an image in a state where the display part with high luminance is surrounding the periphery of the primary-color display part, human eyes recognize the luminance of the primary-color display part to be darker than the original luminance (simultaneous contrast effect). As a result, such sense of darkness and dullness felt in the color of the primary-color display part is increased.

As described above, in RGBW drive, a sense of discomfort is likely to be felt in the image quality when it is tried to increase the power consumption decreasing effect of the backlight. Meanwhile, the power consumption decreasing effect of the backlight is decreased when it is tried to suppress a sense of discomfort in the image quality.

Further, the technique of Patent Document 2 does not use the minimum value of RGB when calculating the W-value, so that the probability of lighting up W excessively is increased. Thus, such sense of discomfort in the image quality that it becomes whitish with respect to the original image is generated. In addition, the power consumption decreasing effect cannot be achieved since the B/L control is not performed.

The display device disclosed in Patent Document 3 executes a processing action for forcibly setting the saturation to be "0" as described above when the backlight value does not reach the prescribed decrease amount. Therefore, the hues of each pixel are changed greatly with respect to those of the original image, so that a sense of discomfort in the image quality is generated (issue of becoming whitish in particular).

The display device of Patent Document 4 performs processing for decreasing the saturation of the RGB signals in order to decrease the backlight value securely. Therefore, there is a possibility of causing a change in the hues of each pixel greatly with respect to those of the original image, so that a sense of discomfort may be generated in the image quality.

The display device of Japanese Unexamined Patent Publication 2009-47775 (Patent Document 5) performs processing for decreasing the saturation by disregarding the high gradation side of the RGB signals of inputted image data for decreasing the power of the backlight. Thus, the hues of each pixel are changed with respect to those of the original image, so that a sense of discomfort may be generated in the image quality.

The present invention is designed to improve the shortcomings of the related techniques described above. More specifically, it is an exemplary object of the present invention to provide a control signal generation circuit, a video display device, and a control signal generation method for minimizing a sense of discomfort as much as possible while decreasing the power consumption by luminance control of the backlight according to the video signals and maintaining the quality of the original image.

SUMMARY OF THE INVENTION

In order to achieve the foregoing object, the control signal generation circuit, according to the present invention employs a structure which includes: a first circuit unit which controls, according to an inputted video signal, light-up amount of each pixel of a display panel where a plurality of pixels constituted by including a white sub-pixel are disposed; and a second circuit unit which controls luminance of a backlight that lights up the display panel from a back surface, wherein: the second circuit unit includes an each-pixel saturation calculation circuit which calculates a saturation value of each pixel, a feature value/luminance decrease amount calculation circuit which calculates a saturation feature value in one frame by using the saturation value of each pixel, and calculates luminance decrease amount of the backlight based thereupon, a PWM signal generation circuit which generates a signal for controlling the luminance of the backlight based on the luminance decrease amount of the backlight, and transmits the generated signal towards the backlight, and an each-pixel luminance increase rate calculation circuit which calculates a luminance increase rate of each pixel by using the saturation value of each pixel and the saturation feature value; and the first circuit unit includes a saturation supplementing circuit which supplements the saturation of each pixel according to the light-up amount of the white sub-pixel.

Further, the video display device according to the present invention employs a structure which includes: a display panel where a plurality of pixels constituted by including a white sub-pixel are disposed; a backlight that lights up the display panel from a back surface; and the control signal generation circuit which includes a first circuit unit which controls light-up amount of each pixel of the display panel according to an inputted video signal and a second circuit unit which controls luminance of the backlight.

Further, the control signal generation method according to the present invention is a control signal generation method achieved by using a control signal generation circuit which includes a first circuit unit which controls, according to an inputted video signal, light-up amount of each pixel of a display panel where a plurality of pixels constituted by including a white sub-pixel are disposed; and a second circuit unit which controls luminance of a backlight that lights up the display panel from a back surface, wherein: the first circuit unit supplements saturation of each pixel according to the light-up amount of the white-sub-pixel; the second circuit unit calculates a saturation value of each pixel; the second circuit unit calculates a saturation feature value in one frame by using the saturation value of each pixel; the second circuit unit calculates luminance decrease amount of the backlight based on the saturation feature value; the second circuit unit generates a signal for controlling the luminance of the backlight based on the luminance decrease amount of the backlight, and transmits the generated signal towards the backlight; the second circuit unit calculates a luminance increase rate of each pixel by using the saturation value of each pixel and the saturation feature value; and the first circuit unit performs luminance decreasing processing of each pixel according to the luminance increase rate.

The present invention can provide the control signal generation circuit, the video display device, and the control signal generation method which in particular can decrease the power consumption by performing luminance control of the backlight according to the video signals and can minimize a sense of discomfort in the image quality.

BRIEF DESCRIPTION OF THE DRAWINGS

FIG. 8 is a table showing an example of various kinds of imagined screens and various kinds of settings for calculating saturation feature values according to the first exemplary embodiment of the present invention;

FIG. 13 is a table showing an example of various kinds of imagined screens and various kinds of settings for calculating saturation feature values according to the second exemplary embodiment of the present invention;

FIG. 21 shows examples of the saturation calculated by inputted luminance signals (RL, GL, BL) of each pixel and Expression 4;

FIGS. 22A-22C show examples of assumed images of luminance signals shown in Table 3, in which FIG. 22A is a chart assumed as a solid primary-color screen, FIG. 22B is a chart assumed to include a lot of low-gradation noises, and FIG. 22C is a chart assumed to be a screen on which a halftone is displayed partially on a solid screen background with a small gradation difference;

FIG. 23 shows examples of pixel saturation calculated by inputted luminance signals (RL, GL, BL) of each pixel and Expression 26;

DETAILED DESCRIPTION OF THE PREFERRED EMBODIMENTS (First Exemplary Embodiment)

A first exemplary embodiment of a control signal generation circuit (a video signal processing circuit) and a video display device according to the present invention will be described by referring to FIG. 1 to FIG. 10.

The control signal generation circuit of the first exemplary embodiment is structured to reduce the power consumption of a backlight effectively according to the increase of the white luminance and to increase the power consumption decreasing effect as the entire video display device by executing characteristic processing which performs control so as to suppress a sense of discomfort in the image quality generated due to the ratio between the white luminance and the primary-color luminance as much as possible when an image where a primary color is partially shown in a part of a white screen is displayed and effectively executes luminance amplification control by W when other images are displayed.

As a method for determining the luminance decrease amount of the backlight associated with added W in an RGBW-type display device, there is a method which determines a specific pixel as the reference by considering that the light-up amount of W in one frame varies for each pixel. For example, known is a method which determines the luminance decrease amount of the backlight by taking the pixel whose light-up amount of W is the smallest (W minimum light-up pixel) in one frame of a video signal as the reference.

However, compared with the light-up amount of the W minimum light-up pixel, the light-up amount of W of the other pixels is naturally greater than that. Thus, if the luminance decrease amount is determined uniformly by taking the W minimum light-up amount pixel as the reference, there may be the pixels that become too bright compared with the original image. In order to avoid such sense of discomfort in the image quality caused due to the existence of such pixels, it is necessary to keep the equivalent balance with that of the original image by equalizing the luminance increase amount of the W minimum light-up pixel and that of the other pixels.

That is, for the pixels that become too bright, it is necessary to decrease the luminance by each pixel. Therefore, the control signal generation circuit according to the first exemplary embodiment employs a structure for decreasing the gradation by each pixel to suppress a sense of discomfort generated in the image quality.

Note here that explanations will be provided hereinafter while assuming that the RGBW-type display panel according to the first exemplary embodiment exhibits such a characteristic that the ratio between the W maximum white luminance and the maximum white luminance generated by RGB becomes 1:1.

(Overall Structure)

Figure 3:
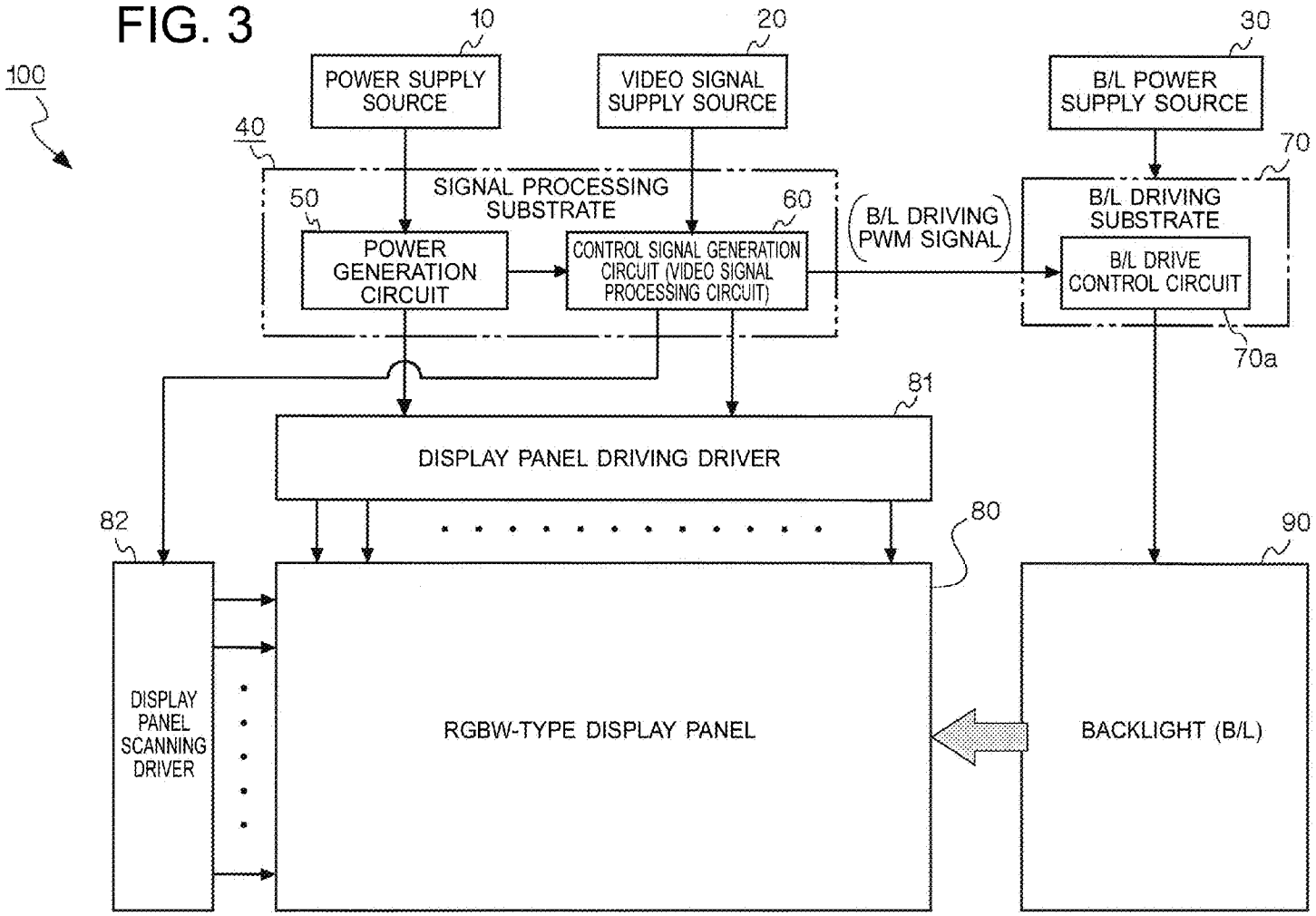
FIG. 3 is a block diagram showing a video display device according to the first exemplary embodiment of the present invention, which includes the control signal generation circuit disclosed in FIG. 1.

As shown in FIG. 3, a video display device (display device) 100 having an RGBW-type display panel 80 for displaying videos towards outside loaded thereon includes: a signal processing substrate 40 on which a power generation circuit 50 as a DC-DC converter and the like and a control signal generation circuit 60 for performing various kinds of signal processing are mounted; a power supply 10 which supplies the power towards the power generation circuit 50; a video signal supply source 20 which supplies video signals to the control signal generation circuit 60; a display panel driving driver 81 which supplies the video signals processed in the control signal generation circuit 60 to the RGBW-type display panel 80; and a display panel scanning driver 82 which supplies horizontal/vertical synchronizing signals transmitted from the control signal generation circuit 60 to the RGBW-type display panel 80.

Further, since a light source is required for displaying videos on the RGBW-type display panel 80, a backlight (B/L) 90 for lighting the RGBE-type display panel 80 from the back surface is loaded on the display device 100 as a light source. Furthermore, the display device 100 includes: a B/L driving substrate 70 equipped with a B/L drive control circuit 70a for performing drive control (light-up control) of the backlight 90 based on various kinds of control signals (PWM signals and the like transmitted from the control signal generation circuit 60); and a B/L power supply source 30 which supplies the power to the B/L driving substrate 70.

The power generation circuit 50 is structured to generate the power for being supplied to various kinds of ICs such as the control signal generation circuit 60, the display panel driving driver 81, and the display panel scanning driver 82.

Further, the control signal generation circuit 60 executes signal processing for driving the display panel driving driver 81. Specifically, it is structured to perform processing for rearranging the video signals received from the video signal supply source 20 according to a prescribed transmission format and processing for generating horizontal synchronous signals, vertical synchronous signals, various kinds of control signals, and the like.

The display panel driving driver 81 and the display panel scanning driver 82 are structured to transmit signals for driving each pixel of the panel towards the RGBW-type display panel that is an RGBW-type drive liquid crystal panel. Thereby, each pixel is controlled to display videos.

In the signal processing substrate 40, the power is supplied from the power supply source 10, and the power for driving various kinds of ICs is generated from the power supply by the power generation circuit 59. The various kinds of ICs are driven by using the power. Further, signal processing for showing videos on the RGBW-type display panel 80 (including layout conversion of signals, generation of horizontal/vertical synchronous signals, and the like) is executed in the signal processing substrate 40 for the video signals supplied from the video signal supply source 20, and the signals generated herein are supplied to the display panel driving driver 81 and the display panel scanning driver 82. It is structured to display videos on the RGBW-type display panel 80 as a result of the above.

Further, by using the power supplied from the B/L power supply source 30 to the B/L driving substrate 70, the B/L drive control circuit 70a drives the circuit for lighting up the backlight 90 by controlling the luminance based on the various kinds of signals (PWM signals and the like) received from the control signal generation circuit 60 to light up the backlight 90.

Note here that the feature of the RGBW-type display device 100 according to the first exemplary embodiment is the structure regarding the drive which calculates a saturation feature value of the video signal and controls the luminance of the backlight according to the saturation feature value. Thus, first, by referring to FIG. 1, the structural content of the control signal generation circuit 60 will be described mainly on the periphery of the block of the saturation feature value/luminance decrease amount calculation circuit section (feature value/luminance decrease amount calculation circuit) 65 that is a feature member.

Figure 1:
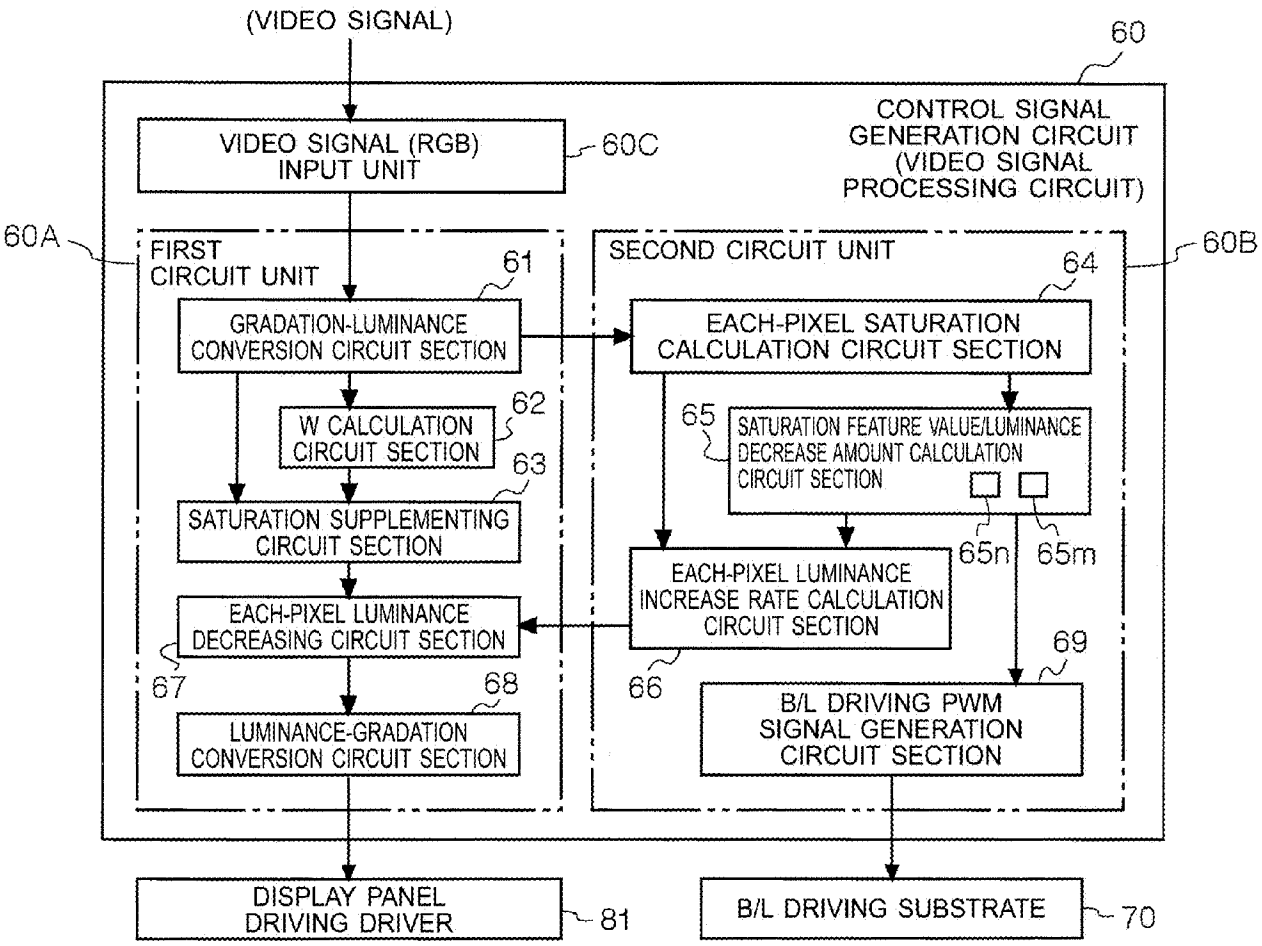
FIG. 1 is a block diagram showing a control signal generation circuit (an example of a peripheral circuit of a saturation feature value/luminance decreasing amount calculation circuit) according to a first exemplary embodiment of the present invention.

As shown in FIG. 1, the control signal generation circuit 60 includes: a video signal (RGB) input unit 60C which receives video signals (gradation signals) of RGB from the video signal supply source 20; a first circuit unit 60A which controls (generates and processes signals) of the light-up amount of the pixels of the RGBW-type display panel 80 including W based on the video signals inputted from the video signal input unit 60C; and also a second circuit unit 60B which calculates the feature value of the saturation (saturation feature value) in one frame based on the video signals (RGB), and calculates the luminance of the pixels and the decrease amount of the B/L luminance.

The first circuit unit 60A includes: a gradation-luminance conversion circuit section 61 which converts inputted RGB video signals (gradation signals) into RGB luminance signals; a W calculation circuit section 62 which generates the luminance signal of W from the minimum value out of the luminance signals of RGB; and a saturation supplementing circuit section 63 which supplements the saturation of each pixel according to the light-up amount of W to prevent the color of the image from becoming whitish due to the lighting up of the W. W is lighted up by the luminance signal of W generated by the W calculation circuit section 62.

The second circuit unit 60B includes: an each-pixel saturation calculation circuit section 64 which calculates the saturation information (saturation value) of each pixel from the RGB luminance signals after being converted by the gradation-luminance conversion circuit section 61; a saturation feature value/luminance decrease amount calculation circuit section 65 which calculates the saturation feature value of the video signals in one frame based on the saturation information of each pixel and determines the decrease amount of the B/L luminance with respect to the luminance increase rate to be the reference; and an each-pixel luminance increase rate calculation circuit section 66 which calculates the luminance increase rate of each pixel by using the saturation feature value calculated in the manner described above and the saturation information of each pixel.

Further, the first circuit unit 60A includes: an each-pixel luminance decreasing circuit section 67 which performs luminance decreasing processing for each pixel whose luminance increase rate calculated by the each-pixel increase rate calculation circuit section 66 is too large compared to the reference luminance increase rate and determines the luminance signals of RGBW; and a luminance-gradation conversion circuit section 68 which converts the luminance signals to the gradation signals to generate the gradation signals of RGBW. The luminance-gradation conversion circuit section 68 is structured to transmit the generated RGBW gradation signals to the display panel driving driver 81 according to a prescribed transmission format.

In addition, the second circuit unit 60B includes a B/L driving PWM signal generation circuit section (PWM signal generation circuit) 69 which converts the luminance decrease amount to the PWM signal by using the value of the decrease amount of the B/L luminance determined by the saturation feature value/luminance decrease amount calculation circuit section 65 and transmits it to the B/L driving substrate 70. According to the PWM signal, the luminance decreasing processing is achieved by the B/L drive control circuit 70a of the B/L driving substrate 70.

Next, the structural content regarding RGBW signal generating processing and luminance control processing will be described in details.

First, as described above, the gradation-luminance conversion circuit section 61 which converts the RGB video signals (gradation signals) inputted from the video signal supply source 20 is specifically structured to convert each of the RGB gradation signals (Tin, Gin, Bin) into the relative luminance according to Expression 1 in the followings. The gradation signals (Rin, Gin, Bin) are values from 0 to 255 in case of 8-bit input and values of 0 to 1023 in case of 10-bit input.

(Expression 1)

$$RL=(\mathrm{Rin}/f(n))\hat{}2.2$$

$$GL=(\mathrm{Gin}/f(n))\hat{}2.2$$

$$BL=(\mathrm{Bin}/f(n))\hat{}2.2 \quad (1)$$

Note here that f(n) is the resolution, and it is defined as "f(n)=2^n−1". Therefore, it can be expressed as "f(8)=255" in case of 8-bit input (0-255 gradation display) and as "f(10)=1023" in case of 10-bit input (0-1023 gradation display). Further, in a case where it is desired to increase the resolution of the computation even with 8-bit input by 4 bits, "255×16=4080" may be set as f(n). Other than the method which converts the gradation signal to the relative luminance, it is also possible to employ a method which executes processing with gradations. However, the first exemplary embodiment employs the method of converting to the luminance.

As the processing methods regarding calculation of the W signal, there are a method which replaces W components of RGB of inputted RGB signals with W, a method which lights up W for the same luminance amount as that of the W component of RGB and supplements the saturation, and the like. (The luminance is increased but the image becomes whitish compared to the original image so that a sense of discomfort is felt in the image quality, if W is lighted up simply. It is necessary to supplement the saturation in order to prevent a sense of discomfort felt in the image quality.)

Further, as the operation principle for achieving reduction of the power of the backlight in association with B/L control (herein means the B/L control which collectively controls the entire screen), there is a method which lights up the luminance corresponding to the W components of RGB as W, supplements the saturation if necessary, and decreases the luminance increased by the light-up amount of W by the luminance of the backlight.

Simply, when video signals having low saturation as a whole are inputted, the light-up amount of W becomes large. Thus, the B/L luminance is decreased. In the meantime, when video signals having high saturation are inputted, the light-up amount of W becomes small. Thus, the B/L luminance is not decreased.

For example, as the video signals having low saturation as a whole, it is possible to assume cases where the ratios of the gradations of R, G, and B are the same such as white, black, and grayscale. As the video signals having high saturation, it is possible to assume cases of red (R) only, green (G) only, blue (B) only (referred to as primary color) (W is not lighted up since a sense of discomfort is generated in the image quality, such as becoming whitish when W is lighted up in the primary colors).

From the above, the decrease amount of the B/L luminance is increased when an image of low saturation is inputted. Therefore, it is expected to decrease the power consumption.

According to the first exemplary embodiment, the W calculation circuit section 62 which generates W signal (hereinafter recited as WL) from the RGB luminance signals (RL, GL, BL) of each pixel after being converted by the gradation-luminance conversion circuit section 61 generates the minimum value of (RL, GL, BL) as WL as shown in following Expression 2.

(Expression 2)

$$WL=\min(RL, GL, BL) \quad (2)$$

When WL is lighted up in each pixel, the image under such state appears whitish compared to the original image. Thus, it is necessary to supplement the saturation. Therefore, the first exemplary embodiment employs the structure with which the saturation is supplemented by the saturation supplementing circuit section 63 by using following Expression 3.

(Expression 3)

$$Rc=(1+\mathrm{MIN}/\mathrm{MAX})\times RL-\mathrm{MIN}$$

$$Gc=(1+\mathrm{MIN}/\mathrm{MAX})\times GL-\mathrm{MIN}$$

$$Bc=(1+\mathrm{MIN}/\mathrm{MAX})\times BL-\mathrm{MIN} \quad (3)$$

Note here that MIN is the minimum value of RL, GL, BL, and MAX is the maximum value of RL, GL, BL (MIN=min (RL, GL, BL), MAX=max(RL, GL, BL)). This also applies to each of following Expressions.

With this processing, one pixel constituted with Rc, Gc, Bc, and WL with supplemented saturation can maintain the same saturation as that of the one pixel constituted with the original RL, GL, BL. Therefore, it is possible to overcome such a sense of discomfort in the image quality that the image appears whitish with respect to the original image. It is assumed that Expression 2 described above is used to calculate WL herein.

The RGBW drive related to the above-described driving principle of the RGBW-type display panel is a technique which makes it possible to decrease the power consumption of the backlight by decreasing the luminance of the backlight for the luminance amount increased by lighting up W. Further, the light-up amount of W in each pixel depends on the saturation of each pixel as described above (e.g., the light-up amount of W is small in the pixel of high saturation, and the light-up amount of W is large in the pixel of low saturation).

The first exemplary embodiment employs the structure with which the saturation feature value (Rank) to be described later is calculated by using this dependent relation, so that the each-pixel saturation calculation circuit section 64 executes the calculation processing of the saturation information (saturation value) of each pixel required for the calculation by following Expression 4.

(Expression 4)

$$\mathrm{chroma}=(\mathrm{MAX}-\mathrm{MIN})/\mathrm{MAX} \quad (4)$$

The value of chroma (saturation value) is calculated by each pixel by the each-pixel saturation calculation circuit section 64. The larger calculation value means that the saturation of the pixel is high, and the smaller value means that the saturation of the pixel is low. Further, the saturation value is closely related to the light-up amount of W. W is not lighted up (since MIN is 0) in a case of a primary-color pixel, for example, so that "chroma=1". In a case where the relative luminance ratios of RGB are the same such as a case of grayscale, "MAX=MIN". Therefore, "chroma=0" so that W is lighted up equivalently for the luminance components of such pixel.

That is, W is lighted up more in the pixel of lower saturation, while W is not lighted up for the pixel of higher saturation. Thus, the luminance increase amount of each pixel can be calculated by using the saturation value of each pixel. The numerical value for determining the decrease amount of the B/L luminance based on the saturation information of each pixel is referred to as a saturation feature value.

Regarding the saturation feature value, as described above, considered are: a method which takes the pixel of the minimum luminance increase amount among each pixel in one screen in a given image as the reference and decreases the luminance of the entire backlight for the luminance increase rate; and a method which takes an average value of the saturation of each pixel in one screen as the reference, and decreases the luminance of the entire backlight for the luminance increase rate.

However, with the former method, the B/L luminance cannot be decreased if there is even one pixel whose saturation is 1 (primary color) in one screen. Thus, the power consumption decreasing effect of the backlight becomes extremely small. Further, with the latter method, when a primary color is displayed in a part of all-white background, for example, the luminance of the primary-color display part cannot be increased and the luminance of the primary-color display part is decreased by decreasing the entire B/L luminance. This increases the luminance difference between the white display part and the primary-color display part. Therefore, a sense of darkness and dullness is increased in the color, thereby causing a sense of discomfort generated in the image quality with respect to the original image.

Thus, the control signal generation circuit 60 (video display device 100) according to the first exemplary embodiment employs the structure with which following Expressions 5, 6, 7, and 8 are used for the calculation processing of the saturation feature value (Rank).

Condition 1: Case of Chroma (k)≤A (Expression 5)

$$Xa=\Sigma\{1-(1/A)\times\text{chroma}(k)\} \quad (5)$$

Condition 2: Case of Chroma (k)>A (Expression 6)

$$Xb=\Sigma\{1/(1-A)\}\times(\text{chroma}(k)-A) \quad (6)$$

(Expression 7)

$$\text{DAVE}=(Xa+Xb)/\text{resolution number} \quad (7)$$

(Expression 8)

$$\text{Rank}=\text{MAX(chroma)}\times\{B\times\text{DAVE}+(1-B)\} \quad (8)$$

Note here that coefficient A is an arbitrary value satisfying "0<A<1", and coefficient B is an arbitrary value satisfying "0<B<1". Further, chroma(k) is the saturation information (saturation value) of each pixel acquired by Expression 4 described above, and k is a value from 1 to the resolution number (total number of pixels when four sub-pixels of RGBW form one pixel).

Specifically, the coefficient A is the value used for determining the border point for performing control to suppress the luminance difference between the all-white display part and the primary-color display part in a screen where a primary color is partially displayed in the all-white background as will be described later by referring to FIG. 4, so that it is also referred to as "saturation threshold value". Further, the coefficient B is also referred to as "coefficient regarding luminance control of the backlight".

Σ shown in Expression 5 and Expression 6 means an arithmetic operation in which the saturation value of each pixel acquired by chroma(k) are classified according to Condition 1 and Condition 2 and all of those are added by being applied to corresponding numerical expressions (Expression 5 or Expression 6). MAX(chroma) is the largest value of the saturation in one frame (saturation maximum value). That is, it is the largest value in one frame (there are pixels corresponding to the number of resolution) among the saturation value of each pixel calculated by Expression 4.

"{1−(1/A)×chroma (k)}" of Expression 5 used when the saturation value in each pixel is equal to or smaller than the coefficient A is saturation deviation calculated by adding weight (deviation) to the saturation value by the coefficient A for chroma(k) that is the saturation value. Note here that there are pixels existing in the number corresponding to the number of resolution, so that there are also the number of saturation values to be judged for the number of resolution. Thus, the value of Xa calculated by Expression 5 means a value that is acquired by adding all the values of the saturation deviation that is weighted by the numerical expression of "{1−(1/A)×chroma (k)}" on the saturation values judged as being equal to or smaller than the coefficient A among the saturation values of the number of resolution.

Further, when the saturation value is larger than the coefficient A, the value of the saturation deviation weighted by Expression 6 described above can be acquired. That is, the saturation value of each pixel is the value of the saturation deviation weighted by either Expression 5 or Expression 6, and the sum total Xa or Xb is calculated based thereupon.

That is, the saturation feature value/luminance decrease amount calculation circuit section 65 is structured to calculate the sum totals Xa and Xb of the saturation deviation by using Expression 5 when Condition 1 "chroma(k)≤A" is satisfied and by using Expression 6 when Condition 2 "chroma (k)>A" is satisfied, respectively, and to calculate the total-pixel saturation deviation average value (DAVE) by using Expression 7 based on those values and the resolution number.

Note here that Expression 5, Expression 6, and Expression 7 are difficult to be calculated by each pixel. However, as described above, a correct value of MAX(chroma) cannot be settled until one frame ends. Therefore, the actual correct value of Rank (saturation feature value) is settled after the processing for one frame is completed.

Thus, it is also possible to employ a structure which executes processing of setting in advance proper initial values as the value of Rank and the value of MAX(chroma) or keeping the value of Rank of the first one frame, for example. With such structure, it is possible to suppress the influence such as a sense of discomfort imposed upon the image quality.

Further, it is also possible to employ a structure in which a treatment using a running average, a filter function, or the like is performed by associated with cases where a radical luminance change or the like is concerned in a video or the like. This makes it possible to eliminate a large influence imposed upon the image quality.

Further, the saturation feature value/luminance decrease amount calculation circuit section 65 calculates the decrease amount of the B/L luminance by following Expression 9 that uses coefficient C and the saturation feature value.

(Expression 9)

$$\text{PWM}=1/\{C-(C-1)\times\text{Rank}\} \quad (9)$$

The coefficient C in Expression 9 is an arbitrary value satisfying "1≤C≤2", and it is optimal to satisfy "C=2×Y" where Y is defined as "(aperture area of sub-pixels of RGBW product)/(aperture area of sub-pixels of RGB product)" (i.e., ratio of the aperture area of the sub-pixels of the RGBW product with respect to the aperture area of the sub-pixels of the RGB product).

Further, PWM is a dimming rate. The B/L light-up rate is 100% when PWM=1, and the B/L light-up rate is 0% when PWM=0, i.e., lights out. For example, in a case where PWM=0.75, it shows that the B/L light-up rate is 75%. Thus, the luminance decrease rate in this case is 25%.

Subsequently, the saturation feature value/luminance decrease amount calculation circuit section 65 within the control signal generation circuit 60 that is the feature structure of the first exemplary embodiment will be described in details by referring to FIG. 2.

Figure 2:
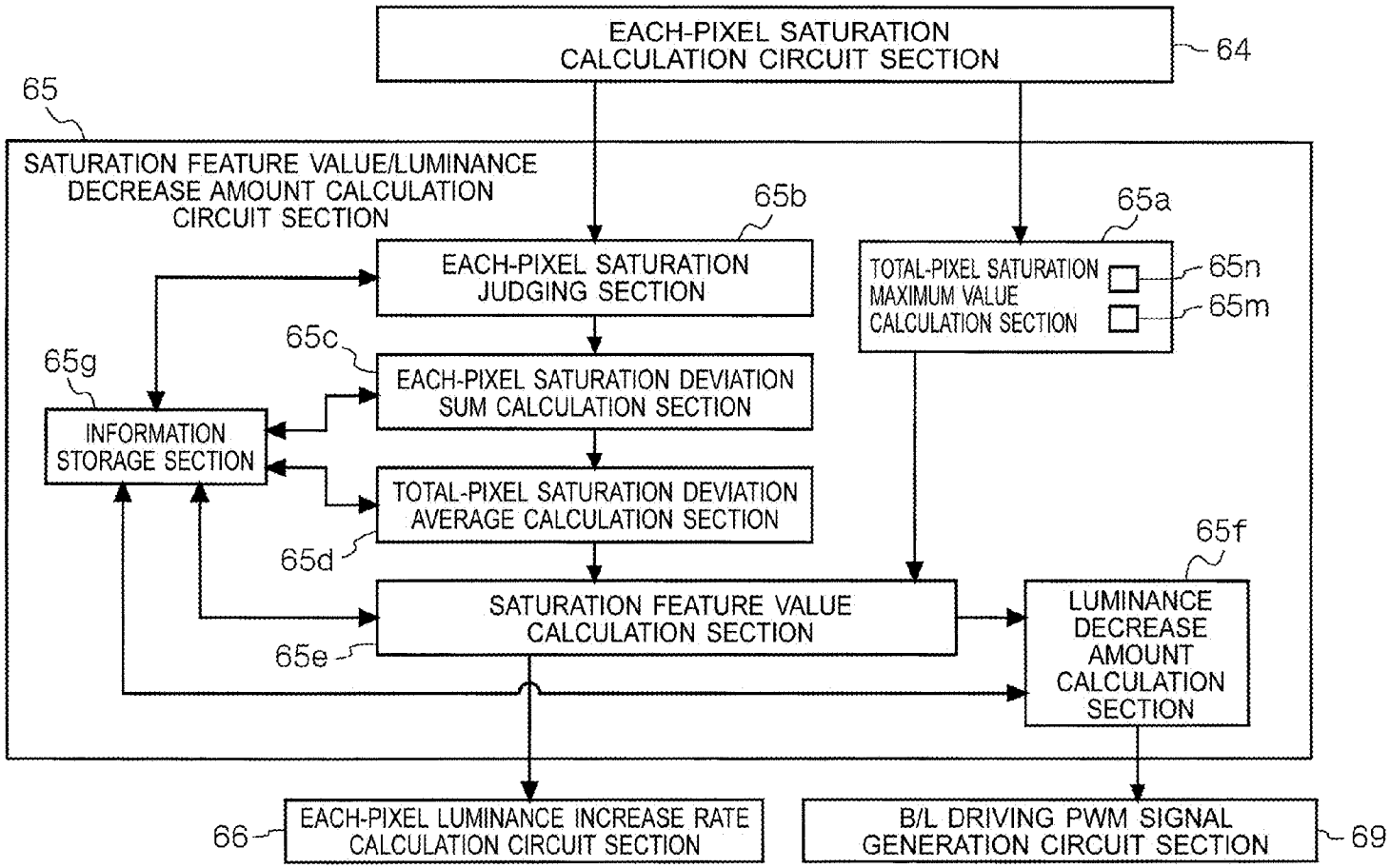
FIG. 2 is a block diagram showing a specific structure of the saturation feature value/luminance decreasing amount calculation circuit that is provided to the control signal generation circuit disclosed in FIG. 1.

As shown in FIG. 2, the saturation feature value/luminance decrease amount calculation circuit section 65 includes: a total-pixel saturation maximum value calculation section 65*a* which calculates the maximum value of the saturation (saturation maximum value) in one frame based on the saturation information of each pixel generated by the each-pixel saturation calculation circuit section 64; an each-pixel saturation judging section 65*b* which judges whether to use Expression 5 or Expression 6 described above based on the extent of the saturation value of each pixel generated also by the each-pixel saturation calculation circuit section 64; an each-pixel saturation deviation sum calculation section 65*c* which calculates the sum totals Xa and Xb of the saturation deviation by using Expression 5 and Expression 6 based on the result of the judgment, the saturation values (chroma), and the coefficient A; a total-pixel saturation deviation average calculation section 65*d* which calculates a total-pixel saturation deviation average value (DAVE) by using Expression 7 from the sum totals Xa and Xb of the saturation deviation and the resolution information (resolution number) of the RGBW-type display panel 80; a saturation feature value calculation section 65*e* which calculates a saturation feature value by Expression 8 described above by using the saturation maximum value in one frame acquired by the total-pixel saturation maximum value calculation section 65*a*, the total-pixel saturation deviation average value acquired by the total-pixel saturation deviation average calculation section 65*d*, and the coefficient B; and a luminance decrease amount calculation section 65*f* which calculates and determines the luminance decrease amount of the backlight by Expression 9 described above by using the saturation feature value and the coefficient C.

The saturation feature value calculation section 65*e* is structured to transmit the saturation feature value calculated in the manner described above also to the each-pixel luminance increase rate calculation circuit section 66 in addition to the luminance decrease amount calculation section 65*f*. Based thereupon, the luminance decrease rate of each pixel is determined, and the luminance decreasing processing is performed on the pixels that become too bright, etc.

The luminance decrease amount calculation section 65*f* is structured to transmit the luminance decrease amount of the backlight determined in the manner described above to the B/L driving PWM signal generation circuit section 69 as the value for generating the PWM signal.

Further, the saturation feature value/luminance decrease amount calculation circuit section 65 further includes an information storage section (coefficient setting section) 65*g* which sets/stores in advance the values such as the coefficient A, the coefficient B, the coefficient C, the resolution information, and the like, and such information is used when various kinds of calculations are executed by each of the above-described structural members.

For example, the each-pixel saturation judging section 65*b* reads out the coefficient A from the information storage section 65*g*, and makes judgment regarding "whether the saturation value of each pixel is equal to or smaller than the coefficient A or larger than the coefficient A". The each-pixel saturation deviation sum calculation section 65*c* is structured to read out the coefficient A from the information storage section 65*g* and to calculate the sum totals Xa and Xb of the saturation deviation from the saturation values and the coefficient A.

As the information storage section 65*g*, a register inside an IC may be functioned for that. However, it is more preferable to employ a structure with which an external ROM (EEPROM or the like) or the like is functioned as the information storage section 65*g* to be able to change each of the values.

Here, the structure regarding calculation of the saturation information (saturation value) of each pixel by the each-pixel saturation calculation circuit section 64 and determination of the saturation maximum value by the total-pixel saturation maximum value calculation section 65*a* will be described in a specific manner.

The each-pixel saturation calculation circuit section 64 is structured to calculate the saturation value of the N-th pixel (N is an arbitrary natural number within a range of the resolution number) in one frame and to transmit it to the saturation feature value/luminance decrease amount calculation circuit section 65. The total-pixel saturation maximum value calculation section 65*a* of the saturation feature value/luminance decrease amount calculation circuit section 65 acquiring the calculation value has it stored temporarily to A register 65*n* and to compare the value of the A register 65*n* with the value (initial value=0) of a MAX register 65*m*.

Further, the total-pixel saturation maximum value calculation section 65*a* is structured to update the value of the MAX register 65*m* to the value of the A register 65*n* when the value of the A register 65*n* is equal to or larger than the value of the MAX register 65*m* and to hold the value of the MAX register 65*m* when the value of the A register 65*n* is less than the value of the MAX register 65*m*.

The total-pixel saturation maximum value calculation section 65*a* is structured to execute the processing of updating or holding the saturation values stored in the MAX register 65*m* on the 1st to the N-th pixels (N is an arbitrary natural number that is the same value as the number of resolution) in the order determined in advance in one frame, and settles the value of the MAX register 65*m* as the saturation maximum value when the processing for all the pixels is completed.

The settled saturation maximum value is the value used for various kinds of arithmetic operations as MAX(chroma). The total-pixel saturation maximum value calculation section 65*a* executes the same processing for the next frame.

Next, specific contents of Expression 5 to 8 and each of the coefficients (A, B, C) above will be described by referring to FIG. 4 and FIG. 5.

Figure 4:
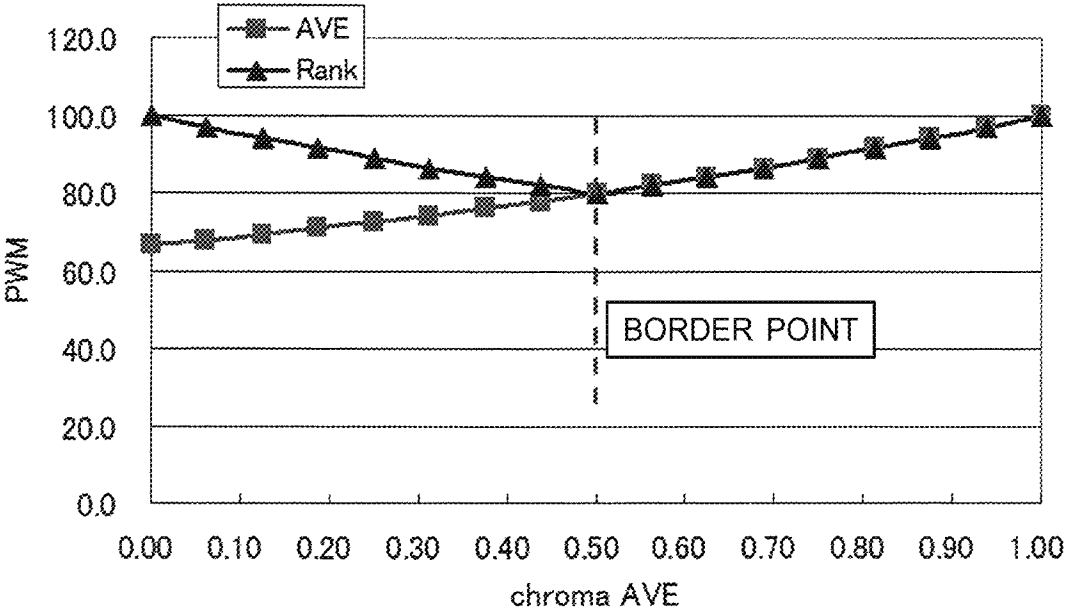
FIG. 4 is a graph showing an example of the relation between saturation feature values and PWM values regarding PWM-value control executed in the first exemplary embodiment of the present invention.

In the graph shown in FIG. 4, the lateral axis shows the average value of the saturation (average of the saturation of each pixel in one frame) while the longitudinal axis shows the PWM value. When the PWM value is 100%, there is no B/L luminance decrease. When the PWM value is 80%, the B/L luminance is decreased by 20%.

A line (AVE) plotted with rectangles shows a case where the average value of the saturation is taken as the saturation feature value (feature value). In this case, it can be seen that the PWM value decreases accordingly when chromaAVE decreases.

Figure 5:
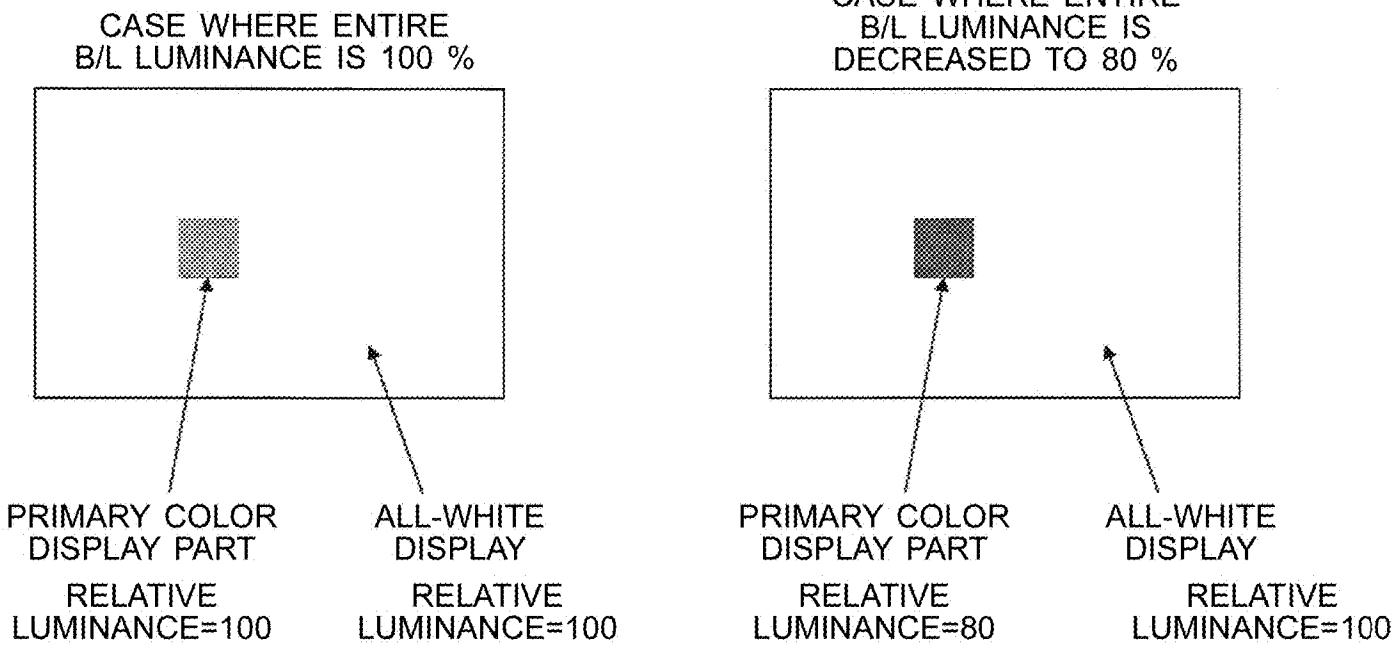
FIG. 5 is a reference chart showing an example of the influence imposed upon an image according to the relation of the luminance ratio between a white display part and a primary-color display part.

Here, considering a screen on which a primary color is partially displayed on an all-white background as shown in FIG. 5, the average value of the saturation becomes small since all-white part occupies the most part of the screen. That is, on the line (AVE), the PWM value decreases in accordance with the decrease in the average value of the saturation. Thus, in the case of such screen, the PWM value takes a small value.

In a case where the B/L relative luminance is decreased to 80% as shown in the right chart of FIG. 5, light-up amount is increased for making relative luminance of all-white 100. However, luminance of primary-color display part cannot be increased, so that luminance difference with respect to surrounding all-white is increased. Therefore, with the processing executed based on the line (AVE), a sense of darkness and dullness in the color is increased in the case shown in the right chart of FIG. 5, for example. Thus, a sense of discomfort is felt in the image quality when such screen is observed.

Therefore, in the case of the screen where a primary color is displayed partially on an all-white background, processing that does not decrease the PWM value is preferred. That is, it is preferable to execute control with which the B/L luminance is not decreased when there is a primary color even on a screen where a certain border point is set and the average value of the saturation is small.

Expression 5 to Expression 8 described above are numerical expressions of such control content. By using each of those expressions, it is possible to achieve the processing based on a line (Rank) plotted with triangles in FIG. 4. Note here that the coefficient A (saturation threshold value) is the coefficient used in Expression 5 and Expression 6, and it is the value used for determining the border point for controlling not to increase the luminance difference between the all-white display part and the primary-color display part on a screen where a primary color is displayed partially in an all-white background.

That is, the value of the coefficient A determines the position of the border point on the lateral axis side (chromaAVE side) in FIG. 4. The border point can be set on the small side of chromaAVE when the value of the coefficient A is set to be small, and the border point can be set on the large side of chromaAVE when the value of the coefficient A is set to be large. For example, as shown in FIG. 4, the coefficient A may be set as A=0.5 when setting the border point as 0.5.

Based on Xa and Xb calculated by the each-pixel saturation deviation sum calculation section 65*c* from Expression 5 and Expression 6 based on the coefficient A, the total-pixel saturation deviation average calculation section 65*d* calculates the saturation deviation average value (DAVE) for the number of resolution according to Expression 7.

Note here that the sum total of the number of the saturation values judged as being equal to or smaller than the coefficient A and the number of the saturation values judged as being larger than the coefficient A is equivalent to the number of resolution. Thus, DAVE acquired by Expression 7 is referred to as the average of the saturation deviation of the total pixels. Further, regarding the number of resolution, the total-pixel saturation deviation average calculation section 65*d* is structured to store the value thereof to the information storage section 65*g* and to read and use it for calculation.

The coefficient B is the coefficient used in Expression 8, and it is the coefficient that determines the extent of the PWM decrease rate of the line (Rank) plotted with triangles shown in FIG. 4. The decrease rate of PWM becomes smaller when the coefficient B becomes closer to 0, and the decrease rate of PWM becomes larger when the coefficient B becomes closer to 1 (the PWM value at the border point on the line of Rank is the minimum PWM value, and the value of the PWM minimum point changes).

That is, the value of the coefficient B determines the position of the border point on the longitudinal axis side (PWM side) in FIG. 4. The border point can be set on the large side of PWM on the longitudinal axis by setting the value of the coefficient to be small, and the border point can be set on the small side of PWM by setting the value of the coefficient to be large.

As described, the minimum value of PWM can be changed by changing the coefficient B. However, it is desirable for that value to be along the AVE line (line plotted with rectangles) until the border point. It is because the backlight power consumption decreasing effect is reduced when the PWM minimum point is increased excessively, and the image quality is deteriorated (a sense of reduction in the luminance felt thereby becomes great) when the PWM minimum point is decreased excessively. As a result of searching the best point by actually checking the image quality, it is found to be the best to set the point along AVE.

As shown in the saturation feature value (Rank) of FIG. 4, the first exemplary embodiment is structured to control the PWM value, i.e., the B/L luminance, by the saturation feature value. More specifically, the first exemplary embodiment employs the structure with which: the luminance decrease amount of the backlight is set as small when the saturation average value of each pixel in one frame of a video signal is high; until reaching the saturation threshold value (border point) from there, the luminance decrease amount of the backlight is set to be increased continuously as the average value of the saturation becomes smaller; when exceeding the saturation threshold value (border point), the luminance decrease amount of the backlight is set to be decreased continuously; and at the border point, the luminance decrease amount of the backlight changes continuously without making a radical change.

That is, the saturation feature value/luminance decrease amount calculation circuit section 65 is structured to: set the luminance decrease amount of the backlight as a small value according to the average value when the average value of the saturation value of each pixel is higher than the saturation threshold value; calculate the luminance decrease amount to increase continuously as the average value becomes decreased until reaching the saturation threshold value from the high value; calculate the luminance decrease amount to decrease continuously as the average value becomes decreased after exceeding the saturation threshold value; and calculate the luminance decrease amount to continue at the saturation threshold value.

Considering it in a specific image as a way of example, the B/L luminance decrease amount is set as small in a case where inputted video signals are for high saturation color solid display. In a case of low saturation color solid display or a screen containing a primary color (R only, G only, or B only) in a part of an intermediate saturation color solid display, the luminance decrease amount of the backlight is set as large. In a case of a screen containing a primary color in a part of all-white (achromatic color) display as the video signals, the luminance decrease amount of the backlight is controlled to be small.

By controlling the B/L luminance in such manner, it becomes possible to reduce the power consumption of the backlight effectively while suppressing a sense of discomfort in the image quality as much as possible.

Next, the coefficient C is the coefficient used in Expression 9 described above, and it is the coefficient that determines the PWM value when chromaAVE=0 on the line AVE plotted with rectangles shown in FIG. 4. The PWM value of chromaAVE=0 becomes larger as the coefficient C becomes closer to 1, and the PWM value of chromaAVE=0 becomes smaller as the coefficient C becomes closer to 2.

Note, however, that the value is closely related with the ratio between the white luminance generated by RGB and the white luminance generated by W. Thus, when it is simply set to be closer to 2, it is possible that a desired white luminance value cannot be acquired.

For example, when assuming that a case where the area of each sub-pixel is ¾ in a structure where the ratio between the white luminance of RGB and the white luminance of W is 1:1, the luminance increase rate is 1.5 times that of the RGB product. As in this case, the coefficient C may be set as C=1.5 under the condition where the luminance increase rate is 1.5 times with respect to that of the RGB product.

Desirably, not just the assumption made for convenience as described above, the coefficient C may be set as C=2×Y by considering the ratio (Y) of the aperture area of each sub-pixel of the RGBW product with respect to the aperture area (area of sub-pixels where the light of B/L can transmit) of each sub-pixel of the RGB product.

In that case, C=1.5 when Y is 0.75 (i.e., ¾). When Y becomes smaller than 3/4 due to the influence of the wiring and the like, C=1.4 when Y=0.7, for example. That is, it becomes possible to align the white luminance of the RGBW product more precisely for the RGB product by taking the rate of the aperture areas into consideration (note, however, that it is assumed that the areas of each of the sub-pixels in RGBW are the same).

(Explanation Using Specific Numerical Values)

Figure 6:
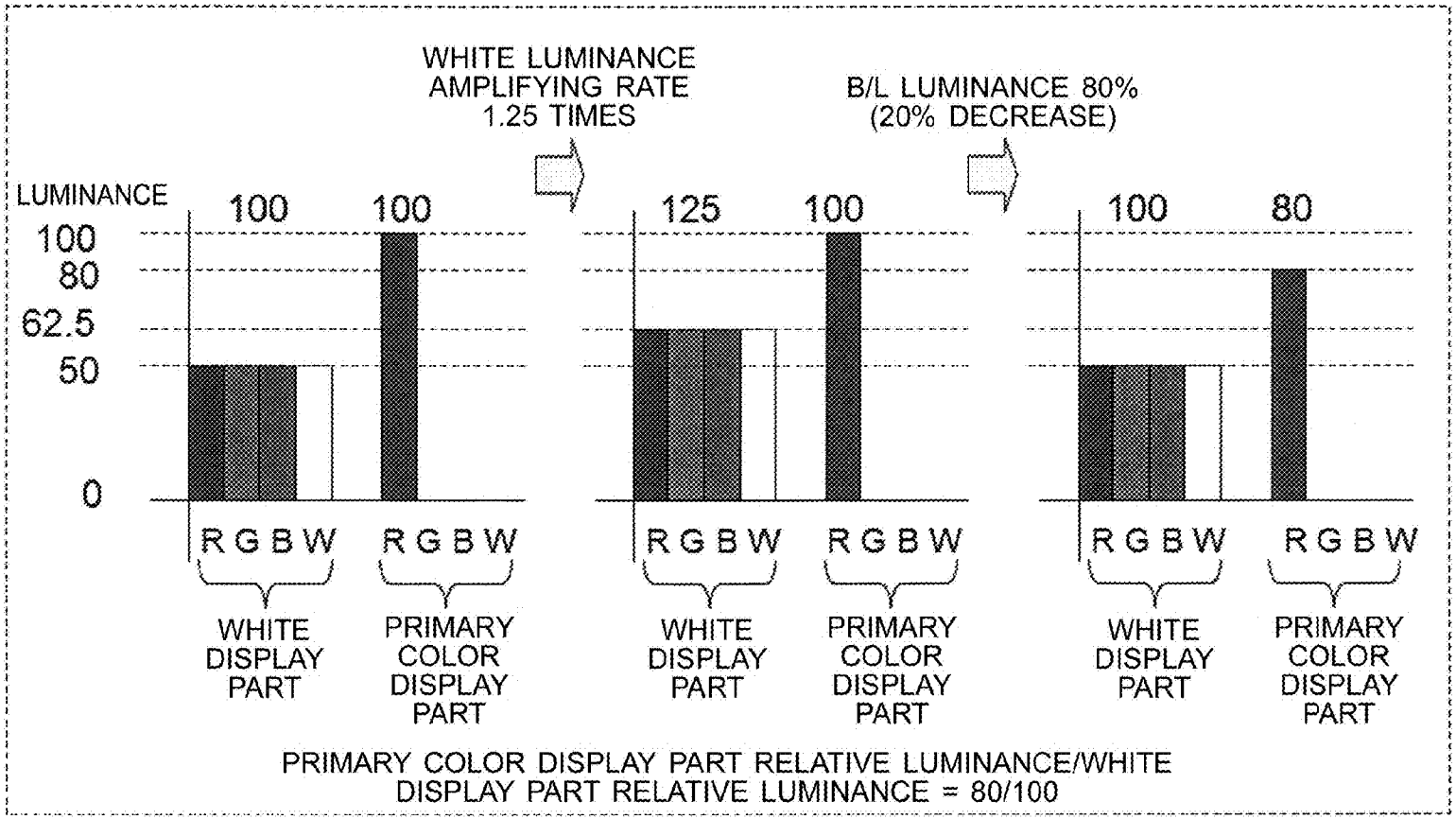
FIG. 6 is a column chart showing a case where the white luminance is increased in the relation of the luminance ratio between the white display part and the primary-color display part.

Now, as in FIG. 6 (Chart 1), values of the coefficient A, the coefficient B, and the coefficient C functioning as described above are set and various assumed screens of each of the cases (Cases (I) to (III)) to which specific numerical values are substituted are considered.

For simplifying the explanation, the number of pixels in one frame is assumed as "5" herein. In a case of VGA (video graphics array: standard of display), it is calculated as 640×480=307200.

Further, the saturation value of each pixel is defined to be the values of 0 (achromatic color) to 1 (primary color).

First, Case (I) is an assumed occasion where a high-saturation image exists in a part of the screen even though the whole screen is not of high saturation (an occasion where at least one pixel of a primary color exists on the screen). In that case, when driving the saturation feature value with the maximum value standard, the power consumption of B/L cannot be reduced.

However, with the first exemplary embodiment that employs the structure related to Expression 5 to Expression 8, it is possible to acquire "PWM=0.926" by performing calculations as follows.

$$\begin{aligned} Xa &= \Sigma(1-2\times\text{chroma}(k)) \\ &= (1-2\times\text{chroma}(3))+(1-2\times\text{chroma}(5)) \\ &= (1-2\times0.1)+(1-2\times0)=0.8+1=1.8 \end{aligned}$$

-continued $$\begin{aligned} Xb &= \Sigma(1/0.5\times(\text{chroma}(k)-1)) \\ &= (1/0.5\times\text{chroma}(1)-1)+(1/0.5\times\text{chroma}(2)-1)+ \\ &\quad (1/0.5\times\text{chroma}(4)-1) \\ &= (1/0.5\times0.6-1)+(1/0.5\times1-1)+(1/0.5\times0.7-1) \\ &= 0.2+1+0.4=1.6 \end{aligned}$$

$$\text{DAVE}=(Xa+Xb)/\text{resolution number}=(1.8+1.6)/5=0.68$$

$$\begin{aligned} \text{Rank} &= \text{MAX(chroma)}\times\{0.5\times\text{DAVE}+(1-0.5)\} \\ &= 1\times(0.5\times0.68+0.5)=0.84 \end{aligned}$$

$$PWM=1/(1.5-(1.5-1)\times\text{Rank})=1/(1.5-0.5\times0.84)=0.926$$

Thereby, the PWM value becomes 92.6%. Thus, it is found that about 7.4% of reduction in the power consumption of B/L can be achieved.

As described, with the control signal generation circuit 60 according to the first exemplary embodiment and the video processing device 100 including it can reduce the power consumption of B/L effectively eve in a case of a screen which is not of high saturation as a whole but includes the pixels of high saturation partially.

Next, Case (II) is an assumed occasion where a primary color is displayed partially on an all-white background. In that case, "PWM=1" is acquired by following calculations using Expression 5 to Expression 8 same as the above.

$$\begin{aligned} Xa &= \Sigma(1-2\times\text{chroma}(k)) \\ &= 4 \end{aligned}$$

$$\begin{aligned} Xb &= \Sigma(1/0.5\times\text{chroma}(k)-1)) \\ &= 1 \end{aligned}$$

$$\text{DAVE}=(Xa+Xb)/\text{resolution number}=(4+1)/5=1$$

$$\begin{aligned} \text{Rank} &= \text{MAX(chroma)}\times\{0.5\times\text{DAVE}+(0.5)\} \\ &= 1\times(0.5\times1+0.5) \\ &= 1 \end{aligned}$$

$$PWM=1/(1.5-(1.5-1)\times\text{Rank})=1/(1.5-0.5\times1)=1$$

Thereby, the PWM value becomes 100%. Thus, the power consumption of B/L is not reduced in the case of such screen. Therefore, in a case where the method of determining the luminance decrease amount of the entire backlight by taking the W minimum light-up pixel as the reference is employed, the luminance of the backlight cannot be decreased if there is even one point of pixel whose light-up amount of W is 0 (W is not lighted-up) existing on the screen. Therefore, the power consumption decreasing effect cannot be acquired.

Such structure is employed by considering such an issue that a sense of darkness and dullness is likely to be felt since the relative luminance difference between the luminance of the all-white part and the luminance of the primary-color part becomes large when the luminance of B/L is decreased on a screen where a primary color is displayed partially on the all-white background as the screen assumed in Case (II). That is, in the case of such display, the first exemplary embodiment employs the structure with which control is executed so as not to decrease the B/L luminance in order to place priority on suppression of a sense of discomfort generated in the image quality such as a sense of darkness and dullness.

Figure 7:
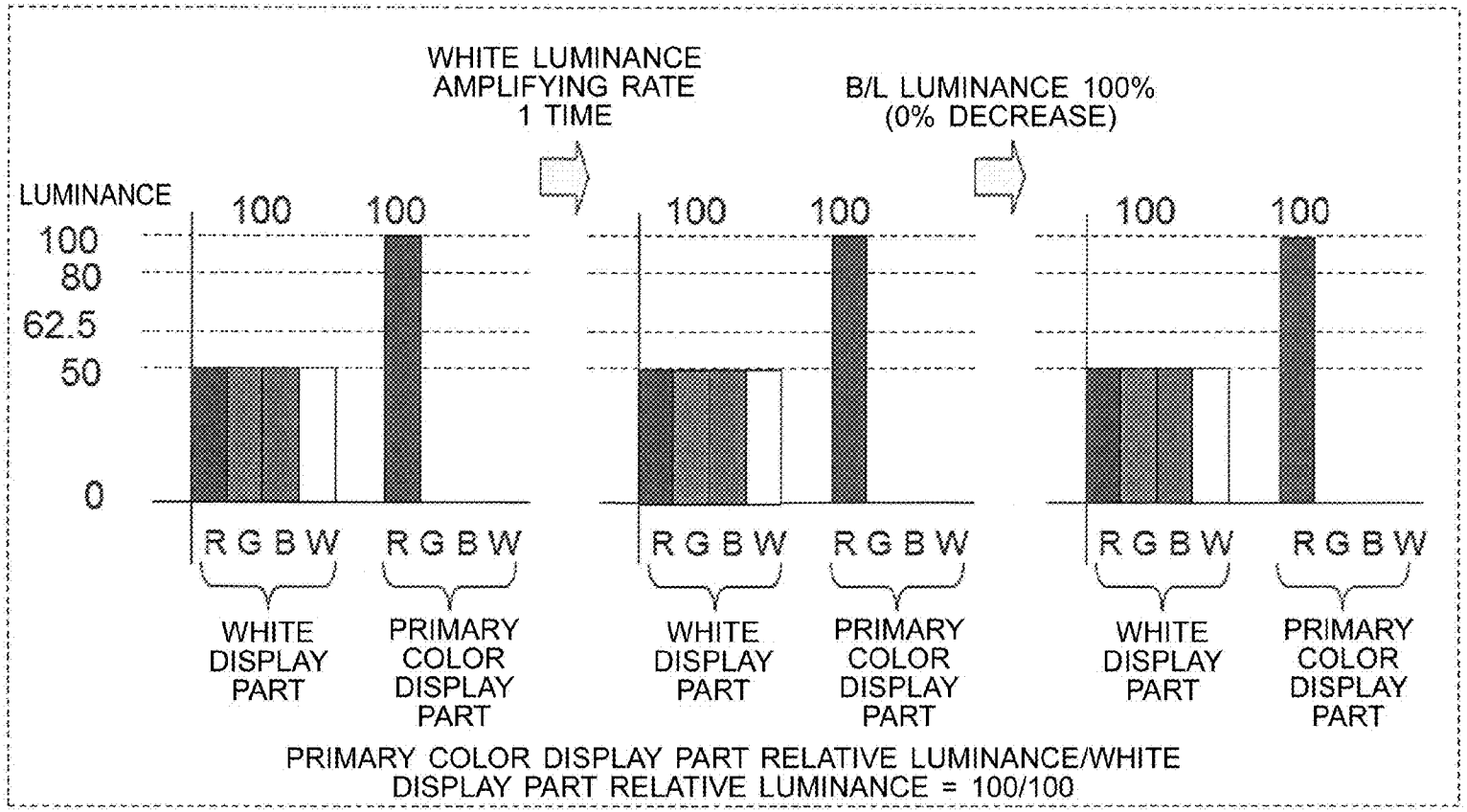
FIG. 7 is a column chart showing a case where the white luminance is not increased in the relation of the luminance ratio between the white display part and the primary-color display part.

Here, the reason why the sense of darkness and dullness is easily felt when the relative luminance difference between the luminance of the all-white part and the luminance of the primary-color display part is increased will be described by referring to FIG. 5 to FIG. 7.

In a case where the B/L luminance is decreased by 80% as in the case of FIG. 5, for example, on a screen where a primary color is displayed partially on the all-white display, it is necessary to increase the luminance of all-white background by 25% to have the relative luminance of 100. Increase in the luminance of the all-white background can be achieved by increasing the light-up amount (gradation) of the entire pixels of RGBW.

As in FIG. 6 showing the principle chart thereof, regarding the relative luminance of the all-white part, for example, it is assumed that a total of 100 white luminance is generated with "50" of the white component of RGB and "50" of the white component of W. In the meantime, it is assumed that the R component is "100" in the primary-color display part.

In that case, the relative luminance ratio between the all-white display part and the primary-color display part is 1:1. When the B/L luminance is to be decreased by 80%, it is necessary to increase the white luminance by 25%. As a result, it can be found that the relative luminance ratio between the all-white display part and the primary-color display part is 1:0.8. Incidentally, if W is lighted up in the primary-color display part, the saturation is deteriorated. Thus, W cannot be lighted up (it can be seen also from Expression 2).

As in this case, due to a difference generated in the luminance, a sense of darkness and dullness as shown in FIG. 5 is generated. Therefore, in the case of display as in Case (II), it is preferable not to decrease the B/L luminance as shown in FIG. 7.

Next, Case (III) is an assumed occasion where the image is of low saturation to intermediate saturation. In that case, "PWM=0.723" is acquired by following calculations using Expression 5 to Expression 8 same as the above.

$$Xa = \Sigma(1 - 2 \times \text{chroma}(k)) = 0.7 + 0.6 + 0.4 + 0.6 + 0.5 = 2.8$$

$$Xb = \Sigma(1/0.5 \times \text{chroma}(k) - 1) = 0$$

$$\text{DAVE} = (Xa + Xb)/\text{resolution number} = (0 + 2.8)/5 = 0.56$$

$$\text{Rank} = \text{MAX(chroma)} \times \{0.5 \times \text{DAVE} + (0.5)\} = 0.3 \times (0.5 \times 0.56 + 0.5) = 0.3 * 0.78 = 0.234$$

$$PWM = 1/(1.5 - (1.5 - 1) \times \text{Rank}) = 1/(1.5 - 0.5 \times 0.234) = 0.723$$

Thereby, the PWM value becomes 72.3%. Thus, it is found that about 27.7% of reduction in the power consumption of B/L can be achieved. It can be found that the decreasing effect of the power consumption is increased further with a screen of low saturation as a whole.

As described above, the feature value of the saturation in one frame is calculated by using Expression 5, Expression 6, Expression 7, and Expression 8, and the PWM value to be the base of the B/L luminance decrease amount is determined by using Expression 9.

Subsequently, the structure regarding a way of increasing the luminance of each pixel will be described. The luminance of each pixel is increased by lighting up W.

In the first exemplary embodiment, two kinds of luminance increase amount (defined as LEH) are calculated by the each-pixel luminance increase rate calculation circuit section 66 from Expression 10 and Expression 11 in the followings.

(Expression 10)

$$LEH(c)=C-(C-1)\times\text{chroma}(c) \tag{10}$$

(Expression 11)

$$LEH(\text{Rank})=C-(C-1)\times\text{Rank} \tag{11}$$

Note here that LEH(c) shows the luminance increase amount of each pixel, and LEH(Rank) shows the reference value of the luminance increase amount (the luminance increase amount based on the Rank value taken as the reference) given by the saturation feature value calculated from Expression 8 described above. Further, C is the same value used in Expression 9 described above.

In a case where the luminance increase amount of each pixel acquired by Expression 10 is larger than the luminance increase amount as the reference given by Expression 11, the pixels become too bright.

Thus, the ratio of the pixels that become too bright (luminance increase rate of each pixel) can be acquired by the each-pixel luminance increase rate calculation circuit section 66 from following Expression 12.

(Expression 12)

$$LEH\text{ratio}=LEH(c)/LEH(\text{Rank}) \tag{12}$$

This LEHratio is the ratio of the pixels that become too bright with respect to the reference value. Thus, a reciprocal of the LEHratio is the decrease amount for decreasing the luminance of the pixel that is too bright. That is, the each-pixel luminance decreasing circuit section 67 calculates and determines the signal of RGBW from following Expression 13.

(Expression 13)

$$Rx=Rc/LEH\text{ratio}$$

$$Gx=Gc/LEH\text{ratio}$$

$$Bx=Bc/LEH\text{ratio}$$

$$Wx=WL/LEH\text{ratio} \tag{13}$$

As described above, various kinds of luminance signals of RGBW based on Expression 13 are generated by the each-pixel luminance decreasing circuit section 67.

Further, the luminance signals of RGBW calculated by Expression 13 are converted to the generation signals by the luminance-gradation conversion circuit section 68 by following Expression 14.

(Expression 14)

$$Rout=f(n)\times\{(Rx/f(n))\hat{}(1/2.2)\}$$

$$Gout=f(n)\times\{(Gx/f(n))\hat{}(1/2.2)\}$$

$$Bout=f(n)\times\{(Bx/f(n))\hat{}(1/2.2)\}$$

$$Wout=f(n)\times\{(Wx/f(n))\hat{}(1/2.2)\} \tag{14}$$

Note here that f(n) herein is also the resolution as in the above-described case. In a case of 8-bit input (0-255 gradation display), it is expressed as "f(8)=255". In a case where it is desired to increase the resolution of the computation by 4 bits, "255×16=4080" may be set as f(n). As the case where it is desired to increase the resolution, considered is a case where mainly multi-gradation processing such as FRC is used. Such method is used frequently when it is desired to increase the resolution of the display gradation in a pseudo manner by using such multi-gradation processing.

The gradation signals of (Rout, Gout, Bout, Wout) acquired by Expression 14 are transmitted to the display panel driving driver 81 from the luminance-gradation conversion circuit section 68, and the PWM signal outputted from the B/L driving PWL signal generation circuit section 69 as the circuit for controlling B/L is transmitted to the B/L driving substrate 70. Thereby, the B/L control is performed in the video display device 100 as the RGBW-type display device to achieve reduction in the power consumption of B/L.

(Explanation of Operations)

The operations of the control signal generation circuit 60 and the video display device 100 disclosed in FIG. 1 to FIG. 3 will be described by referring to flowcharts of FIG. 9 to FIG. 11.

(Generation of RGBW Gradation Signals and PWM Signals)

Figure 9:
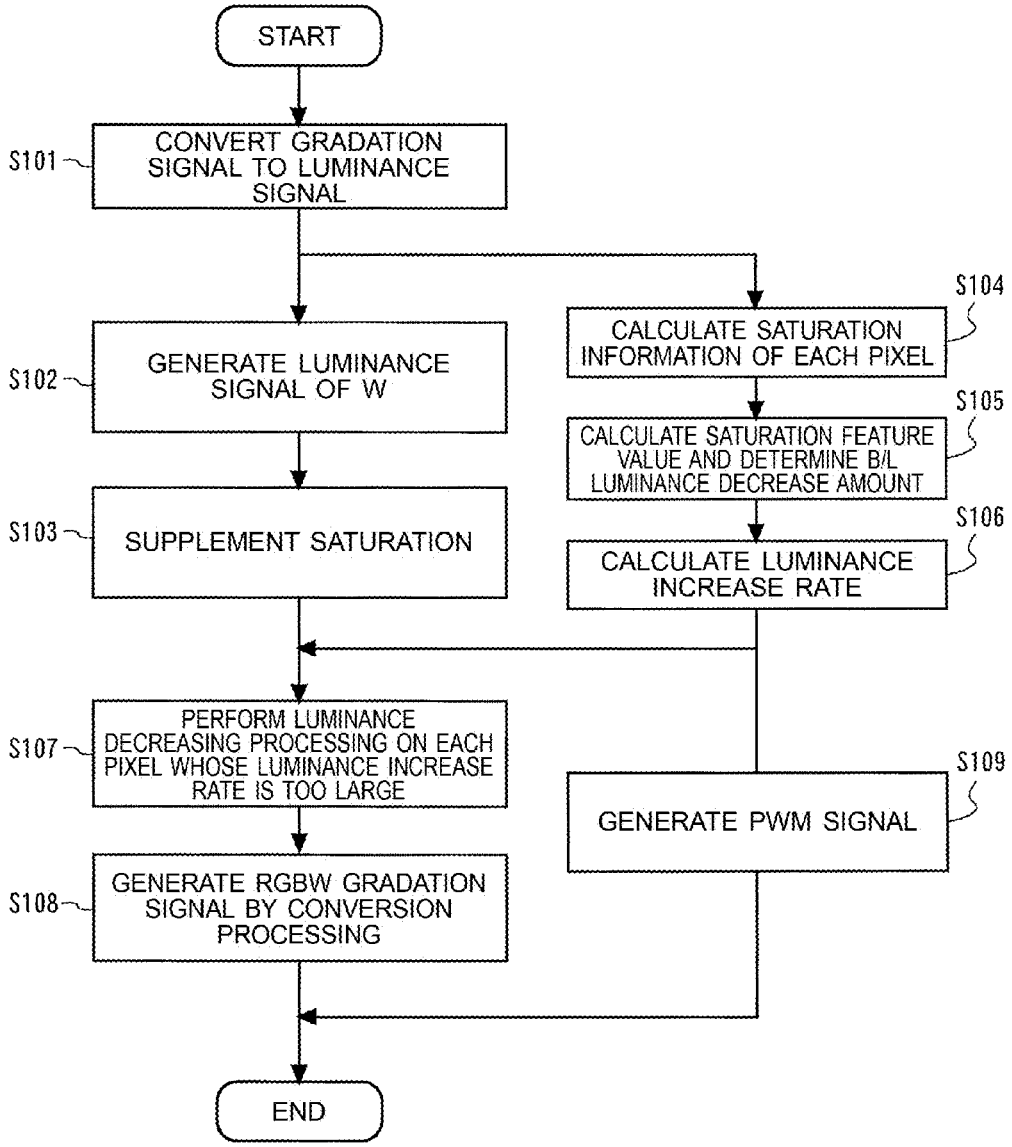
FIG. 9 is a flowchart showing an example of operations done by the control signal generation circuit disclosed in FIG. 1.

The gradation-luminance conversion circuit section 61 upon receiving the video signals (gradation signals) of RGB transmitted from the video signal supply source 20 via the video signal input unit 60C converts the gradation signals of RGB to luminance signals of RGB (FIG. 9: step S101).

Then, the W calculation circuit section 62 generates a video signal of W from the minimum value out of the luminance signals of RGB (FIG. 9: step S102), and the saturation supplementing circuit section 63 supplements the saturation for suppressing the color of image from becoming whitish based on the luminance signal of W (FIG. 9: step S103).

In the meantime, the saturation information of each pixel is calculated by the each-pixel saturation calculation circuit section 64 from the luminance signals of RGB after being converted by the gradation-luminance conversion circuit section 61 (FIG. 9: step S104). The saturation feature value/luminance decrease amount calculation circuit section 65 calculates the saturation feature value of the video signal in one frame based on the saturation information of each pixel, and determines the decrease amount of the B/L luminance according to the luminance increase rate as the reference (FIG. 9: step S105).

Further, the each-pixel luminance increase rate calculation circuit section 66 calculates the luminance increase rate of each pixel by Expression 10 by using the saturation feature value and the saturation information of each pixel, and calculates the luminance increase rate by using Expression 11 (FIG. 9: step S106).

For the pixels whose luminance increase rate calculated from Expression 10 is too large with respect to the reference luminance increase rate calculated from Expression 11, the each-pixel luminance decreasing circuit section 67 performs luminance decreasing processing on each of the corresponding pixels to determine the luminance signals of RGBW (FIG. 9: step S107).

Then, the luminance-gradation conversion circuit section 68 generates the gradation signals of RGBW by converting the luminance signals of RGBW, and transmits those signals to the display panel driving driver 81 according to a prescribed transmission format (FIG. 9: step S108).

Further, the B/L driving PWM signal generation circuit section 69 converts the luminance decrease amount to the PWM signal by using the B/L luminance decrease amount determined by the saturation feature value/luminance decrease amount calculation circuit section 65, and transmits it to the B/L driving substrate 70 (FIG. 9: step S109).

While a series of the above-described operational contents are described in the order of the numbers applied in FIGS. 9 (S101 to S109) for convenience, the execution order is not necessarily limited to the order of the numbers.

(Maximum Value Determining Processing)

Next, specific operations regarding the saturation maximum value determining processing executed by the total-pixel saturation maximum value calculation section 65*a* within the saturation feature value/luminance decrease amount calculation circuit section 65 will be described by referring to the flowchart shown in FIG. 10 . It is assumed herein that N-pieces of pixels exist in one frame, i.e., the maximum value of N corresponds to the number of resolution.

Figure 10:
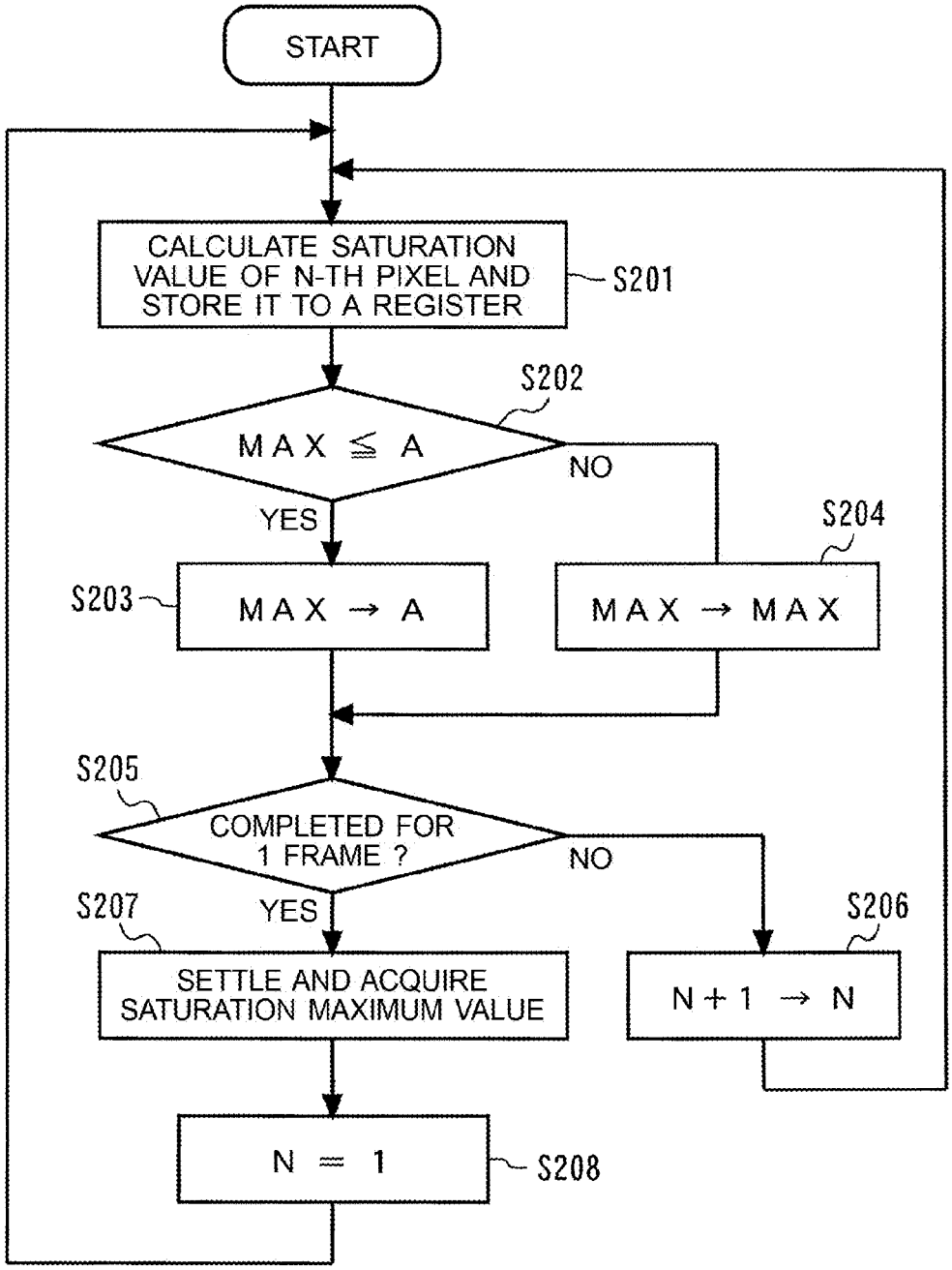
FIG. 10 is a flowchart showing an example of operations for calculating the saturation maximum value in one frame executed by a total-pixel saturation maximum value calculation section disclosed in FIG. 2.

First, the each-pixel saturation calculation circuit section 64 calculates the saturation value of the first pixel (N is an arbitrary natural number started from 1) by using Expression 4 described above and transmits the calculated value to the saturation feature value/luminance decrease amount calculation circuit section 65, and the saturation feature value/luminance decrease amount calculation circuit section 65 upon receiving it temporarily stores it to the A register 65*n* by the total-pixel saturation maximum value calculation section 65*a* (FIG. 10: step S201).

Next, the total-pixel saturation maximum value calculation section 65*a* compares the value (initial value is 0) of the MAX register and the value of the A register (FIG. 10: step S202). When the value of the A register is equal to or larger than the value of the MAX register (FIG. 10: step S202/Yes), the value of the MAX register is updated to the value of the A register (FIG. 10: step S203). When the value of the A register is less than the value of the MAX register (FIG. 10: step S202/No), the value of the MAX register is maintained (FIG. 10: step S204). In fact, the initial value of the MAX register is 0, so that the value of the MAX register is updated by the saturation value thereof in a case of the pixel of the head of the frame (N=1) (FIG. 10: step S203).

Then, the total-pixel saturation maximum value calculation section 65*a* checks (judges) whether or not judgment regarding the extent of the values for one frame (for the number of resolution) is completed (FIG. 10: step S205). When the judgment is completed for all the pixels in one frame (FIG. 10: step S205/Yes), the value stored in the MAX register at that time is settled as the saturation maximum value (FIG. 10: step S207). The saturation maximum value acquired herein is used for various kinds of computations.

In the meantime, when the judgment is not completed to the last pixel in one frame (FIG. 10: step S205/No), the total-pixel saturation maximum value calculation section 65*a* increases the value of N by 1 (value of N+1 is taken as N) and repeats a series of the contents of the above-described steps (steps S201 to S206) (repeats operations of judging the second pixel after completing judgment/checking of the first pixel).

Through repeating such judgment and checking for the pixels (for the number of resolution) constituting one frame, the saturation maximum value of each pixel in one frame can be calculated. The saturation maximum value is settled as described above at the point where the processing for one frame is completed, and it is used as MAX(chrome) for various kinds of computations (FIG. 10: step S207).

Then, N is reset to 1 (FIG. 10: step S208), and the saturation maximum value of the next frame (i.e., the second frame after the first frame) is calculated in the same manner (steps S201 to S207).

Through repeating such operations, the value of MAX (chrome) for each frame can be acquired.

(Calculation of Saturation Feature Value/Luminance Decrease Amount)

Subsequently, operations executed by each of the structural members (except for the total-pixel saturation maximum value calculation section 65*a* ) within the saturation feature value/luminance decrease amount calculation circuit section 65 will be described by referring to the flowchart shown in FIG. 11.

Figure 11:
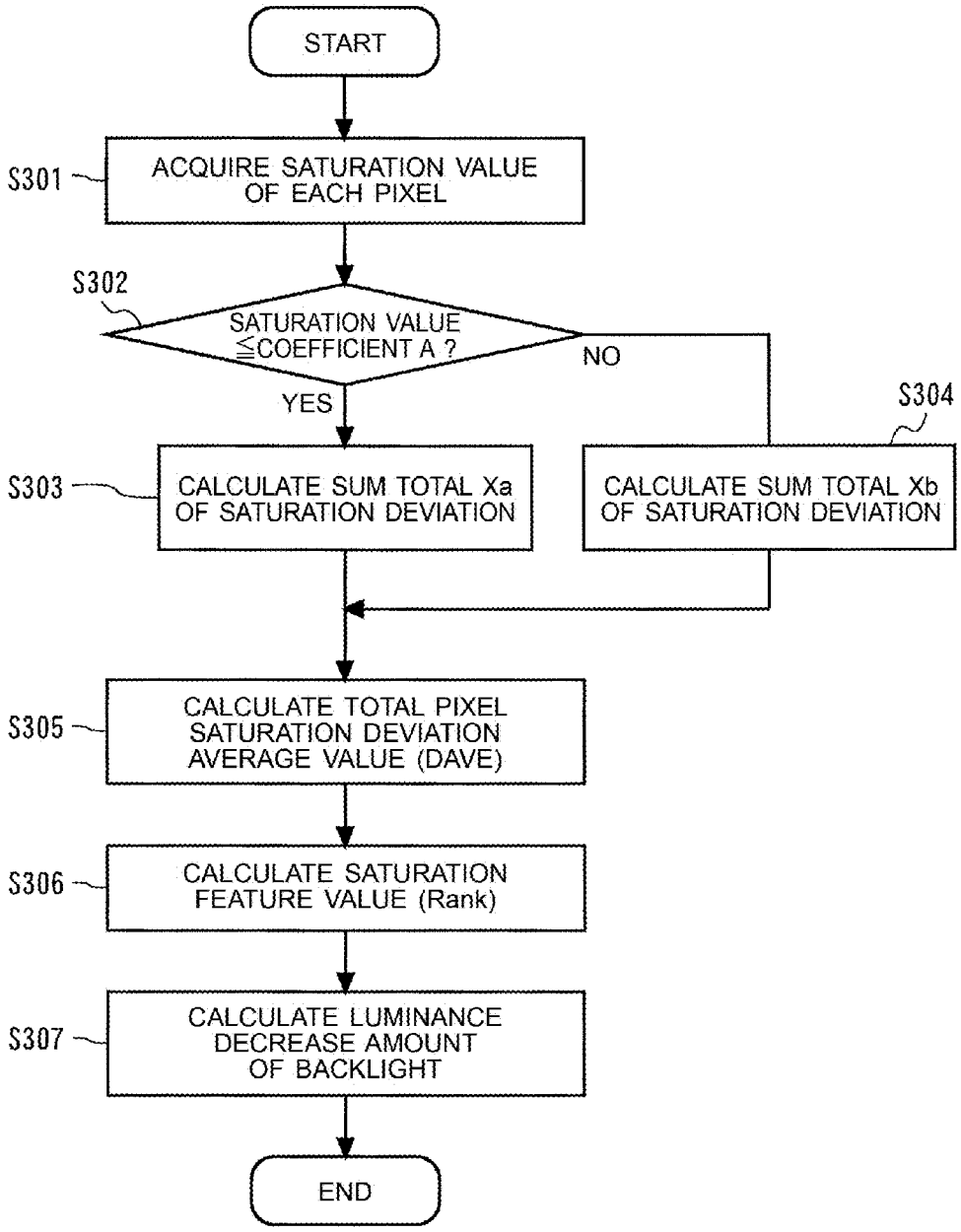
FIG. 11 is a flowchart showing operations executed by each structural member of the saturation feature value/luminance decreasing amount calculation circuit section disclosed in FIG. 2.

First, the each-pixel saturation judging section 65*b* upon acquiring the saturation value of each pixel from the each-pixel saturation value calculation circuit section 64 (FIG. 11: step S301) reads out the coefficient A from the information storage section 65*g*, judges whether or not the saturation value of each pixel is equal to or less than the coefficient A, and determines whether to use Expression 5 or Expression 6 (FIG. 11: step S302).

Here, when the each-pixel saturation judging section 65*b* judges that the saturation value is equal to or less than the coefficient A (FIG. 11: step S302/Yes), the each-pixel saturation deviation sum calculation section 65*c* calculates the sum total Xa of the saturation deviation from the saturation value and the coefficient A by using Expression 5 (FIG. 11: step S303). In the meantime, when the each-pixel saturation judging section 65*b* judges that the saturation value is larger than the coefficient A (FIG. 11: step S302/No), the each-pixel saturation deviation sum calculation section 65*c* calculates the sum total Xb of the saturation deviation from the saturation value and the coefficient A by using Expression 6 (FIG. 11: step S304).

Then, the total-pixel saturation deviation average calculation section 65*d* after reading out the number of resolution from the information storage section 65*g* calculates the total-pixel saturation deviation average value (DAVE) from the number of resolution and the total sums Xa, Xb of the saturation deviation by using Expression 7 (FIG. 11: step S305).

Then, the saturation feature value calculation section 65*e* upon reading out the coefficient B from the information storage section 65*g* calculates the saturation feature value (Rank) from Expression 8 by using the coefficient B, the total-pixel saturation deviation average value (DAVE), and the saturation maximum value (see FIG. 10), and transmits it to the luminance decrease amount calculation section 65*f* and the each-pixel luminance increase rate calculation circuit section 66 (FIG. 11: step S306).

The each-pixel luminance increase rate calculation circuit section 66 calculates the luminance increase rate of each pixel by using the saturation feature value (Rank), and the each-pixel luminance decreasing circuit section 67 executes luminance decreasing processing as appropriate based on the value of the luminance increase rate. Thereby, significant luminance decreasing processing can be performed for the pixels that become too bright.

Subsequently, the luminance decrease amount calculation section 65*f* upon reading out the coefficient C from the information storage section 65*g* calculates the luminance decrease amount of the backlight from Expression 9 by using the coefficient C and the saturation feature value (Rank), and transmits it to the B/L driving PWM signal generation circuit section 69 (FIG. 11: step S307).

That is, the B/L driving PWM signal generation circuit section 69 generates the PWM signal based on the luminance decrease amount.

As described, the luminance value of each pixel and the B/L luminance values are determined as appropriate according to the image based on the saturation feature value and the luminance decrease amount acquired by the saturation feature value/luminance decrease amount calculation circuit section 65. This makes it possible to control the luminance so as to suppress a sense of discomfort in the image quality generated due to the ratio between the white luminance and the primary color luminance as much as possible in a case of displaying an image where a primary color is simultaneously displayed in a part of a white screen, and to reduce the power consumption of B/L according to the decrease in the white luminance by effectively operating the luminance amplification control by W for other images to decrease the power consumption of B/L effectively.

A part of or a whole part of the execution contents of each of the steps S101 to S109 (FIG. 9), steps S201 to S208 (FIG. 10), and steps S301 to S307 (FIG. 11) may be put into programs, and a series of each of such control programs may be achieved by a computer.

(Effects and the like of First Exemplary Embodiment)

As described above, in the first exemplary embodiment, the control signal generation circuit 60 is structured to perform processing by considering the ratio between the white luminance and the primary-color luminance for the image where high saturation (primary color) is displayed simultaneously in a part of a white screen and to perform effective luminance amplification control by W for other images. This makes it possible to achieve the luminance control to suppress a sense of discomfort in the image quality as much as possible and to effectively reduce the power consumption of B/L according to the increase of the white luminance.

Further, the control signal generation circuit 60 calculates the saturation feature value by using the pixel information in one frame of the inputted video signals and executes the luminance control of the backlight based thereupon. Therefore, it is possible to suppress a sense of discomfort as much as possible even in a case of receiving the video signals in which the ratio of the white luminance with respect to the primary-color luminance becomes high at the edge of the screen.

Note here that there is a possibility that the backlight control amount is changed radically in the vicinity of the threshold value of statics even in a case where there is a gradual change in the saturation when employing the structure with which the backlight control amount is calculated by using the statistics (histogram or the like), for example. That is, in a case where similar video signals with slightly different saturation existing in a part thereof are inputted and the saturation feature values cross the threshold value, the control amount of the backlight may change radically. The luminance changes radically according to that change, so that a sense of discomfort in the image quality is felt by the observer.

Considering such issue, the first embodiment does not employ the structure that uses the statistics for the saturation feature value. Thus, in a case where there is a gradual change in the saturation, the control amount of the backlight can be changed continuously. This makes it possible to suppress a sense of discomfort in the image quality as much as possible.

Therefore, with the control signal generation circuit 60 that employs the structure with which the minimum value of inputted RGB is taken as the W value, the image feature value is calculated from the entire image, and the backlight value is controlled based thereupon, the hues of each pixel do not change greatly with respect to those of the original image. Thus, it is possible to reduce the power consumption effectively while suppressing a sense of discomfort in the image quality as much as possible.

(Second Exemplary Embodiment)

A second exemplary embodiment of the control signal generation circuit and the video display device according to the present invention will be described by referring to FIG. 12 and FIG. 13. Further, same reference numerals are used for the same structural members as those of the first exemplary embodiment described above, and FIG. 1 and the like are referred as appropriate.

In the second exemplary embodiment, shown is an example for increasing the power consumption decreasing effect of a backlight (B/L) further regarding the coefficient A and the coefficient B described in the first exemplary embodiment. Points different from those of the first exemplary embodiment will be focused and described herein.

The control signal generation circuit (video signal processing circuit) 60 of the second exemplary embodiment is structured to calculate the saturation feature value and the luminance decrease amount by using Expression 5 and Expression 9 described above under a condition where the set value of the coefficient A in the information storage section 65*g* takes the value within a range of "$0<A\leq 0.5$" and the value of the coefficient B is defined as "$B=1-A$".

That is, among the information stored in advance in the information storage section (coefficient setting section) 65*g* shown in FIG. 1, the value of the coefficient A is set within a range of "$0<A\leq 0.5$" and the value of the coefficient B is set to satisfy "$B=1-A$". Each of other structures is the same as the structural content described in the first exemplary embodiment by referring to the block diagrams of FIG. 1 to FIG. 3.

Figure 12:
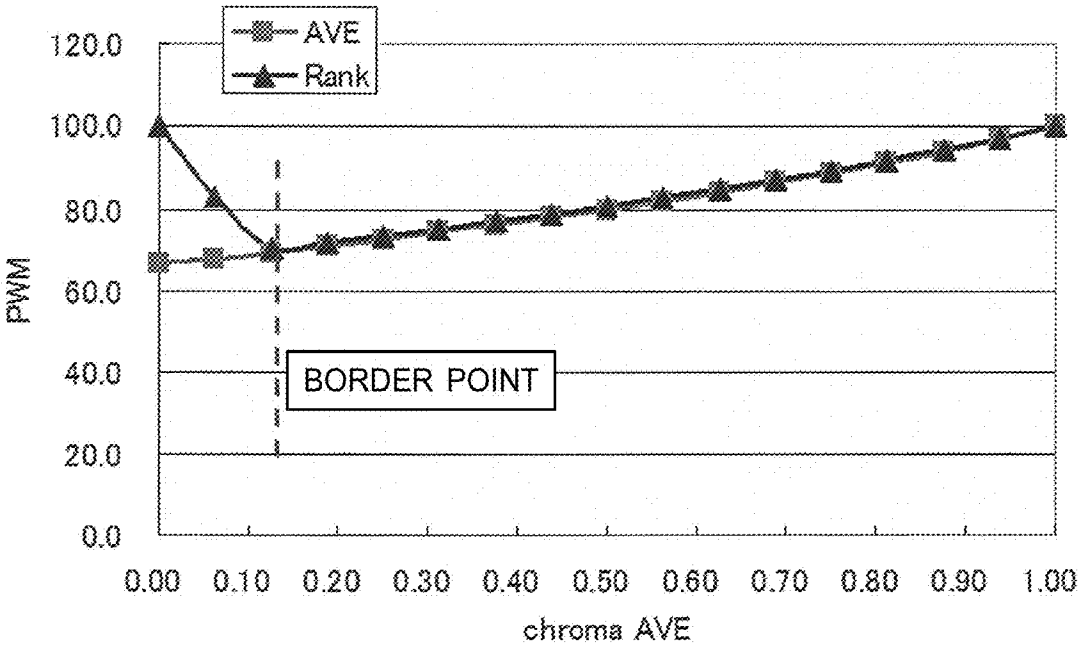
FIG. 12 is a graph showing an example of the relation between saturation feature values and PWM values regarding PWM-value control executed in a second exemplary embodiment of the present invention.

The graph shown in FIG. 12 shows the relation between the average value of the saturation and the PWM value in a case where the coefficients are set as A=0.125 and B=0.875. With such setting of the coefficients, the control shown in the line of Rank plotted with triangles can be achieved.

That is, as in FIG. 12, when the lateral axis is the average value of the saturation in one frame and the longitudinal axis shows the PWM value, the saturation feature value (Rank) changes along the AVE value in a case where the average value (chromaAVE) of the saturation is larger than the value of the coefficient A as the average value at the border point as in the graph plotted with triangles. When the average value of the saturation is smaller than the value of the coefficient A, it can be operated to increase the PWM value. Note here that the AVE value plotted with rectangles shows the case of using the average value of the saturation in one frame for the saturation feature value.

In the second exemplary embodiment, the values of each of the coefficients are set as A=0.125 and B=0.875. Thereby, the saturation feature value can be changed as in FIG. 12.

Further, as in the case of the first exemplary embodiment described above, the information storage section 65*g* can be set in a register inside an IC. Desirably, however, the information storage section 65*g* may be structured to be able to change the values by setting it to an external ROM (EEPROM or the like) or the like.

(Explanation using Specific Numerical Values)

Now, as in FIG. 13 (Chart 2), values of the coefficient A, the coefficient B, and the coefficient C functioning as described above are set and various assumed screens of each of the cases (Cases (I) to (III)) to which specific numerical values are substituted are considered. Each of the values and settings applied in Chart 2 are the same as those applied in FIG. 8 (Chart 1) shown in the first exemplary embodiment described above except for the coefficient A and the coefficient B.

First, Case (I) is an assumed occasion where a high-saturation image exists in a part of the screen even though the whole screen is not of high saturation (an occasion where at least one pixel of a primary color exists on the screen). In that case, when driving the saturation feature value with the maximum value standard, the power consumption of B/L cannot be reduced.

However, with the second exemplary embodiment that employs the structure related to Expression 5 to Expression 8, it is possible to acquire "PWM=0.877" by performing calculations as follows.

$$\begin{aligned} Xa &= \Sigma(1-8\times \text{chroma}(k)) \\ &= (1-8\times \text{chroma}(3))+(1-8\times \text{chroma}(5)) \\ &= (1-8\times 0.1)+(1-8\times 0)=0.2+1=1.2 \end{aligned}$$

$$\begin{aligned} Xb &= \Sigma(1/0.875\times \text{chroma}(k)-0.125) \\ &= (1/0.875\times \text{chroma}(1)-0.1428)+(1/0.875\times \text{chroma}(2)- \\ &\quad 0.1428)+(1/0.875\times \text{chroma}(4)-0.1428) \\ &= (1/0.875\times 0.6-0.1428)+(1/0.875\times 1-0.1428)+ \\ &\quad (1/0.875\times 0.7-0.1428) \\ &= 0.543+1.0+0.657=2.2 \end{aligned}$$

$$\text{DAVE}=(Xa+Xb)/\text{resolution number}=(1.2+2.2)/5=0.68$$

$$\begin{aligned} \text{Rank} &= \text{MAX}(\text{chroma})\times\{0.875\times \text{DAVE}+(0.125)\} \\ &= 1\times(0.875\times 0.68+0.125)=0.72 \end{aligned}$$

$$PWM=1/(1.5-(1.5-1)\times \text{Rank})=1/(1.5-0.5\times 0.72)=0.877$$

Thereby, the PWM value becomes 87.7%. Thus, it is found that about 12.3% of reduction in the power consumption of B/L can be achieved.

Next, Case (II) is an assumed occasion where a primary color is displayed on an all-white background. In that case, "PWM=1" is acquired by following calculations using Expression 5 to Expression 8 same as the above. Therefore, it is found that the PWM value becomes 100%.

$$\begin{aligned} Xa &= \Sigma(1-8\times \text{chroma}(k)) \\ &= 4 \end{aligned}$$

$$\begin{aligned} Xb &= \Sigma(1/0.875\times \text{chroma}(k)-0.125)) \\ &= 1 \end{aligned}$$

$$\text{DAVE}=(Xa+Xb)/\text{resolution number}=(4+1)/5=1$$

$$\begin{aligned} \text{Rank} &= \text{MAX}(\text{chroma})\times\{0.875\times \text{DAVE}+(0.125)\} \\ &= 1\times(0.875\times 1+0.125)=1 \end{aligned}$$

$$PWM=1/(1.5-(1.5-1)\times \text{Rank})=1/(1.5-0.5\times 1)=1$$

Next, Case (III) is an assumed occasion where the image is of low saturation to intermediate saturation. In that case, "PWM=0.682" is acquired by following calculations using Expression 5 to Expression 8 same as the above.

$$\begin{aligned} Xa &= \Sigma(1-8\times \text{chroma}(k)) \\ &= 0 \end{aligned}$$

$$\begin{aligned} Xb &= \Sigma(1/0.875\times \text{chroma}(k)-0.125) \\ &= 0.0286+0.08577+0.2+0.08577+0.143=0.543 \end{aligned}$$

$$\text{DAVE}=(Xa+Xb)/\text{resolution number}=(0+0.543)/5=0.1086$$

$$\begin{aligned} \text{Rank} &= \text{MAX}(\text{chroma})\times\{0.875\times \text{DAVE}+(0.125)\} \\ &= 0.3\times(0.875\times 0.1086+0.125)=0.3*0.22=0.066 \end{aligned}$$

$$PWM=1/(1.5-(1.5-1)\times \text{Rank})=1/(1.5-0.5\times 0.066)=0.682$$

Thereby, the PWM value becomes 68.2%. Thus, it is found that about 31.8% of reduction in the power consumption of B/L can be achieved.

When compared with the power consumption decrease amount of B/L of the case shown in FIG. 8 (Chart 1) according to the first exemplary embodiment, the ratios thereof are as follows.

Case (I) (First Exemplary Embodiment: Second Exemplary Embodiment)=(7.4%: 12.3%)

Case (II) (First Exemplary Embodiment: Second Exemplary Embodiment)=(0%: 0%)

Case (III) (First Exemplary Embodiment: Second Exemplary Embodiment)=(27.2%: 31.8%)

As shown in the above, it can be found that the power consumption of B/L is decreased more with the coefficient A and the coefficient B employed in the second exemplary embodiment. Regarding Case (II), the values are both 0%. As described above, it is for suppressing a sense of discomfort felt in the image quality.

For setting each of the coefficients, employed is a method of selecting the optimum coefficients while checking the image quality. As a result, it is found that a sense of discomfort in terms of the image quality is reduced by executing the control in a such a manner that the value of Rank goes along the value of AVE until reaching the border point as in the case of the first exemplary embodiment. Therefore, such control is employed.

Further, as a result of selecting the optimum coefficients while checking the image quality, it is found that the power consumption of B/L can be reduced effectively while suppressing a sense of discomfort in the image quality as much as possible when setting the value of the coefficient A to be within a range of "$0<A\leq 0.5$" and setting, under such condition, the value of the coefficient B to satisfy "$B=1-A$". That is, "$0<A\leq 0.5$" is considered to be the optimum range for the coefficient A.

Further, it is found that the power consumption of B/L can be suppressed while suppressing a sense of discomfort in the image quality more effectively when the values of the coefficient A and the coefficient B are set as 0.125 and 0.875, respectively. Thus, in the explanation of the second exemplary embodiment, those values are employed.

(Effects and the like of Second Exemplary Embodiment)

In the second exemplary embodiment, the value of the coefficient A stored in the information storage section 65*g* is set to be within the optimum range of "$0<A\leq 0.5$" and the coefficient A and the coefficient B are set to satisfy the relation of "$B=1-A$". Thereby, it is possible to achieve reduction of the power consumption by the luminance control of the backlight according to the videos signals more effectively and to minimize generation of a sense of discomfort felt in the image quality.

Other structures and operations are the same as those of the first exemplary embodiment, and other operational effects generated thereby are also the same.

(Third Exemplary Embodiment)

Figure 14:
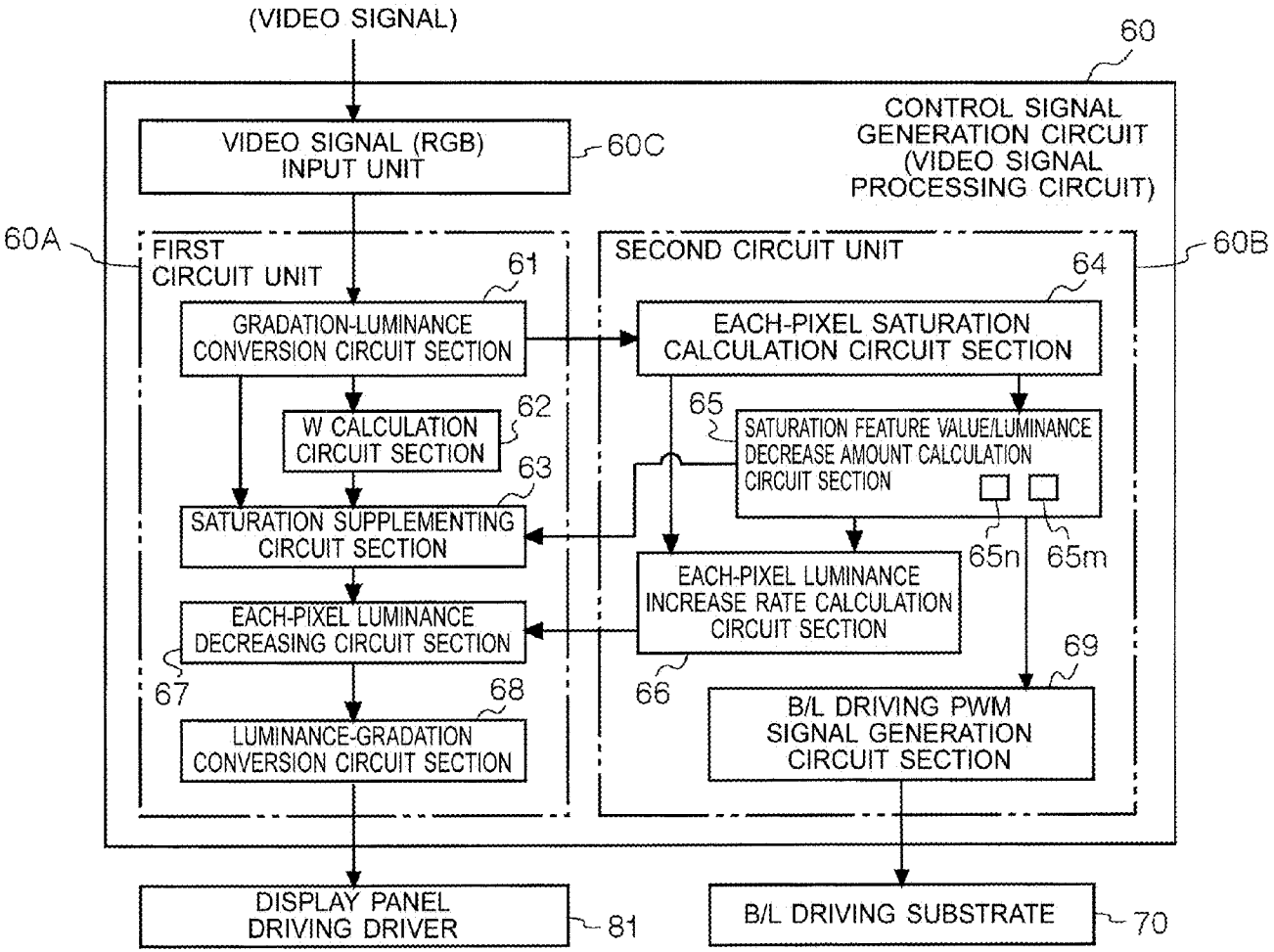
FIG. 14 is a block diagram showing a control signal generation circuit according to a third exemplary embodiment of the present invention.

A third exemplary embodiment of the control signal generation circuit (video signal processing circuit) and the video display device according to the present invention will be described by referring to FIG. 14 and FIG. 15. Same reference numerals are used for the same structural members as those of the first exemplary embodiment described above.

In the first and second exemplary embodiments above, the panel characteristic is so described that the ratio between the maximum white luminance of W and the maximum white luminance generated by RGB is 1:1. However, the present invention can flexibly deal with a case where the ratio is not 1:1.

Thus, in the third exemplary embodiment, described is an optimum control corresponding to an RGBW-type display panel exhibiting a panel characteristic in which the ratio between the maximum white luminance of W acquired from the panel characteristic (simply referred to as "the maximum white luminance of W" hereinafter) and the maximum white luminance generated by RGB becomes "p:q". In the third exemplary embodiment, points different from those of the first exemplary embodiment will be focused and described.

Figure 15:
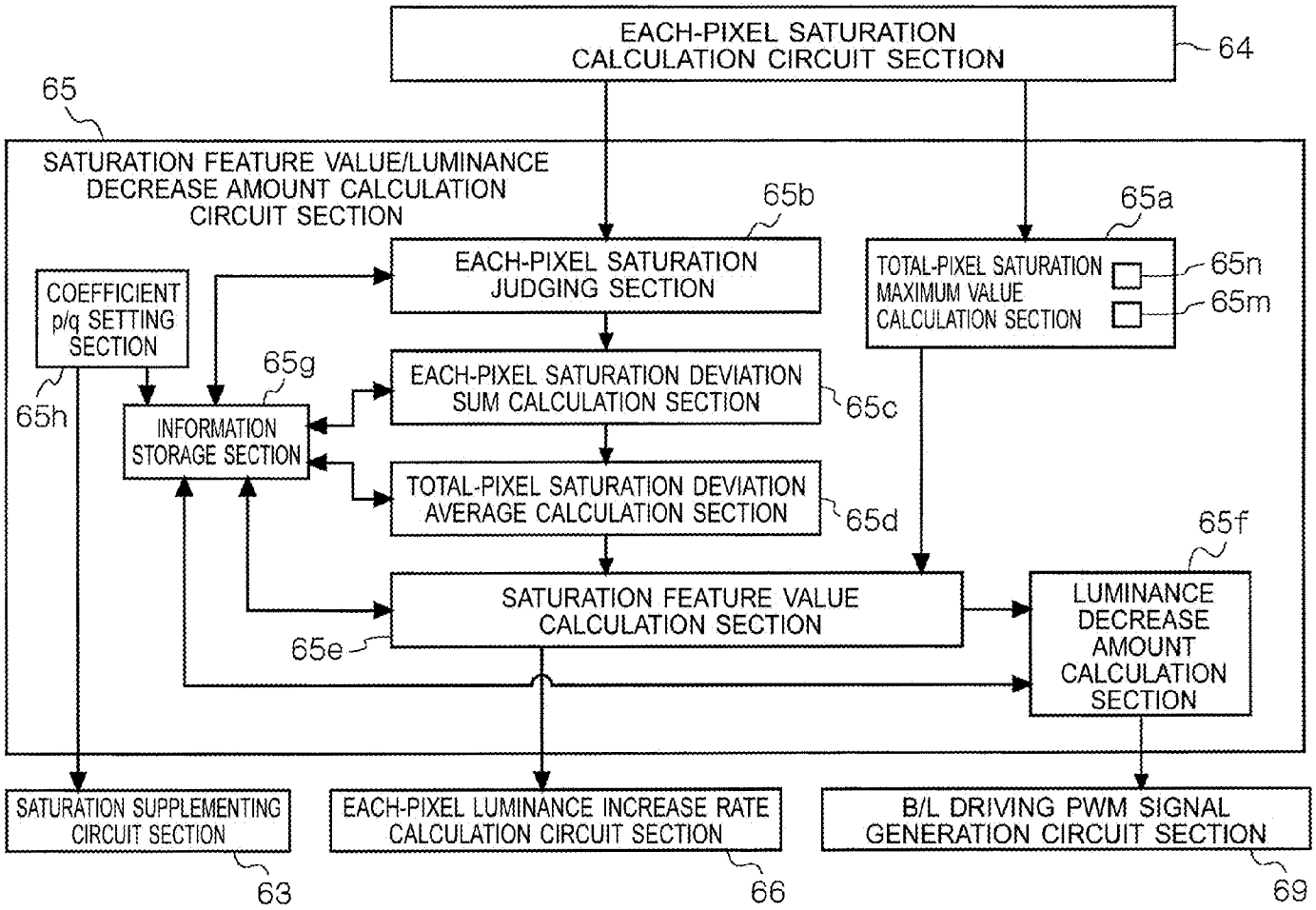
FIG. 15 is a block diagram showing a specific structure of the saturation feature value/luminance decreasing amount calculation circuit that is provided to the control signal generation circuit disclosed in FIG. 14.

A difference of the third exemplary embodiment with respect to the first exemplary embodiment first is that, as shown in FIG. 15, the value of the coefficient p/q that is the ratio between the maximum white luminance of W and the maximum white luminance generated by RGB (the ratio of the aperture area of the sub-pixels of the RGBW product with respect to the aperture area of the sub-pixels of the RGB product) is set in advance, and a coefficient p/q setting section 65*h* for transmitting it to the information storage section 65*g* and the saturation supplementing circuit section 63 is added inside the saturation feature value/luminance decrease amount calculation circuit section 65. In fact, the coefficient p/q setting section 65*h* may be structured with an external ROM as in the case of the information storage section 65*g* so as to be able to set the coefficient p/q.

Thus, as shown in FIG. 15, the saturation feature value/luminance decrease amount calculation circuit section 65 is different from that of the first exemplary embodiment in that it is structured to transmit the coefficient p/q to the saturation supplementing circuit section 63 by the coefficient p/q setting section 65*h*. Similarly, the saturation supplementing circuit section 63 and the luminance decrease amount calculation section 65*f* are different in respect that it executes processing using the coefficient p/q. However, same reference numerals are used herein for explanations.

In the third exemplary embodiment, the value of the coefficient p/q is transmitted to the information storage section 65*g* from the coefficient p/q setting section 65*h* (storing-processed), and that value is read out by the luminance decrease amount calculation section 65*f*. Further, the coefficient p/q is used by the luminance decrease amount calculation section 65*f* when acquiring the coefficient C (see Expression 9 described above) from following Expression 15.

(Expression 15)

$$C=(1+(p/q))\times Y \tag{15}$$

The coefficient C acquired from Expression 15 is the optimum value for displaying an image quality close to that of an original image. Further, Y is "(aperture area of sub-pixels of RGBW product)/(aperture area of sub-pixels of RGB product)".

In the third exemplary embodiment, the saturation supplementing circuit section ⊖supplements the saturation by using not Expression 3 described above but Expression 16 in the followings. That is, the coefficient p/q is used also for that.

(Expression 16)

$$Rc=\{1+(p/q)\times(\mathrm{MIN}/\mathrm{MAX})\}\times RL-(p/q)\times\mathrm{MIN}$$

$$Gc=\{1+(p/q)\times(\mathrm{MIN}/\mathrm{MAX})\}\times GL-(p/q)\times\mathrm{MIN}$$

$$Bc=\{1+(p/q)\times(\mathrm{MIN}/\mathrm{MAX})\}\times BL-(p/q)\times\mathrm{MIN} \tag{16}$$

More specifically, assuming that the area of each sub-pixel is ¾, the luminance increase rate of the RGBW product becomes 1.5 times that of the RGB product when the ratio between the maximum white luminance of W and the maximum white luminance generated by RGB is 1:1. This is evident because "$(1+1)\times(3/4)=1.5$" is acquired considering that the area of each sub-pixel becomes 3/4 times when the maximum white luminance of W is 1 and the maximum white luminance of RGB is 1.

Similarly, "(1+(p/q))×¾" is acquired when the ratio between the maximum white luminance of W and the maximum white luminance generated by RGB is p/q, so that the luminance increase rate of the RGBW product compared with that of the RGB product is "(1+(p/q))×¾" times.

As described, considered as a case where the ratio between the maximum white luminance of W and the maximum white luminance generated by RGB is not 1:1 may be a case where the maximum white luminance generated by RGB becomes larger than the maximum white luminance of W due to a difference in the transmittance of the color filters even when the areas of each of the sub-pixels of RGBW are set as the same, for example.

In this case, the maximum white luminance of W is relatively decreased more than the maximum white luminance generated by RGB. Thus, in order to maintain the saturation of the pixels, it is desirable to use Expression 3 employed in the first exemplary embodiment by amending it as in Expression 16.

With this processing, it is possible to adjust the saturation of one pixel constituted with Rc, Gc, Bc, and WL to be the same saturation of the one pixel constituted with the original RL, GL, and BL. However, in a case where the saturation is desired to be enhanced intentionally, for example, not Expression 16 but Expression 3 may simply be used.

Further, in a case where the ratio between the maximum white luminance of W and the maximum white luminance generated by RGB is "p:q", prior to using Expression 9 described above, the optimum value of the coefficient C is calculated/set by Expression 15 described above. By using that value, it becomes possible to align the white luminance of the RGBW product with the RGB product more precisely.

As described above, other than the fact that each processing of Expression 3 and Expression 9 is performed based on the rate "p:q" between the maximum white luminance of W and the maximum white luminance generated by RGB, i.e., based on the value of the coefficient p/q that is the ratio thereof, the third exemplary embodiment is the same as the first exemplary embodiment.

(Effects of Third Exemplary Embodiment)

The third exemplary embodiment employs the structure with which the saturation feature value, the luminance decrease amount of the backlight, and the like are controlled by the processing using the coefficient p/q. This makes it possible to provide the image displayed on the RGBW-type display panel to be in the image quality which is still closer to that of the original image. That is, with the control signal generation circuit according to the third exemplary embodiment and the video display device provided with the circuit (by controlling the saturation feature value in the manner described above), the power consumption of B/L can be decreased effectively while suppressing a sense of discomfort in the image quality as much as possible.

Other structures and operations are the same as those of the first and second exemplary embodiments, and other operational effects generated thereby are also the same.

(Fourth Exemplary Embodiment)

A fourth exemplary embodiment of the control signal generation circuit (video signal processing circuit) and the video display device according to the present invention will be described by referring to FIG. 16 and FIG. 17. Same reference numerals are used for the same structural members as those of the first exemplary embodiment described above.

In the third exemplary embodiment above, it is described that the present invention can flexibly deal with the case where the rate between the maximum white luminance of W and the maximum white luminance generated by RGB is not 1:1. However, when the value of p/q is larger than 1 in the RGBW-type display panel exhibiting a panel characteristic in which the rate between the maximum white luminance of W and the maximum white luminance generated by RGB is "p:q", the values of Rc, Gc, and Bc may become negative values when the saturation is supplemented based on the formula given by Numerical Expression 16.

It is difficult to display the negative luminance values on the display panel. In such case, a limiter control circuit or the like is used to control the value to be 0 when a negative value is calculated so that the normal luminance value does not take a value smaller than 0. However, this is a cause for inducing a sense of discomfort in the image quality such as luminance crush (a case where there is originally a luminance difference but the luminance becomes the same due to the result of calculation) and deterioration in the saturation.

The fourth exemplary embodiment is designed to perform the control so as not to have a sense of discomfort in the image quality such as the luminance crush and the deterioration in the saturation even when the value of p/q is larger than 1.

Figure 16:
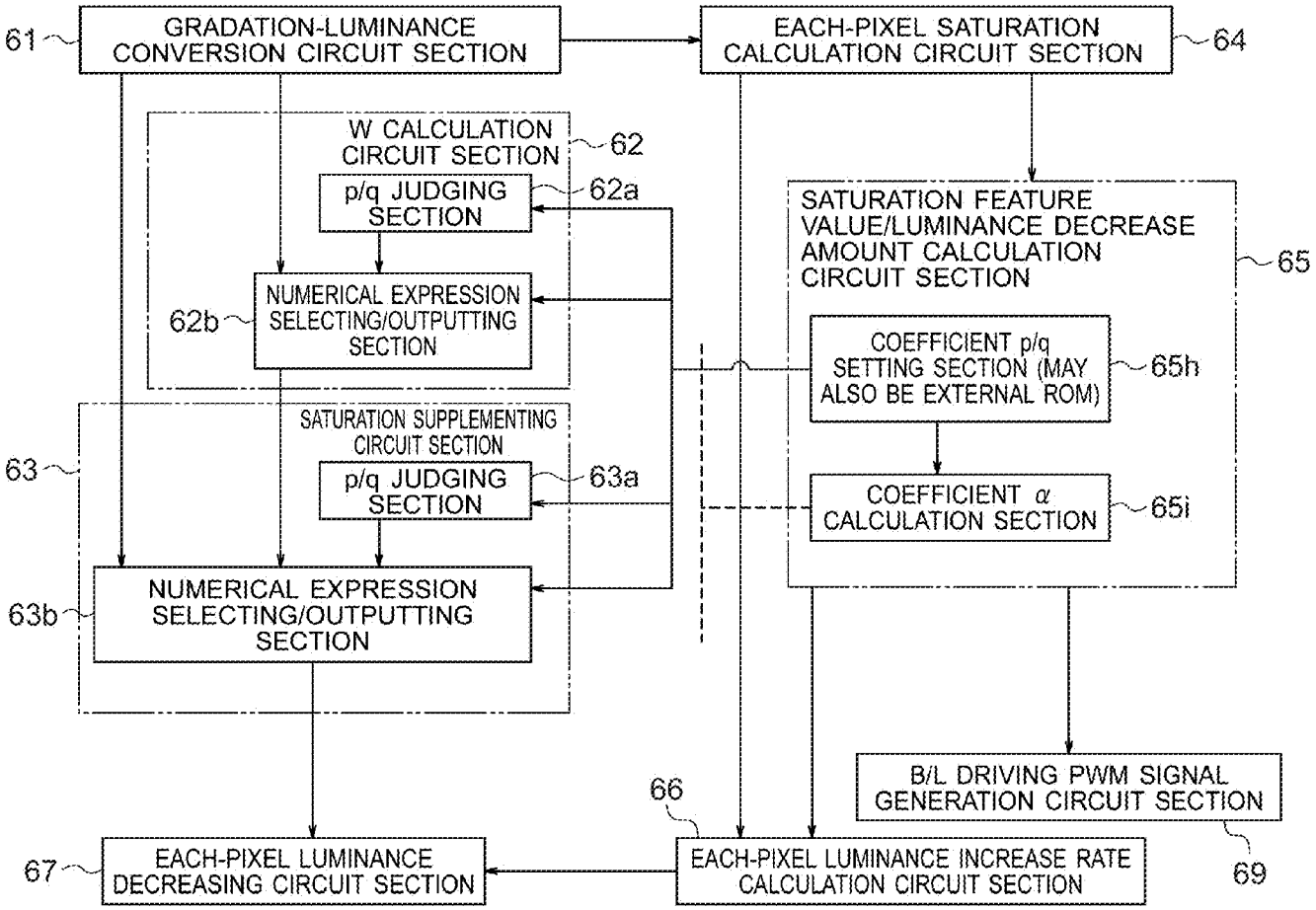
FIG. 16 shows examples peripheral circuits of a coefficient $\alpha$ calculation section according to a fourth exemplary embodiment of the present invention.

In the fourth exemplary embodiment, points different from those of the third exemplary embodiment will be focused and described As shown in FIG. 16, the different points of the fourth exemplary embodiment with respect to the third exemplary embodiment are that: a coefficient α calculation section 65*i* for calculating a coefficient α based on the coefficient p/q set in the coefficient p/q setting section 65*h* is added within the saturation feature value/luminance decrease amount calculation circuit section 65; a p/q judging section 62*a* for judging the value of the coefficient p/q and a numerical expression selecting/outputting section 62*b* for selecting and outputting a calculation result calculated by a numerical expression according to the value of p/q are added inside the W calculation circuit section 62; and a p/q judging section 63*a* for judging the value of the coefficient p/q and a numerical expression selecting/outputting section 63*b* for selecting and outputting a calculation result calculated by a numerical expression according to the value of p/q are added inside the saturation supplementing circuit section 63.

Figure 17:
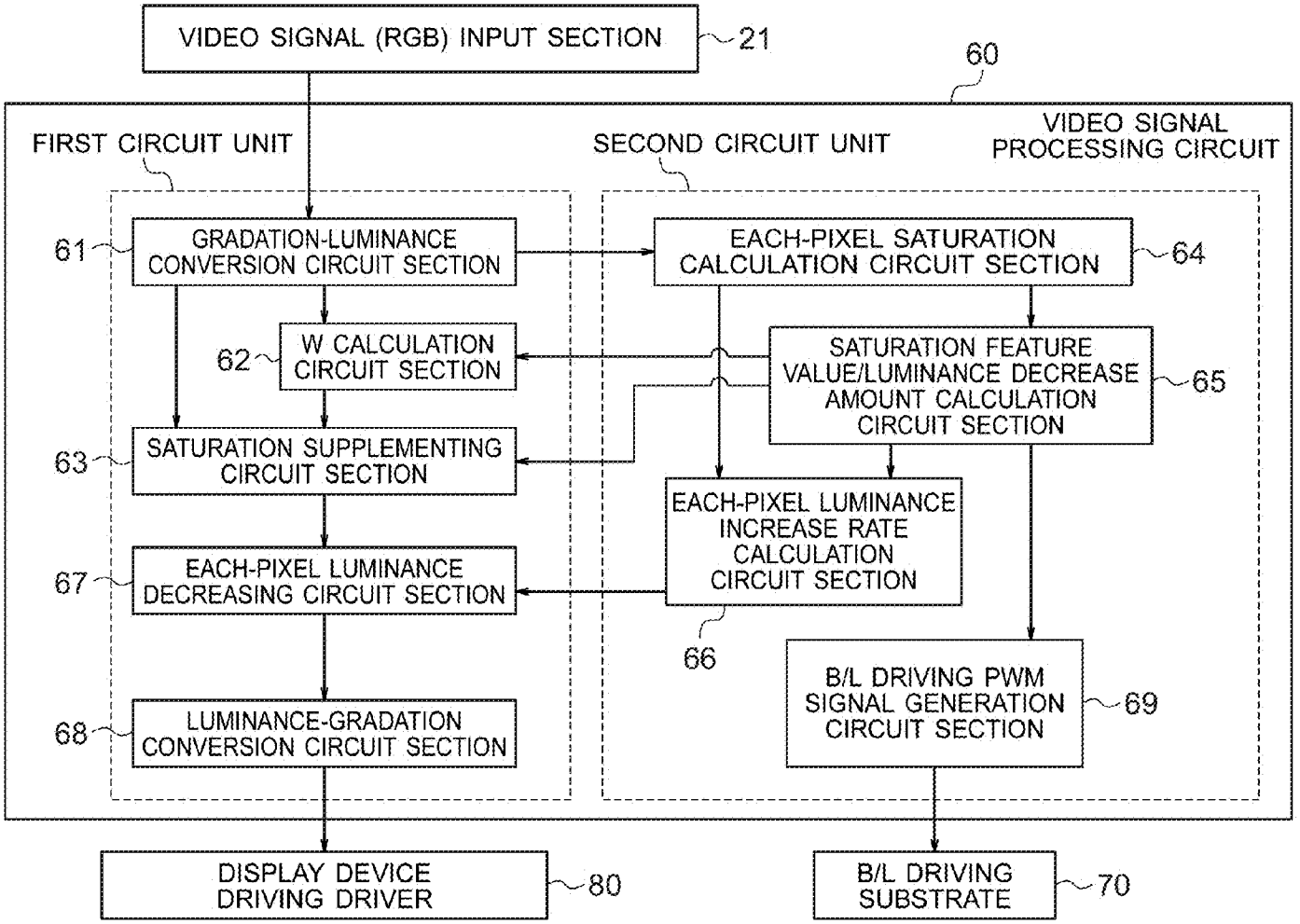
FIG. 17 is a block diagram showing examples of peripheral circuits of a saturation feature value/luminance decreasing amount calculation circuit according to the fourth exemplary embodiment of the present invention.

Thus, as also shown in FIG. 17, the fourth exemplary embodiment is different from the third exemplary embodiment in that the saturation feature value/luminance decrease amount calculation circuit section 65 is structured to transmit the value of the coefficient p/q set by the coefficient p/q setting section 65*h* and the value of α calculated by the coefficient α calculation section 65*i* based on the value of p/q to the W calculation circuit section 62 and the saturation supplementing circuit section 63. However, same reference numerals are used herein for explanations.

In the fourth exemplary embodiment, first, the value of the coefficient p/q is read out from the coefficient p/q setting section 65*h*, and the value of the coefficient α is calculated by the coefficient α calculation section 65*i* based on following Expression 17.

(Expression 17)

$$\alpha=1+((p/q)-1)\times((1-\text{chroma}(c)) \quad (17)$$

Note that chroma(c) is the saturation value of each pixel calculated by Expression 4. The coefficient α calculated based on Expression 17 is the values required for supplementing the saturation value to the same value as that of the original image when the value of p/q is larger than 1.

In the fourth exemplary embodiment, the W calculation circuit section 62 calculates the value of WL by using Expression 2 described above in a case where the value of p/q is equal to or less than 1 and calculates the value of WL by using not Expression 2 but following Expression 18 in a case where the value of p/q is larger than 1. That is, whether the value of p/q is equal to or less than 1 or larger than 1 is judged by the p/q judging section 62*a*, whether to use Expression 2 or Expression 18 according to the value of p/q is selected by the numerical expression selecting/outputting section 62*b*, and WL calculated based on the selected expression is outputted from the W calculation circuit section 62 at last.

Condition 1: p/q≤1

(Numerical Expression 2)

$$WL=\min(RL, GL, BL) \tag{2}$$

Condition 2: p/q>1

(Numerical Expression 18)

$$WL=(\alpha/(p/q))\times\min(RL, GL, BL) \tag{18}$$

Note that α is the value calculated based on Expression 17.

Further, the saturation supplementing circuit section 63 supplements the saturation by using Expression 16 described above in a case where the value of p/q is equal to or less than 1 and supplements the saturation by using not Expression 16 but following Expression 19 in a case where the value of p/q is larger than 1. That is, whether the value of p/q is equal to or less than 1 or larger than 1 is judged by the p/q judging section 63*a*, whether to use Expression 16 or Expression 19 is selected by the numerical expression selecting/outputting section 63*b* according to the value of p/q, and Rc, Gc, and Bc calculated based on the selected expression are outputted from the saturation supplementing circuit section 63 at last.

Condition 1: p/q≤1

(Numerical Expression 16)

$$Rc=\{1+(p/q)\times(\mathrm{MIN}/\mathrm{MAX})\}\times RL-(p/q)\times\mathrm{MIN}$$

$$Gc=\{1+(p/q)\times(\mathrm{MIN}/\mathrm{MAX})\}\times GL-(p/q)\times\mathrm{MIN}$$

$$Bc=\{1+(p/q)\times(\mathrm{MIN}/\mathrm{MAX})\}\times BL-(p/q)\times\mathrm{MIN} \tag{16}$$

Condition 2: p/q>1

(Numerical Expression 19)

$$Rc=\{1+\alpha\times(\mathrm{MIN}/\mathrm{MAX})\}\times RL-\alpha\times\mathrm{MIN}$$

$$Gc=\{1+\alpha\times(\mathrm{MIN}/\mathrm{MAX})\}\times GL-\alpha\times\mathrm{MIN}$$

$$Bc=\{1+\alpha\times(\mathrm{MIN}/\mathrm{MAX})\}\times BL-\alpha\times\mathrm{MIN} \tag{19}$$

Note that α is a value calculated by Expression 17.

Considered as a case where the ratio between the maximum white luminance of W and the maximum white luminance generated by RGB is not 1:1 may be a case where the maximum white luminance generated by RGB becomes smaller than the maximum white luminance of W due to a difference in the transmittance of the color filters even when the areas of each of the sub-pixels of RGBW are set as the same, for example (such as a case of using a color filter having a wide chromaticity region).

In this case, the maximum white luminance of W is relatively increased more than the maximum white luminance generated by RGB. Thus, in order to maintain the saturation of the pixels, it is desirable to use Expression 2 employed in the first exemplary embodiment by amending it as Expression 18 and also Expression 3 by amending it as Expression 19.

With this processing, it is possible to adjust the saturation of one pixel constituted with Rc, Gc, Bc, and WL to be the same saturation of the one pixel constituted with the original RL, GL, and BL without causing luminance crush (also referred to as gradation crush since the luminance signal is converted into the gradation signals at last) and deterioration in the saturation even in a case where the value of p/q becomes larger than 1.

As described above, other than the fact that the coefficient α is calculated by using Expression 17 based on the value of the coefficient p/q and each processing is performed by using Expression 18 and Expression 19 according to the value of the coefficient p/q, the fourth exemplary embodiment is the same as the third exemplary embodiment.

(Effects of Fourth Exemplary Embodiment)

The fourth exemplary embodiment employs the structure with which the saturation feature value, the luminance decrease amount of the backlight, and the like are controlled by calculating the coefficient α from the coefficient p/q and by executing the processing using the coefficient α according to the value of the coefficient p/q. This makes it possible to provide the image displayed on the RGBW-type display panel exhibiting such a characteristic that the value of p/q is larger than 1 to be in the image quality which is still closer to that of the original image. That is, with the control signal generation circuit according to the fourth exemplary embodiment and the video display device provided with the circuit (by controlling the saturation feature value in the manner described above), the power consumption of B/L can be decreased effectively while suppressing a sense of discomfort in the image quality as much as possible.

Other structures and operations are the same as those of the first, second, and third exemplary embodiments, and other operational effects generated thereby are also the same.

(Fifth Exemplary Embodiment)

In the fourth exemplary embodiment described above, it is described to be able to deal with the case where the value of p/q is larger than 1 in an RGBW-type display panel exhibiting a panel characteristic in which the rate between the maximum white luminance of W and the maximum white luminance generated RGB is "p:q". However, when the value of p/q is larger than 2, the values of Rc, Gc, and Bc may become negative values even when the saturation is supplemented based on the formula given by Numerical Expressions 17, 18, and 19. This is also a cause for inducing a sense of discomfort in the image quality such as luminance crush (a case where there is originally a luminance difference but the luminance becomes the same due to the result of calculation) and deterioration in the saturation.

A fifth exemplary embodiment is designed to perform control so that there is no sense of discomfort generated in the image quality such as the luminance crush and deterioration in the saturation even when the value of p/q is larger than 2.

The difference of the fifth exemplary embodiment with respect to the fourth exemplary embodiment described above is a calculation formula of the coefficient α. In the fifth exemplary embodiment, the value of the coefficient α is calculated based on following Expression 20.

(Expression 20)

$$\alpha=1+((p/q)-1)\times((1-\mathrm{chroma}(c))\hat{}(p/q)) \tag{20}$$

Other structures and a control method thereof are the same as those of the fourth exemplary embodiment.

By using the coefficient α calculated based on Expression 20, it is possible to perform control so as not to have a sense of discomfort in the image quality such as the luminance crush and deterioration in the saturation even when the value of p/q is larger than 2. However, in the RGBW-type display panel exhibiting a characteristic in which the value of p/q is between 1 and 2, both inclusive, the circuit scale can become smaller by using the coefficient α that is calculated by Expression 17 of the fourth exemplary embodiment. Thus, it is desirable to perform the control according to the fourth exemplary embodiment.

(Effects of Fifth Exemplary Embodiment)

In the fifth exemplary embodiment, the image displayed on the RGBW-type display panel exhibiting such a characteristic that the value of p/q is larger than 2 can be displayed with the image quality which is still closer to that of the original image. That is, with the control signal generation circuit according to the fifth exemplary embodiment and the video display device provided with the circuit (by controlling the saturation feature value in the manner described above), the power consumption of B/L can be decreased effectively while suppressing a sense of discomfort in the image quality as much as possible.

Other structures and operations are the same as those of the first, second, third, and fourth exemplary embodiments, and other operational effects generated thereby are also the same.

(Sixth Exemplary Embodiment)

The fourth exemplary embodiment shows the method for making it possible with the RGBW-type display panel exhibiting such a panel characteristic that the rate between the maximum white luminance of W and the maximum white luminance generated by RGB is "p:q" to deal with the case where the value of p/q is larger than 1. Similarly, a method different from the fourth exemplary embodiment for making it possible to deal with the case where the value of p/q is larger than 1 will be described as a sixth exemplary embodiment.

The sixth exemplary embodiment is designed to perform the control so as not to decrease the saturation as much as possible even when the value of p/q is larger than 1 by using a method different from that of the fourth exemplary embodiment. Thus, it will be compared with the case of the third exemplary embodiment.

Figure 18:
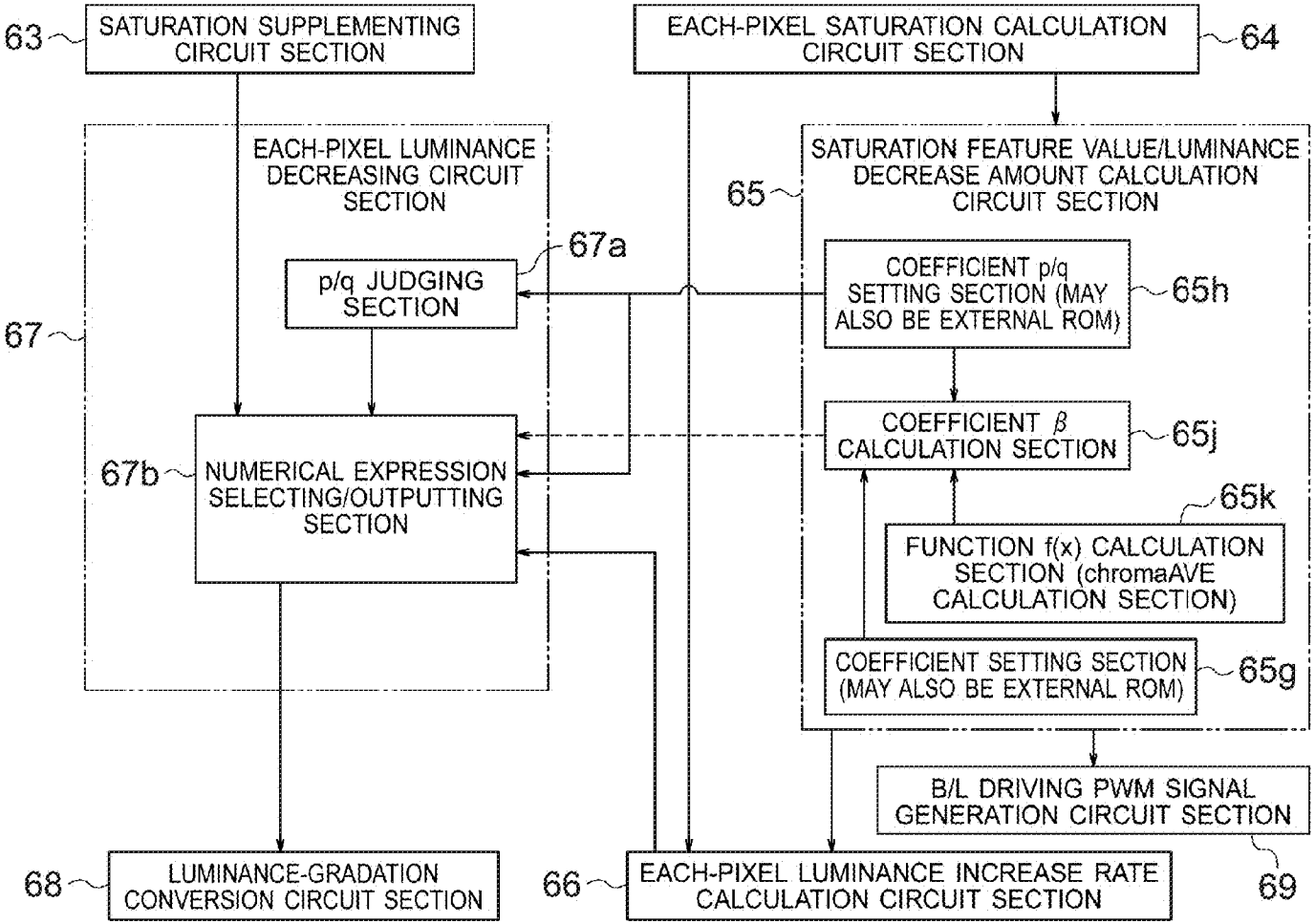
FIG. 18 is examples of peripheral circuits of a coefficient $\alpha$ calculation section according to a sixth exemplary embodiment of the present invention.

As shown in FIG. 18, the different points with respect to the third exemplary embodiments are that: a coefficient β calculation section 65*j* for calculating a coefficient β based on the value of the coefficient p/q set by the coefficient p/q setting section 65*h* and a value of a function f(x) and a function f(x) calculation section 65*k* for calculating the function f(x) are added inside the saturation feature value/luminance decrease amount calculation circuit section 65; and a p/q judging section 67*a* for judging the value of the coefficient p/q and a numerical expression selecting/outputting section 67*b* for selecting and outputting a calculation result calculated by a numerical expression according to the value of p/q are added inside the each-pixel luminance decreasing circuit section 67.

Figure 19:
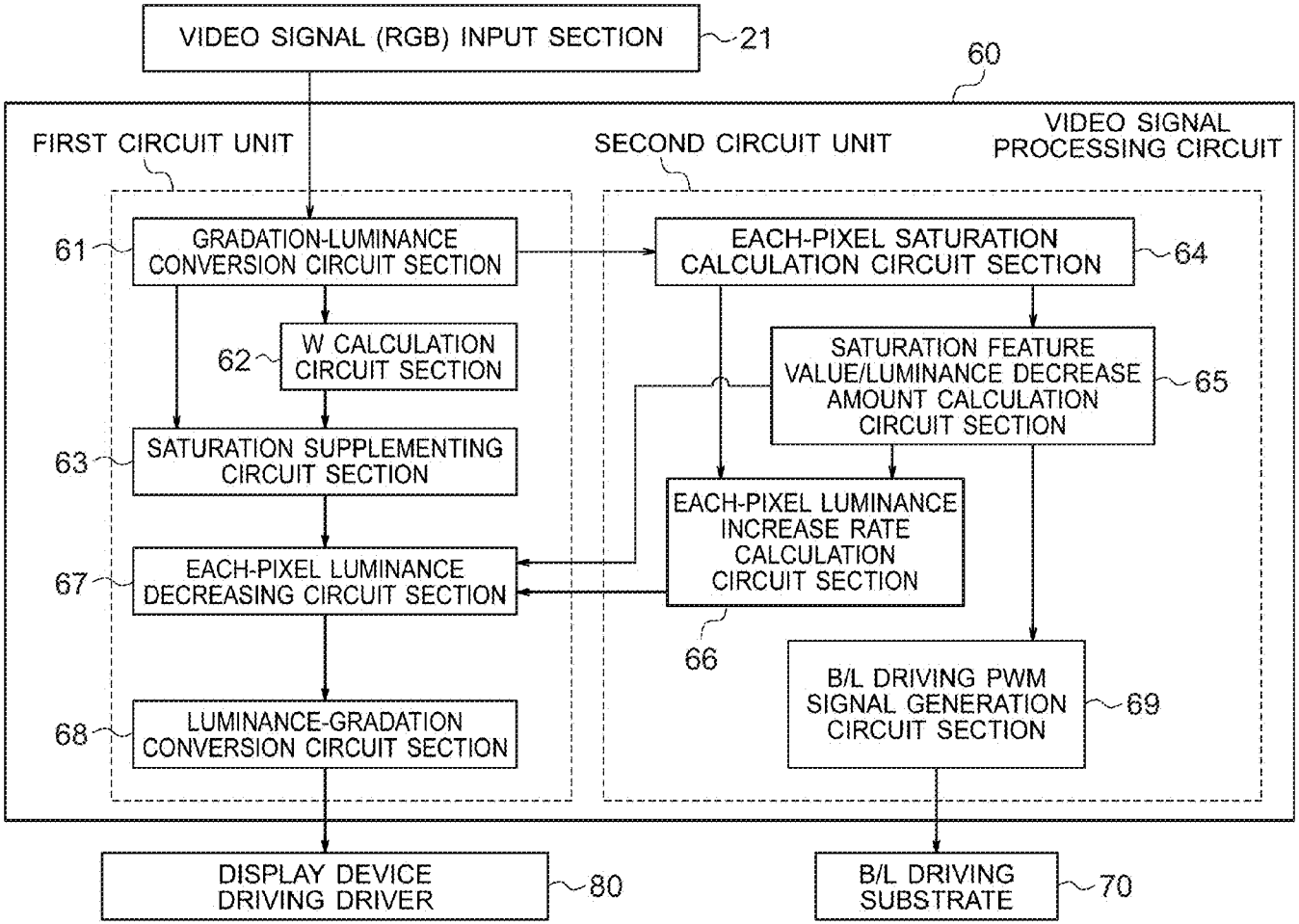
FIG. 19 is a block diagram showing examples of peripheral circuits of a saturation feature value/luminance decreasing amount calculation circuit according to the sixth exemplary embodiment of the present invention.

Thus, as also shown in FIG. 19, the sixth exemplary embodiment is different from the fourth exemplary embodiment in that the saturation feature value/luminance decrease amount calculation circuit section 65 is structured to transmit the value of the coefficient p/q set by the coefficient p/q setting section 65*h* and the value of β calculated by the coefficient β calculation section 65*j* based on the value of p/q and the value of the function f(x) to the each-pixel luminance decreasing circuit section 67. However, same reference numerals are used herein for explanations.

In the sixth exemplary embodiment, first, the value of the coefficient p/q is read out from the coefficient p/q setting section 65*h*, the value of the function f(x) is read out from the function f(x) calculation section 65*k*, and the value of the coefficient β is calculated by the coefficient 13 calculation section 65*j* based on following Expression 21.

(Expression 21)

$$\beta=1+((p/q)-1)\times f(x) \tag{21}$$

The function f(x) is defined as a function of the saturation value calculated from each pixel in one frame, and it is desirable to be set as a function which becomes close to 0 when the saturation is low while it becomes close to 1 when the saturation is high. More detailed content will be described later.

In the sixth exemplary embodiment, the values of each of Rc, Gc, Bc, and WL are calculated by using Expression 13 described above when the value of p/q is equal to or smaller than 1. When the value of p/q is larger than 1, the each-pixel luminance decreasing circuit section 67 calculates the values of each of Rc, Gc, Bc, and WL by using not Expression 13 but following Expression 22.

In the sixth exemplary embodiment, when the value of p/q is equal to or smaller than 1, the each-pixel luminance decreasing circuit section 67 decreases the luminance of each pixel by using Expression 13. When the value of p/q is larger than 1, the each-pixel luminance decreasing circuit section 67 decreases the luminance of each pixel by using not Expression 13 but following Expression 22. That is, whether the value of p/q is equal to or less than 1 or larger than 1 is judged by the p/q judging section 67*a*, whether to use Expression 13 or Expression 22 is selected by the numerical expression selecting/outputting section 67b according to the value of p/q, and the values of Rc, Gc, Bc, and WL calculated based on the selected expression are outputted from the each-pixel luminance decreasing circuit section 67 at last.

Condition 3: p/q≤1

(Numerical Expression 13)

$$Rx=Rc/LEH\text{ratio}$$

$$Gx=Gc/LEH\text{ratio}$$

$$Bx=Bc/LEH\text{ratio}$$

$$Wx=WL/LEH\text{ratio} \tag{13}$$

Condition 4: p/q>1

(Numerical Expression 22)

$$Rx=Rc/LEH\text{ratio}$$

$$Gx=Gc/LEH\text{ratio}$$

$$Bx=Bc/LEH\text{ratio}$$

$$Wx=(WL/LEH\text{ratio})\times(1/\beta) \tag{22}$$

Note that β is a value calculated by Expression 21.

Here, the function f(x) of Expression 21 will be described in details. First, "the value of p/q is larger than 1" means that the maximum white luminance of W is increased relatively with respect to the maximum white luminance generated by RGB in the panel characteristic. In that case, in an all-white image or a grayscale image, the original image is achromatic. Thus, the saturation is not deteriorated even when W is lighted up, so that the luminance can be increased for the lighted-up amount of W. However, W is lighted up also in an image of intermediate saturation. Thus, the light-up amount of W is increased relatively, so that the saturation is deteriorated compared to that of the original image (naturally, W is not lighted up in a high-saturation image of a primary color and the like, so that explanation thereof is omitted herein).

That is, the luminance of W lighted up relatively excessively due to the panel characteristic may be controlled to decrease according to the image. It is desirable to perform control to: set the value of β close to 1 and have no luminance decrease due to the panel characteristic in an achromatic image; and set the value of β close to p/q and decrease the relative luminance increase of W due to the panel characteristic in an image of intermediate saturation ("decrease in the relative luminance increase of W due to the panel characteristic" indicates not LEHratio in Expression 13 and Expression 22 but 1/β in Expression 22).

To perform such operation described above, it is desired to set β close to 1 in a case of low saturation image regarding the function f(x) of Expression 21. Thus, f(x) is set to become close to 0. In a case of high saturation image, it is desired to set 13 close to the value of p/q, so that f(x) may be controlled to become close to 1. More specifically, the value of f(x) may be set as a function of the average value of the saturation in one frame as in following Expression 23.

(Expression 23)

$$f(x)=(\text{chromaAVE})\hat{}E \tag{23}$$

Note that "chromaAVE" is the average value of the saturation value of each pixel in one frame (acquired by adding up the saturation value of each pixel calculated by Expression 4 for the number of resolution of one frame and dividing it by the number of resolution), and "E" is an actual number satisfying 0<E<2 and an arbitrary coefficient. The value of chromaAVE is calculated within the function f(x) calculation section 65*k*, and the coefficient E may be set in advance in the coefficient setting section 65*g* (may be set in an external ROM as in the case of the first exemplary embodiment). According to the value of the coefficient E, the decrease value of the relative luminance increase of W in the vicinity of the intermediate saturation can be increased or decreased. In this embodiment, it is desirable to set the value of E to be about 0.5 in order to suppress the deterioration in the saturation as much as possible.

Here, the coefficient E will be described in details. For example, in a low-saturation all-white (achromatic) screen, chromaAVE=0. In a high-saturation primary-color solid screen (R, G, or B only, for example), chromaAVE=1. In such solid screen, f(x)=0 and β=1 in a case of low saturation image while f(x)=1 and β=p/q in a case of high saturation image. Thus, expected numerical values can be acquired. However, there are not only the solid images but normally are images where low saturation pixels, high saturation pixels, and relatively high saturation (intermediate level) pixels exist simultaneously. In such case, chromaAVE is calculated as the average value of the total values of the low saturation pixels and the low or intermediate saturation pixels. Thus, the coefficient E is set to be able to give priority on either of the pixels when the high saturation pixels and the low saturation pixels exist simultaneously by applying weight of exponential function to the value of chromaAVE.

In a case where E=0, f(x) is always 1. Thus, such case is excluded. When the value of E is in a range of 0<E<1, a sense of discomfort in the image quality can be decreased by giving priority on the pixels of relatively high (intermediate level) saturation. However, when the value of E is set to be too small such as 0.1 in an image of many low saturation pixels, the value of f(x) is excessively amplified by applying more than necessary weight by the value of the coefficient E even though the value of chromaAVE is small. Thus, the effect of luminance increase by the W pixels cannot be acquired fully, thereby causing deterioration in the luminance and the like. Further, when the value of E is in a range of 1<E<2, priority can be given on the luminance increase by the W pixels even though there is a little sense of discomfort generated in the image quality. The numerical expression applies even in a case of E=2 or larger. However, a sense of discomfort in the image quality becomes large, so that it is defined to be within a range of 0<E<2.

In the sixth exemplary embodiment, it is preferable to set the value of E to be small (but not too small) since it is desired to suppress a sense of discomfort in the image quality generated by deterioration in the saturation as much as possible. More desirably, by setting the value as about E=0.5, the effect of luminance increase of W pixels can be acquired and also a sense of discomfort in the image quality generated by deterioration in the saturation can be suppressed as much as possible. Therefore, it is the optimum value.

By performing such processing, it is possible to perform adjustment to keep the saturation of one pixel constituted with Rc, Gc, Bc, and WL as much as possible with respect to the original saturation of one pixel constituted with RL, GL, and BL while suppressing deterioration in the saturation as much as possible even in a case where the value of p/q is larger than 1.

As described above, other than the fact that the coefficient β is calculated by using Expression 21 based on the function f(x) calculated by using the value of the coefficient p/q and Expression 23 and that each processing is performed by using Expression 22 according to the value of the coefficient p/q, the sixth exemplary embodiment is the same as the third exemplary embodiment.

(Effects of Sixth Exemplary Embodiment)

The sixth exemplary embodiment employs the structure with which the saturation feature value, the luminance decrease amount of the backlight, and the like are controlled by calculating the coefficient α from the coefficient p/q and by executing the processing using the coefficient α according to the value of the coefficient p/q. This makes it possible to provide the image displayed on the RGBW-type display panel exhibiting such a characteristic that the value of p/q is larger than 1 to be in the image quality which is still closer to that of the original image. That is, with the control signal generation circuit according to the sixth exemplary embodiment and the video display device provided with the circuit (by controlling the saturation feature value in the manner described above), the power consumption of B/L can be decreased effectively while suppressing a sense of discomfort in the image quality as much as possible. Other structures and operations are the same as those of the first, second, and third exemplary embodiments, and other operational effects generated thereby are also the same.

(Seventh Exemplary Embodiment)

A seventh exemplary embodiment of the control signal generation circuit and the video display device according to the present invention will be described by referring to FIG. 20 to FIG. 23. Further, same reference numerals are used for the same structural members as those of the first to sixth exemplary embodiments described above, and FIG. 1 and the like are referred as appropriate.

In the seventh exemplary embodiment, shown is an example for increasing the power consumption decreasing effect of a backlight further in an image containing many low gradation noises regarding the saturation calculation method described in the first exemplary embodiment. A feature of the seventh exemplary embodiment is the each-pixel saturation calculation circuit section 64, so that points different from those of the first exemplary embodiment will be focused and described.

Figure 20:
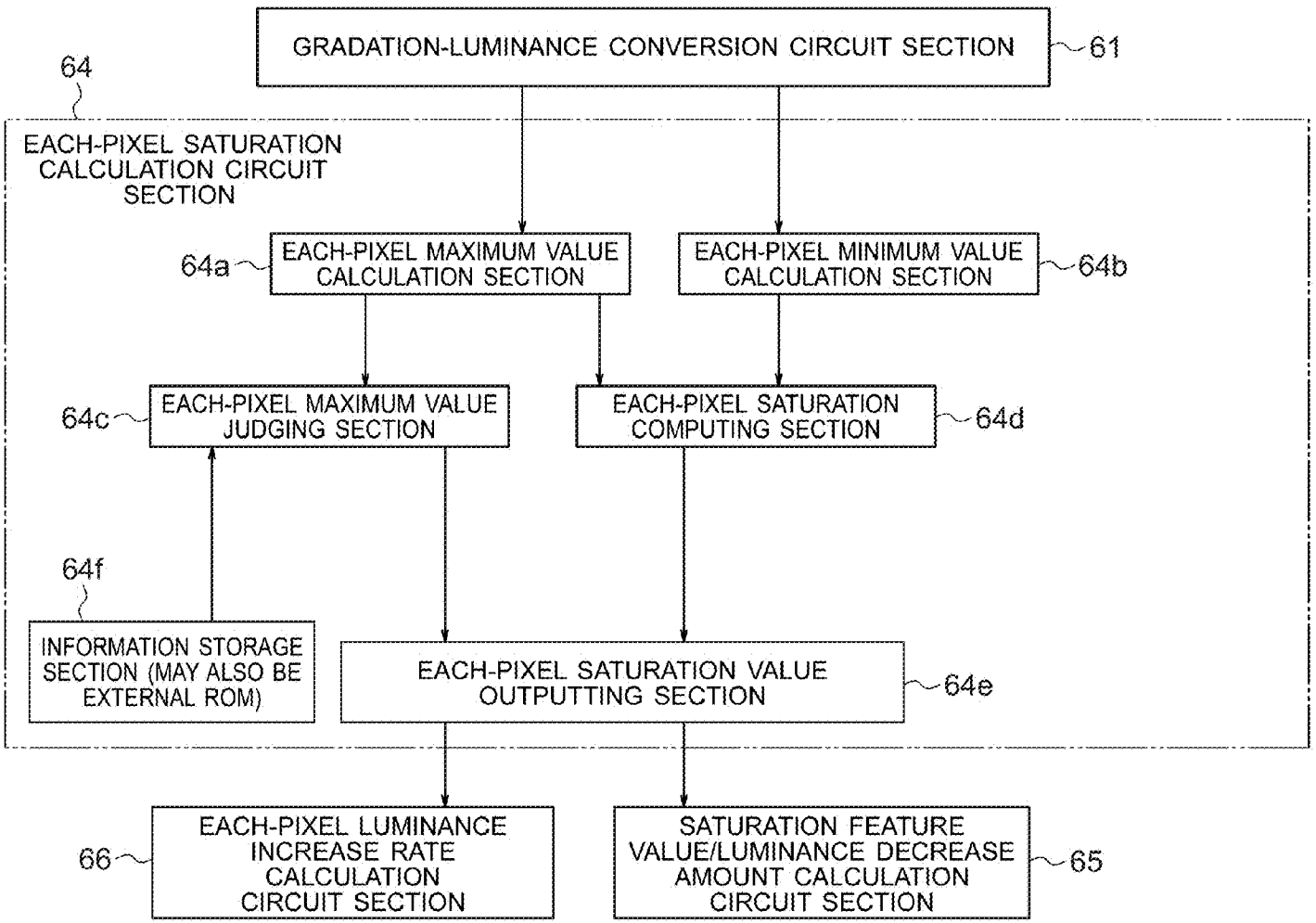
FIG. 20 is an example of each-pixel saturation calculation circuit unit according to a seventh exemplary embodiment of the present invention.

As shown in FIG. 20, the each-pixel luminance calculation circuit section 64 of the seventh exemplary embodiment includes: an each-pixel maximum value calculation section 64*a* which calculates the maximum value of the RGB luminance signals based on the RGB luminance signals (hereinafter, luminance signal means relative luminance signal) after being converted by the gradation-luminance converting circuit section 61; an each-pixel minimum value calculation section 64*b* which calculates the minimum value of the RGB luminance signals; an each-pixel maximum value judging section 64*c* which judges whether the maximum value is larger or smaller than a coefficient set in the information storage section (coefficient setting section) 64*f*; an each-pixel saturation computing section 64*d* which computes the saturation of each pixel from the maximum value and the minimum value; and an each-pixel saturation value outputting section 64*e* which outputs a final saturation value based on the computed value and the judgment result acquired by the each-pixel maximum value judging section. According to the saturation value of each pixel, calculation processing of the luminance increase rate of each pixel, the saturation feature value, and the luminance decrease amount is achieved. An external ROM may be used for the information storage section 64*f*. Alternatively, the information storage section 65*g* of the first exemplary embodiment may be used in common Next, the structural content regarding saturation value calculation processing of each pixel will be described in details.

First, the maximum value and the minimum value of the relative luminance signals of each pixel are calculated from the RGB luminance signals outputted from the gradation-luminance converting circuit section 61 described above. That is, the largest luminance signal among RGB (hereinafter, the luminance signal is the signal acquired by converting the inputted gradation signal based on Expression 1, which is the relative luminance signal corresponding to the inputted gradation signal) is the maximum value (MAX), and the smallest luminance signal is the minimum value (MIN).

Regarding a specific maximum value calculation method, the each-pixel maximum value calculation section 64*a* calculates the maximum value by following Expression 24.

(Maximum Value Calculation Method)

$$\mathrm{MAX}=\max(RL, GL, BL)$$

where in a case where $RL>GL$ and $RL>BL$ $\mathrm{MAX}=RL$ in a case where $RL>GL$ and $RL\leq BL$ $\mathrm{MAX}=BL$ in a case where $RL\leq GL$ and $GL>BL$ $\mathrm{MAX}=GL$ in a case where $RL\leq GL$ and $GL\leq BL$ $\mathrm{MAX}=BL$ (24)

Similarly, regarding a specific minimum value calculation method, the each-pixel minimum value calculation section 64*b* calculates the minimum value by following Expression 25.

(Minimum Value Calculation Method)

$$\mathrm{MIN}=\min(RL, GL, BL)$$

where in a case where $RL<GL$ and $RL<BL$ $\mathrm{MIN}=RL$ in a case where $RL<GL$ and $RL\geq BL$ $\mathrm{MIN}=BL$ in a case where $RL\geq GL$ and $GL<BL$ $\mathrm{MIN}=GL$ in a case where $RL\geq GL$ and $GL\geq BL$ $\mathrm{MIN}=BL$ (25)

Next, the each-pixel saturation computing section 64*d* calculates the saturation from MAX and MIN described above (same as the computation of Expression 4), the each-pixel maximum value judging section 64*c* compares the maximum value of each pixel and the value of the coefficient F saved in the information storage section (coefficient setting section) 64*f* to judge which of the values is larger, and the each-value saturation value outputting section 64*e* outputs the final saturation value of each pixel according to the judgment result. Specifically, when MAX is equal to or less than the coefficient F (maximum threshold value), the saturation is defined as G. When MAX is larger than the coefficient F, the saturation value is calculated by a numerical expression given by Expression 4. Note here that G is a coefficient within a range of G0.5, and it is saved in advance in the information storage section 64*f*. This can be expressed as a numerical expression by following Expression 26 using MAX, MIN, and the coefficient F, and calculation processing is executed according to that.

(Case of MAX>F)

$$\mathrm{chroma}=(\mathrm{MAX}-\mathrm{MIN})/\mathrm{MAX}$$

(Case of MAX≤F)

$$\mathrm{chroma}=G \tag{26}$$

The coefficient F in Expression 26 is the maximum threshold value, and it is an actual number larger than 0. This is the threshold value for outputting the saturation value by taking the saturation of the pixels as the value of the coefficient G in a case where the maximum value (MAX) out of the three luminance signals (relative luminance signals) of R, G, and B of each pixel is equal to or less than the value of the coefficient F. Further, the coefficient G takes a value within a range of $0\leq G\leq 0.5$. Desirably, by setting as G=0, the saturation value that is calculated as "1" according to Expression 4 can be calculated as "0" in the pixel of almost black noise such as (R, G, B)=(0, 0, 1). Thus, the saturation can be calculated as the smaller saturation value than the original saturation value. Thereby, a smaller saturation feature value can be acquired, so that the decreasing effect of the power consumption of the backlight can be increased further. The coefficient G may be determined by evaluating the image qualities of various kinds of images. However, it is preferable to set the coefficient to a value as small as possible such as 0 or 0.1, since the decreasing effect of the power consumption of the backlight can be increased further. When it is set to be larger than 0.5, the decreasing effect of the power consumption of the backlight cannot be acquired fully. Therefore, it is defined to be within a range of $0\leq G\leq 0.5$.

With the processing described above, the decreasing effect of the power consumption of the backlight can be increased further than that of the saturation value calculation method shown by Expression 4 depicted in the first exemplary embodiment.

The detailed operations will be described by referring to specific images, luminance signals, and saturation feature values as examples.

Various kinds of assumed screens are considered for each case to which specific numerical values are applied as in FIG. 21 (Chart 3). Here, the number of pixels in one frame is set as "10" for simplifying the explanations. In a case of VGA, the number takes the value of "640×480=307200".

Further, the method used for calculating the saturation in Chart 3 is the calculation using Expression 4 of the first exemplary embodiment.

Figure 22A:
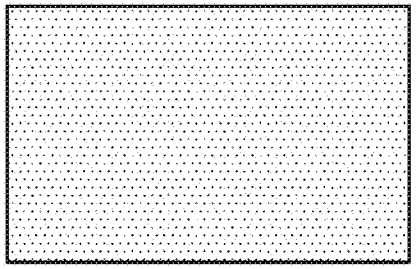

As shown in FIG. 22A, Case IV is assumed to be an all-red (solid) screen. When the luminance of the backlight is decreased in a case where a primary-color based screen is displayed, the luminance is decreased even though W is not lighted up. Thus, a sense of discomfort is generated in the image quality such as darkening of the screen. Therefore, it is desirable not to decrease the backlight luminance in such case.

In order not to decrease the backlight luminance, the saturation feature value may be set as "1". This can be seen by substituting "1" to the saturation feature value (Rank) of Expression 9 described above, PWM=1/((C−(C−1)×1)=1, i.e., the value of PWM is 100%. The saturation of each pixel is 1 so that the saturation feature value is also 1 as expected.

Figure 22B:
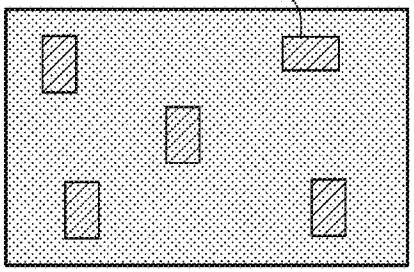

Next, as shown in FIG. 22B, Case V is an example of an image containing many low-gradation noises. As shown in FIG. 22B, this is an almost all-black screen but assumed to have a small gradation difference. The gradation difference is not intentionally given. In many cases, such difference is generated as an image noise. However, in such almost all-black screen, a sense of discomfort in the image quality is not felt even when the backlight luminance is decreased sufficiently (in case where coefficient C=1.5, the PWM value is 66.6% when the saturation feature value is 0) since it is the image noise.

Thus, in a case of Case V, it is desirable to decrease the power consumption of the backlight by decreasing the luminance of the backlight. However, the saturation values of the low-gradation noise part (corresponds to the first to fifth pixels) are all calculated as 1 by Expression 4. Thus, the saturation feature value does not take the value 0, so that the backlight luminance cannot be decreased sufficiently. In Case V, the saturation value of each pixel is 0. As a result, it is desirable for the saturation feature value to become 0.

The case of (Rin, Gin, Bin)=(0, 0, 0) shows perfect black (achromatic color), so that a denominator becomes 0 according to Expression 4 and the value becomes undefined. However, it is possible to deal with such case by setting exceptional processing such as setting the saturation as 0 when MAX is 0, for example.

Assumed as Case V in Chart 3 is an image where both a low-gradation noise part and perfect black exist. However, all the pixels may be the low-gradation noise pixels. In such case, the saturation value is 1 for all the pixels, so that the saturation feature value is also 1. This means that the backlight luminance cannot be decreased further.

Figure 22C:
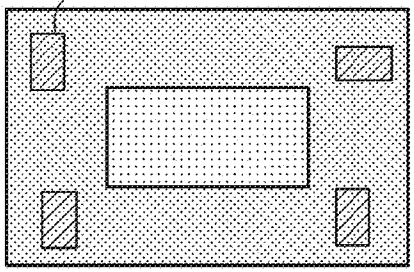

Next, as shown in FIG. 22C, assumed as Case VI is an almost all-black screen where a partially halftone (achromatic color) is displayed in a background with a small gradation difference. W is lighted up on the halftone (achromatic color) where (Rin, Gin, Bin)=(128, 128, 128), so that the backlight luminance can be decreased for the luminance thereof. However, the saturation values of the low-gradation noise part (corresponds to the first to fourth pixels) are all calculated as 1 by Expression 4, so that the backlight luminance cannot be decreased sufficiently in this case as well. The saturation value of each pixel is also 0 in Case VI, so that it is desirable for the saturation feature value to become 0.

Note here that the use of a saturation value calculation method according to Expression 26 of the seventh exemplary embodiment makes it possible to decrease the backlight luminance more effectively.

FIG. 23 (Chart 4) shows the result acquired by calculating the saturation value of each pixel by using Expression 26. The value of the coefficient F is set as D=5 herein as an example. As can be seen from Chart 4, the saturation value of each pixel in Case V is calculated as 0 and the saturation value of each pixel in Case VI is also calculated as 0. Therefore, the backlight luminance can be decreased more effectively than the case of the saturation value calculation method according to the first exemplary embodiment and the decreasing effect of the power consumption of the backlight can be increased further.

In practice, the value of the coefficient F may be determined to bring out the effect on a dark screen with a noise such as Case V. As a result of evaluation done while observing an actual dark image with a noise, it is optimal to judge the pixel whose maximum value of the gradation is 8 gradations or less as the saturation 0 in a case where the value of the gradation signals (Rin, Gin, Bin) to be inputted is 8-bit input (maximum value of the gradation signal is 255). The reason for setting the input gradation signal as 8 gradations or less is that the value of the inputted luminance signals (RL, GL, BL) changes due to the method of gradation-luminance conversion.

For example, when the maximum luminance value is set as 255 according to the gradation-luminance conversion method of Expression 1, 8 gradations can be expressed as 255×(8/255)^2.2=0.1256. The coefficient F is set as 0.1256, and the saturation may be judged as 0 when the maximum gradation is equal to or less than the luminance signal. In the above-described example, the maximum luminance value 255 is multiplied. However, when the resolution is increased and the maximum luminance value is set as 4080, a result of 2.01 is acquired.

In that case, the value of the coefficient F may be set as 2.01. Further, when not Expression 1 but another gradation-luminance conversion method (e.g., a case of applying a change to increase the tilt in a low-gradation area) is employed, the luminance value acquired when the inputted gradation signal is defined as of 8 gradations acquired by such expression and converted into the luminance signal may be used as the value of the coefficient F.

The processing described above is not for adding the processing which may increase the luminance of the pixels in a noise part of an image and not for performing a change and a control which may generate a sense of discomfort in the image quality such as increasing the visibility of the noise by increasing the backlight luminance for the existence of the noise. It is the processing which operates to decrease the backlight luminance in a case where there is a noise in a dark screen and to perform control so that the decreasing effect of the backlight luminance becomes still larger while suppressing a sense of discomfort in the image quality as much as possible.

(Effect of Seventh Exemplary Embodiment)

With the seventh exemplary embodiment, the saturation value calculation method of each pixel is optimally controlled for the image containing many low-gradation noises. Thereby, it is possible to decrease the power consumption of the backlight more effectively while suppressing a sense of discomfort in the image quality as much as possible.

Other structures and operations are the same as those of the first to sixth exemplary embodiments, and other operational effects generated thereby are also the same.

(Eighth Exemplary Embodiment)

An eighth exemplary embodiment of the control signal generation circuit (video signal processing circuit) and the video display device according to the present invention will be described by referring to FIG. 24 and FIG. 25. Same reference numerals are used for the same structural members as those of the seventh exemplary embodiment described above.

In the eighth exemplary embodiment, shown is an example for performing control to give the continuity in the luminance change of the backlight regarding the saturation calculation method used in the image containing many low gradation noises described in the seventh exemplary embodiment. In the eighth exemplary embodiment, points different from those of the seventh exemplary embodiment will be focused and described.

Figure 24:
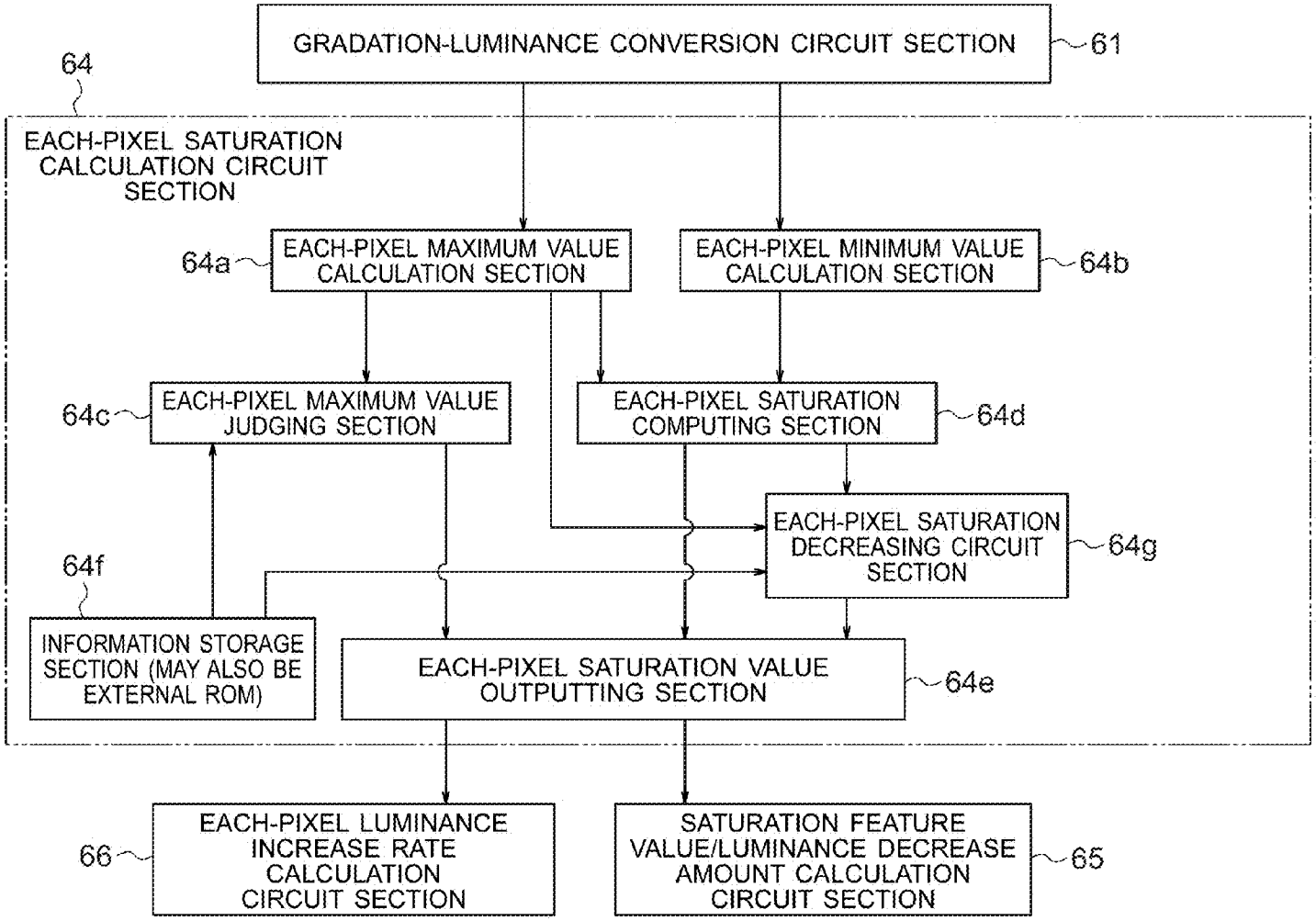
FIG. 24 is an example of an each-pixel saturation calculation circuit section according to an eighth exemplary embodiment of the present invention.
Figure 25:
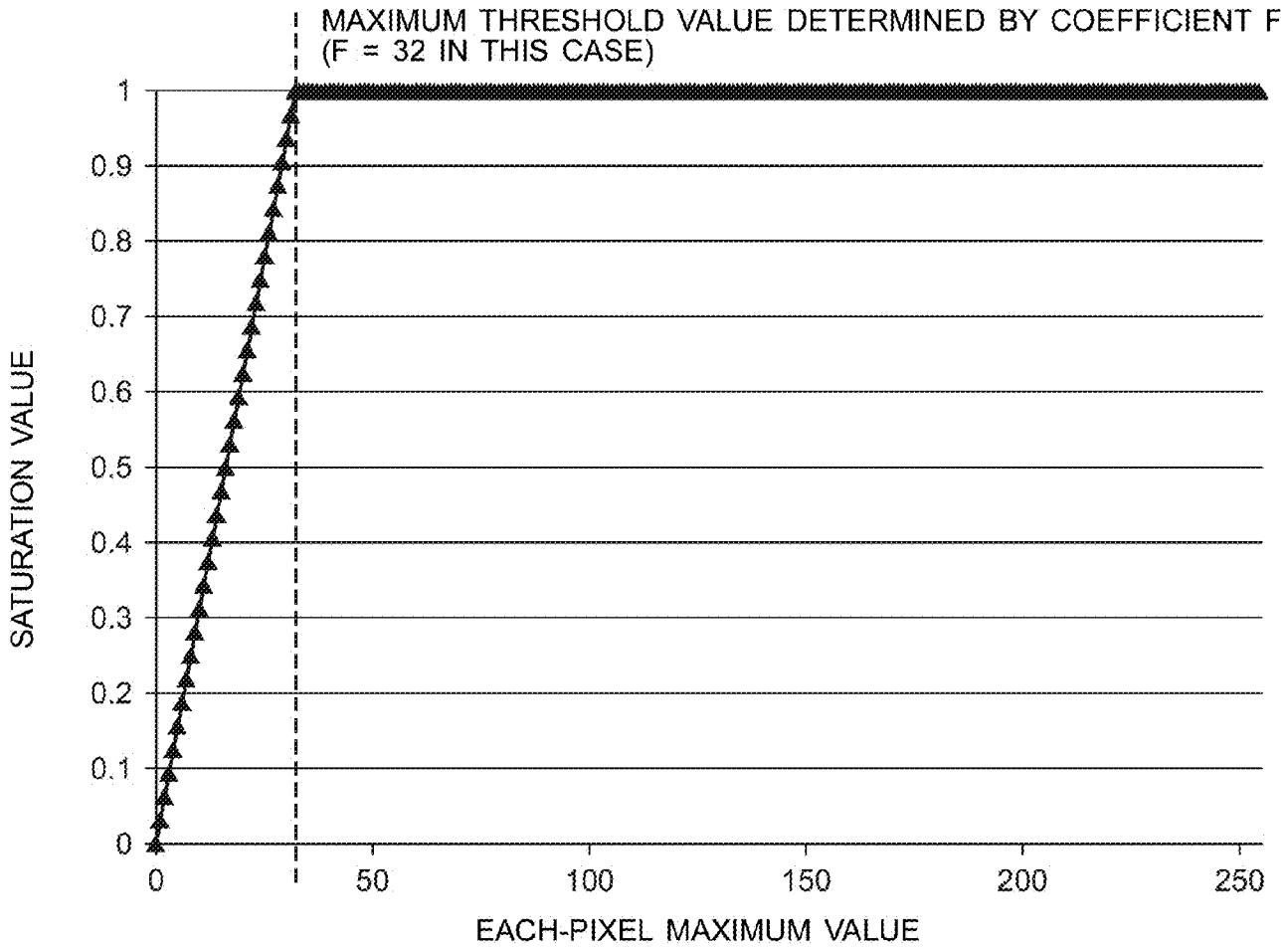
FIG. 25 is an example of operations of a saturation decrease amount calculation circuit section according to the eighth exemplary embodiment of the present invention.

As shown in FIG. 24, the different points of the eighth exemplary embodiment with respect to the seventh exemplary embodiment are that an each-pixel saturation decreasing circuit section 64*g* for decreasing the saturation value of each pixel according to the maximum value of each pixel is added to the each-pixel saturation calculation circuit section 64.

In the each-pixel saturation calculation circuit section 64 of the eighth exemplary embodiment, the each-pixel saturation computing section 64*d* calculates the saturation from MAX and MIN described above (same as the computation of Expression 4), the each-pixel maximum value judging section 64*c* compares the maximum value of each pixel with the value of the coefficient F saved in the information storage section 64*f* to judge which of the values is larger, and the each-pixel saturation value outputting section 64*e* outputs the final saturation value of each pixel according to the judgment result. Specifically, when MAX is equal to or less than the coefficient F (maximum threshold value), the each-pixel saturation decreasing circuit section 64g takes the value calculated by a numerical expression "((MAX−MIN)/MAX)×(MAX/F)" that is an expression in which (MAX/F) is multiplied to Expression 4 described above as the saturation value. When MAX is larger than the coefficient F, the saturation value is calculated by a numerical expression given by Expression 4.

This can be expressed as a numerical expression as in following Expression 27 using MAX, MIN, and the coefficient F, and calculation processing is executed according to that.

(Case of MAX>F)

$$\text{chroma}=(\text{MAX}-\text{MIN})/\text{MAX}$$

(Case of MAX≤F)

$$\text{chroma}=((\text{MAX}-\text{MIN})/\text{MAX})\times(\text{MAX}/F) \quad (27)$$

Next, the operations of Expression 27 will be described in details.

In the eighth exemplary embodiment, specifically considered is the luminance signals in which the value of Bin is continuously increased by 1 from (Rin, Gin, Bin)=(0, 0, 1) to (0, 0, 255). Here, the case of increasing the value of Bin by 1 is described as an example. However, this is not limited to Bin but may also be applied to the cases of Rin and Gin.

In the case of (Rin, Gin, Bin)=(0, 0, 0), a denominator becomes 0 according to Expression 4 so that the value becomes undefined. However, it is possible to deal with such case by setting exceptional processing such as setting the saturation as 0 when MAX is 0, for example.

When the saturation value of the luminance signals is calculated according to Expression 4, the saturation value is 1 that is a high value in all the cases. That is, the saturation value becomes 1 even in an image of almost black (like a noise component of image) as in the case of (Rin, Gin, Bin)=(0, 0, 1) or (0, 0, 2), so that it is calculated as a high saturation value.

In the case with high saturation and large maximum value, it is assumed that there is the screen of Case VI of the seventh exemplary embodiment, and it is desirable not to decrease the backlight in such case. In the meantime, in the case with high saturation and small maximum value, it is assumed that there is the screen of Case V of the seventh exemplary embodiment, and it is desirable to decrease the backlight in such case. That is, it is desirable to perform the operation in such a manner that the saturation value becomes large in a case where the maximum value is large in the luminance signal whose saturation value is calculated as high and that the saturation value becomes small when the maximum value is small.

Here, a case of calculating the saturation values of the luminance signals based on Expression 27 will be described by referring to FIG. 25. FIG. 25 is a graph in which the lateral axis shows the maximum values of the relative luminance of each pixel and the longitudinal axis shows the saturation values of the luminance signals calculated based on Expression 27. For simplifying the operation, the value of the coefficient F in this case is set as F=32 (naturally, it may be set as a still smaller value). It can be seen from the graph that it is possible to achieve the operations with which the saturation value decreases continuously as the maximum value decreases (according to the maximum value) and the saturation value continues at the maximum threshold value in a case where the maximum value of each pixel is equal to or less than the maximum threshold value (coefficient F) that is shown by a vertical broken line in FIG. 25. Further, as can be seen from the graph shown in FIG. 25, the eighth exemplary embodiment can change the maximum threshold value for decreasing the saturation value by setting the value of the coefficient F properly (to be able to change the threshold value is the same as the case of the seventh exemplary embodiment). Further, the saturation values at the points equal to or less than the maximum threshold value decrease linearly as the maximum value decreases. Thus, it is possible to make a continuous change without having a radical decrease in the saturation values from a given maximum value.

As the value of the coefficient F, as in the case of the seventh exemplary embodiment, it is desirable to set the maximum value of the pixel gradation in such a manner that the saturation of the pixel of 8 gradations or less becomes sufficiently small in a case where values of the gradation signals (Rin, Gin, Bin) to be inputted are of 8-bit input (the maximum value of the gradation signals is 255) in order to calculate the saturation value of the pixel of the noise part to be small in a case of a dark screen with many noises.

Through performing the control in the manner described above, it is possible to perform the operation to decrease the luminance of the backlight effectively even when there is a noise in the dark screen. Therefore, it is possible to achieve the control to increase the decreasing effect of the backlight luminance further while suppressing a sense of discomfort in the image quality as much as possible.

(Effect of Eighth Exemplary Embodiment)

With the eighth exemplary embodiment, the saturation value calculation method of each pixel is optimally controlled for the image containing many low-gradation noises. Thereby, it is possible to decrease the power consumption of the backlight more effectively while suppressing a sense of discomfort in the image quality as much as possible.

Other structures and operations are the same as those of the first to seventh exemplary embodiments, and other operational effects generated thereby are also the same.

Note that each of the above-described exemplary embodiments shows preferable specific examples of the control signal generation circuit, the video display device, and the control signal generation method, and various kinds of technically preferable limits may be set in some cases. However, the technical scope of the present invention is not limited to those modes unless it is specifically mentioned to limit the preset invention. Further, the first to sixth exemplary embodiments and the seventh exemplary embodiment or the eighth exemplary embodiment can be combined arbitrarily.

New technical contents regarding the above-described exemplary embodiments can be summarized as follows. Note, however, that the present invention is not necessarily limited to the followings.

(Supplementary Note 1)

A control signal generation circuit which includes:

a first circuit unit 60A which controls, according to an inputted video signal, light-up amount of each pixel of a display panel 80 where a plurality of pixels constituted by including a white sub-pixel are disposed; and a second circuit unit 60B which controls luminance of a backlight 90 that lights up the display panel from a back surface, wherein:

the second circuit unit 60B includes an each-pixel saturation calculation circuit 64 which calculates a saturation value of each pixel, a feature value/luminance decrease amount calculation circuit 65 which calculates a saturation feature value in one frame by using the saturation value of each pixel, and calculates luminance decrease amount of the backlight based thereupon, a PWM signal generation circuit 69 which generates a signal for controlling the luminance of the backlight based on the luminance decrease amount of the backlight, and transmits the generated signal towards the backlight, and an each-pixel luminance increase rate calculation circuit 66 which calculates a luminance increase rate of each pixel by using the saturation value of each pixel and the saturation feature value; and the first circuit unit 60A includes a saturation supplementing circuit 63 which supplements the saturation of each pixel according to the light-up amount of the white sub-pixel.

(Supplementary Note 2)

The control signal generation circuit as depicted in Supplementary Note 1, wherein the first circuit unit 60A further includes an each-pixel luminance decreasing circuit 67 which performs luminance decreasing processing of each pixel according to the luminance increase rate.

(Supplementary Note 3)

The control signal generation circuit as depicted in Supplementary Note 1 or 2, wherein the feature value/luminance decrease amount calculation circuit 65 includes:

an each-pixel saturation judging section 65*b* which judges whether the saturation value of each pixel is larger or smaller with respect to a saturation threshold value (A) set in advance;

an each-pixel saturation deviation sum calculation section 65*c* which individually calculates sum total of saturation deviation regarding a case where the saturation value is judged as being equal to or less than the saturation threshold value and a case where the saturation value is judged as being larger than the saturation threshold value, by the each-pixel saturation judging section 65*b*, respectively;

a total-pixel saturation deviation average calculation section 65*d* which calculates a saturation deviation average value of total pixels by using the sum total of the each saturation deviation and number of resolution of the display panel; and a saturation feature value calculation section 65*e* which calculates the saturation feature value by using the saturation deviation average value of the total pixels, a saturation maximum value of the total pixels, and a coefficient (B) regarding luminance control of the backlight.

(Supplementary Note 4)

The control signal generation circuit as depicted in Supplementary Note 3, wherein the feature value/luminance decrease amount calculation circuit 65 calculates the luminance decrease amount of the backlight to be a small value according to an average value of the saturation value of each pixel in a case where the average value is a higher value than the saturation threshold value, calculates the luminance decrease amount to increase continuously as the average value becomes decreased until reaching the saturation threshold value from the higher value, calculates the luminance decrease amount to decrease continuously as the average value becomes decreased after exceeding the saturation threshold value, and calculates the luminance decrease amount to continue at the saturation threshold value.

(Supplementary Note 5)

The control signal generation circuit as depicted in Supplementary Note 3, wherein provided that the sum totals of the each saturation deviation are defined as Xa, Xb, the saturation threshold value is defined as a coefficient A ($0<A<1$), the saturation value of k-th (k is an arbitrary value from 1 to the number of resolution) pixel is defined as chroma(k), the feature value/luminance decrease amount calculation circuit 65 calculates value of Xa by applying a numerical expression $Xa=\Sigma\{1-(1/A)\times chroma(k)\}$ in a case where the chroma(k) is equal to or less than the coefficient A, calculates value of Xb by applying a numerical expression $Xb=\Sigma\{1/(1-A)\}\times(chroma(k)-A)$ in a case where the chroma(k) is larger than the coefficient A, and calculates a quotient acquired by dividing the sum totals by the number of resolution as the saturation deviation average value of the total pixels.

(Supplementary Note 6)

The control signal generation circuit as depicted in Supplementary Note 5, wherein provided that the saturation deviation average value of the total pixels is defined as DAVE, a saturation maximum value of the total pixels is defined as MAX(chroma), the saturation feature value is defined as Rank, and a coefficient regarding luminance control of the backlight is defined as B ($0<B<1$), the feature value/luminance decrease amount calculation circuit 65 calculates the saturation feature value based on a numerical expression $Rank=MAX(chroma)\times\{B\times DAVE+(1-B)\}$.

(Supplementary Note 7)

The control signal generation circuit as depicted in Supplementary Note 6, wherein the feature value/luminance decrease amount calculation circuit 65 calculates a PWM value PWM used for the luminance control of the backlight from a numerical expression $PWM=1/\{C-(C-1)\times Rank\}$ by using another coefficient C ($1\leq C\leq 2$) regarding the luminance control of the backlight, and calculates the luminance decrease amount of the backlight based on the PWM value.

(Supplementary Note 8)

The control signal generation circuit as depicted in any one of Supplementary Notes 3 to 7, wherein the saturation threshold value is set as a value that is larger than 0 and equal to or smaller than 0.5 ($0<A\leq 0.5$).

(Supplementary Note 9)

The control signal generation circuit as depicted in any one of Supplementary Notes 3 to 8, wherein the coefficient (B) regarding the luminance control of the backlight is set as a value acquired by subtracting the saturation threshold value from 1 ($B=1-A$).

(Supplementary Note 10)

The control signal generation circuit as depicted in any one of Supplementary Notes 1 to 3, wherein the feature value/luminance decrease amount calculation circuit 65 calculates the luminance decrease amount of the backlight as a small value in a case where the video signal is a case of a high saturation color solid display, calculates the luminance decrease amount of the backlight as a large value in a case where the video signal is a case of low saturation color solid display or a case of intermediate saturation color solid display containing primary color display in a part thereof, and calculates the luminance decrease amount of the backlight as a small value in a case where the video signal is a case of achromatic display containing primary color display on a part thereof.

(Supplementary Note 11)

The control signal generation circuit as depicted in Supplementary Note 7, wherein in a case where a ratio between the maximum white luminance of the white sub-pixel and the maximum white luminance generated by the video signal is 1:1, the feature value/luminance decrease amount calculation circuit 65 sets the another coefficient C as a value that is twice a ratio of an aperture area of sub-pixels of an RGBW-type display panel with respect to an aperture area of sub-pixels of an RGB-type display panel(a quotient acquired by dividing the aperture area of the sub-pixels of the RGBW-type display panel by the aperture area of the sub-pixels of the RGB -type display panel) ($C=2\times Y$).

(Supplementary Note 12)

The control signal generation circuit as depicted in Supplementary Note 10, wherein provided that a ratio of an aperture area of sub-pixels of an RGBW-type display panel with respect to an aperture area of sub-pixels of an RGB -type display panel is defined as Y, and a ratio of a maximum white luminance of the white sub-pixels and a maximum white luminance generated by the video signal is p:q, the feature value/luminance decrease amount calculation circuit 65 calculates the coefficient C from a numerical expression $C=(1+(p/q))\times Y$, and uses the acquired value for calculating the PWM value.

(Supplementary Note 13)

The control signal generation circuit as depicted in Supplementary Note 12, wherein in a case where the ratio between the maximum white luminance of the white sub-pixels and the maximum white luminance generated by the video signal is p:q, and a ratio thereof p/q is larger than 1, the saturation value of each pixel is defined as chroma(c), a coefficient $\alpha$ is calculated from a numerical expression $\alpha=1+((p/q)-1)\times(1-chroma(c))$, and the coefficient $\alpha$ is used for calculation of saturation supplement and for calculation of the luminance of the white sub-pixels.

(Supplementary Note 14)

The control signal generation circuit as depicted in Supplementary Note 12, wherein in a case where a ratio between the maximum white luminance of the white sub-pixels and the maximum white luminance generated by the video signal is p:q, and a ratio thereof p/q is larger than 2, the saturation value of each pixel is defined as chroma(c), a coefficient $\alpha$ is calculated from a numerical expression $\alpha=1+((p/q)-1)\times((1-chroma(c))\hat{}(p/q))$, and the coefficient $\alpha$ is used for calculation of saturation supplement and for calculation of the luminance of the white sub-pixels.

(Supplementary Note 15)

The control signal generation circuit as depicted in Supplementary Note 12, wherein in a case where a ratio between the maximum white luminance of the white sub-pixels and the maximum white luminance generated by the video signal is p:q, and a ratio thereof p/q is larger than 1, a function of the saturation values calculated from each pixel in one frame is defined as f(x), a coefficient $\beta$ is calculated from a numerical expression $\beta=1+((p/q)-1)\times f(x)$, and the coefficient $\beta$ is used for calculation of each-pixel luminance decrease.

(Supplementary Note 16)

The control signal generation circuit as depicted in Supplementary Note 15, wherein the function f(x) is calculated from a numerical expression $f(x)=(chromaAVE)\hat{}E$ provided that E is a coefficient within a range of $0<E<2$ and chromaAVE is an average value of the saturation value of each pixel in one frame, and the function f(x) is used for calculation of the coefficient $\beta$.

(Supplementary Note 17)

The control signal generation circuit as depicted in Supplementary Note 16, wherein the coefficient E is set as 0.5.

(Supplementary Note 18)

The control signal generation circuit as depicted in Supplementary Note 1 or 2, wherein the each-pixel saturation calculation circuit 64 includes:

an each-pixel maximum value calculation section 64*a* which calculates a maximum value of relative luminance of each pixel;

an each-pixel minimum value calculation section 64*b* which calculates a minimum value of the relative luminance of each pixel;

an each-pixel saturation computing section 64*d* which computes saturation of each pixel;

an each-pixel maximum value judging section 64*c* which judges whether the maximum value of the relative luminance of each pixel is larger or smaller than a maximum threshold value set in advance; and an each-pixel saturation value outputting section 64*e* which outputs saturation values calculated when judged as being equal to or less than the maximum threshold value and when judged as being larger than the maximum threshold value, by the each-pixel maximum value judging section 64*c*, respectively.

(Supplementary Note 19)

The control signal generation circuit as depicted in Supplementary Note 18, wherein the each-pixel saturation calculation circuit 64 calculates the saturation value of each pixel as a saturation value that is smaller than an original saturation value in a case where the maximum value of the relative luminance of each pixel is equal to or less than the maximum threshold value.

(Supplementary Note 20)

The control signal generation circuit as depicted in Supplementary Note 19, wherein provided that the saturation value of each pixel is defined as chroma, the maximum value of the relative luminance of each pixel is MAX, the minimum value of the relative luminance of each pixel is MIN, the maximum threshold value set in advance is F, and a coefficient within a range of $0 \leq G \leq 0.5$ is G, the each-pixel saturation calculation circuit 64 employs chroma=(MAX−MIN)/MAX under a condition of MAX>F while employing chroma=G under a condition of MAX≤F, and uses the values of chroma for the saturation value of each pixel.

(Supplementary Note 21)

The control signal generation circuit as depicted in Supplementary Note 18, wherein when the maximum value of the relative luminance of each pixel is equal to or less than the maximum threshold value, each-pixel saturation calculation circuit 64 calculates the saturation value of each pixel to become decreased continuously according to the maximum value of the relative luminance and to continue at the maximum threshold value.

(Supplementary Note 22)

The control signal generation circuit as depicted in Supplementary Note 21, wherein provided that the saturation value of each pixel is defined as chroma, the maximum value of the relative luminance of each pixel is MAX, the minimum value of the relative luminance of each pixel is MIN, and the maximum threshold value set in advance is F, the each-pixel saturation calculation circuit 64 employs chroma=(MAX−MIN)/MAX under a condition of MAX>F while employing chroma=((MAX−MIN)/MAX)×(MAX/F) under a condition of MAX≤F, and uses the values of chroma for the saturation value of each pixel.

(Supplementary Note 23)

A video display device which includes:

the display panel 80; the backlight 90, and the control signal generation circuit depicted in any one of Supplementary Notes 1 to 22.

(Supplementary Note 24)

A control signal generation method using a control signal generation circuit which includes a first circuit unit 60A which controls, according to an inputted video signal, light-up amount of each pixel of a display panel where a plurality of pixels constituted by including a white sub-pixel are disposed; and a second circuit unit 60B which controls luminance of a backlight that lights up the display panel from a back surface, wherein:

the first circuit unit 60A supplements saturation of each pixel according to the light-up amount of the white-sub-pixel;

the second circuit unit 60B calculates a saturation value of each pixel;

the second circuit unit 60B calculates a saturation feature value in one frame by using the saturation value of each pixel;

the second circuit unit 60B calculates luminance decrease amount of the backlight based on the saturation feature value;

the second circuit unit 60B generates a signal for controlling the luminance of the backlight based on the luminance decrease amount of the backlight, and transmits the generated signal towards the backlight;

the second circuit unit 60B calculates a luminance increase rate of each pixel by using the saturation value of each pixel and the saturation feature value; and the first circuit unit 60A performs luminance decreasing processing of each pixel according to the luminance increase rate.

(Supplementary Note 25)

The control signal generation method as depicted in Supplementary Note 24, wherein when calculating the saturation feature value, the second circuit unit 60B:

judges whether the saturation value of each pixel is larger or smaller with respect to a saturation threshold value (A) set in advance;

individually calculates sum total of saturation deviation regarding a case where the saturation value is judged as being equal to or less than the saturation threshold value and a case where the saturation value is judged as being larger than the saturation threshold value, respectively;

calculates a saturation deviation average value of total pixels by using the sum total of the each saturation deviation and number of resolution of the display panel; and calculates the saturation feature value by using the saturation deviation average value of the total pixels, a saturation maximum value of the total pixels, and a coefficient (B) regarding luminance control of the backlight.

(Supplementary Note 26)

The control signal generation method as depicted in Supplementary Note 24, wherein when calculating the saturation value, the second circuit unit: calculates the maximum value of relative luminance of each pixel; computes the saturation of each pixel; judges whether the maximum value of relative luminance of each pixel is larger or smaller with respect to a maximum threshold value set in advance; and outputs the saturation value calculated, respectively, when judged as being equal to or less than the maximum threshold value and when judged as being larger than the maximum threshold value as a final saturation value.

(Supplementary Note 27)

A control signal generation circuit which includes:

first circuit means for controlling, according to an inputted video signal, light-up amount of each pixel of a display panel where a plurality of pixels constituted by including a white sub-pixel are disposed; and second circuit means for controlling luminance of a backlight that lights up the display panel from a back surface, wherein:

the second circuit means includes each-pixel saturation calculation means for calculating a saturation value of each pixel, feature value/luminance decrease amount calculation means for calculating a saturation feature value in one frame by using the saturation value of each pixel, and calculating luminance decrease amount of the backlight based thereupon, PWM signal generation means for generating a signal for controlling the luminance of the backlight based on the luminance decrease amount of the backlight, and transmitting the generated signal towards the backlight, and each-pixel luminance increase rate calculation means for calculating a luminance increase rate of each pixel by using the saturation value of each pixel and the saturation feature value; and the first circuit means comprises saturation supplementing means for supplementing the saturation of each pixel according to the light-up amount of the white sub-pixel.

INDUSTRIAL APPLICABILITY

The present invention can be utilized for various kinds of display devices having an information processing function.

What is claimed is:

1. A control signal generation circuit, comprising:

a first circuit unit which controls, according to an inputted video signal, light-up amount of each pixel of a display panel where a plurality of pixels constituted by including a white sub-pixel are disposed; and a second circuit unit which controls luminance of a backlight that lights up the display panel from a back surface, wherein the second circuit unit comprises, an each-pixel saturation calculation circuit which calculates a saturation value of each pixel, a feature value/luminance decrease amount calculation circuit which calculates a saturation feature value in one frame by using the saturation value of each pixel, and calculates luminance decrease amount of the backlight based thereupon, a PWM signal generation circuit which generates a signal for controlling the luminance of the backlight based on the luminance decrease amount of the backlight, and transmits the generated signal towards the backlight, and an each-pixel luminance increase rate calculation circuit which calculates a luminance increase rate of each pixel by using the saturation value of each pixel and the saturation feature value; and wherein the first circuit unit comprises a saturation supplementing circuit which supplements the saturation of each pixel according to the light-up amount of the white sub-pixel, wherein the feature value/luminance decrease amount calculation circuit calculates the luminance decrease amount of the backlight as a small value in a case where the video signal is a case of a high saturation color display, calculates the luminance decrease amount of the backlight as a large value in a case where the video signal is a case of low saturation color display or a case of intermediate saturation color display containing primary color display in a part thereof, and calculates the luminance decrease amount of the backlight as a small value in a case where the video signal is a case of achromatic display containing primary color display in a part thereof.

2. The control signal generation circuit as claimed in claim 1, wherein the first circuit unit further comprises an each-pixel luminance decreasing circuit which performs luminance decreasing processing of each pixel according to the luminance increase rate.

3. The control signal generation circuit as claimed in claim 1, wherein the feature value/luminance decrease amount calculation circuit comprises:

an each-pixel saturation judging section which judges whether the saturation value of each pixel is larger or smaller with respect to a saturation threshold value set in advance;

an each-pixel saturation deviation sum calculation section which individually calculates sum total of saturation deviation regarding a case where the saturation value is judged as being equal to or less than the saturation threshold value and a case where the saturation value is judged as being larger than the saturation threshold value, by the each-pixel saturation judging section, respectively;

a total-pixel saturation deviation average calculation section which calculates a saturation deviation average value of total pixels by using the sum total of the each saturation deviation and number of resolution of the display panel; and a saturation feature value calculation section which calculates the saturation feature value by using the saturation deviation average value of the total pixels, a saturation maximum value of the total pixels, and a coefficient regarding luminance control of the backlight.

4. The control signal generation circuit as claimed in claim 3, wherein the feature value/luminance decrease amount calculation circuit calculates the luminance decrease amount of the backlight to be a small value according to an average value of the saturation value of each pixel in a case where the average value is a higher value than the saturation threshold value, calculates the luminance decrease amount to increase continuously as the average value becomes decreased until reaching the saturation threshold value from the higher value, calculates the luminance decrease amount to decrease continuously as the average value becomes decreased after exceeding the saturation threshold value, and calculates the luminance decrease amount to continue at the saturation threshold value.

5. The control signal generation circuit as claimed in claim 3, wherein provided that the sum totals of the each saturation deviation are defined as Xa, Xb, the saturation threshold value is defined as a coefficient A ($0<A<1$), the saturation value of k-th (k is an arbitrary value from 1 to the number of resolution) pixel is defined as chroma(k), the feature value/luminance decrease amount calculation circuit calculates value of Xa by applying a numerical expression $Xa=\Sigma\{1-(1/A)\times\text{chroma}(k)\}$ in a case where the chroma(k) is equal to or less than the coefficient A, calculates value of Xb by applying a numerical expression $Xb=\Sigma\{1/(1-A)\}\times(\text{chroma}(k)-A)$ in a case where the chroma(k) is larger than the coefficient A, and calculates a quotient acquired by dividing the sum totals by the number of resolution as the saturation deviation average value of the total pixels.

6. The control signal generation circuit as claimed in claim 5, wherein provided that the saturation deviation average value of the total pixels is defined as DAVE, a saturation maximum value of the total pixels is defined as MAX(chroma), the saturation feature value is defined as Rank, and a coefficient regarding luminance control of the backlight is defined as B ($0<B<1$), the feature value/luminance decrease amount calculation circuit calculates the saturation feature value based on a numerical expression $Rank=MAX(\text{chroma})\times\{B\times DAVE+(1-B)\}$.

7. The control signal generation circuit as claimed in claim 6, wherein the feature value/luminance decrease amount calculation circuit calculates a PWM value PWM used for the luminance control of the backlight from a numerical expression $PWM=1/\{C-(C-1)\times Rank\}$ by using another coefficient C ($1\leq C\leq 2$) regarding the luminance control of the backlight, and calculates the luminance decrease amount of the backlight based on the PWM value.

8. The control signal generation circuit as claimed in claim 7, wherein in a case where a ratio between the maximum white luminance of the white sub-pixel and the maximum white luminance generated by the video signal is 1:1, the feature value/luminance decrease amount calculation circuit sets the another coefficient C as a value that is twice a ratio of an aperture area of sub-pixels of an RGBW-type display panel with respect to an aperture area of sub-pixels of an RGB-type display panel.

9. The control signal generation circuit as claimed in claim 3, wherein the saturation threshold value is set as a value that is larger than 0 and equal to or smaller than 0.5.

10. The control signal generation circuit as claimed in claim 3, wherein the coefficient regarding the luminance control of the backlight is set as a value acquired by subtracting the saturation threshold value from 1.

11. The control signal generation circuit as claimed in claim 1, wherein provided that a ratio of an aperture area of sub-pixels of an RGBW-type display panel with respect to an aperture area of sub-pixels of an RGB-type display panel is defined as Y, and a ratio of a maximum white luminance of the white sub-pixels and a maximum white luminance generated by the video signal is p:q, the feature value/luminance decrease amount calculation circuit calculates the another coefficient C from a numerical expression $C=(1+(p/q))\times Y$, and uses the acquired value for calculating the PWM value.

12. The control signal generation circuit as claimed in claim 11, wherein in a case where the ratio between the maximum white luminance of the white sub-pixels and the maximum white luminance generated by the video signal is p:q, and a ratio thereof p/q is larger than 1, the saturation value of each pixel is defined as chroma(c), a coefficient $\alpha$ is calculated from a numerical expression $\alpha=1+((p/q)-1)\times(1-chroma(c))$, and the coefficient $\alpha$ is used for calculation of saturation supplement and for calculation of the luminance of the white sub-pixels.

13. The control signal generation circuit as claimed in claim 11, wherein in a case where a ratio between the maximum white luminance of the white sub-pixels and the maximum white luminance generated by the video signal is p:q, and a ratio thereof p/q is larger than 2, the saturation value of each pixel is defined as chroma(c), a coefficient $\alpha$ is calculated from a numerical expression $\alpha=1+((p/q)-1)\times((1-chroma(c))\hat{}(p/q))$, and the coefficient $\alpha$ is used for calculation of saturation supplement and for calculation of the luminance of the white sub-pixels.

14. The control signal generation circuit as claimed in claim 11, wherein in a case where a ratio between the maximum white luminance of the white sub-pixels and the maximum white luminance generated by the video signal is p:q, and a ratio thereof p/q is larger than 1, a function of the saturation values calculated from each pixel in one frame is defined as f(x), a coefficient $\beta$ is calculated from a numerical expression $\beta=1+((p/q)-1)\times f(x)$, and the coefficient $\beta$ is used for calculation of each-pixel luminance decrease.

15. The control signal generation circuit as claimed in claim 14, wherein the function f(x) is calculated from a numerical expression $f(x)=(chromaAVE)\hat{}E$ provided that E is a coefficient within a range of $0<E<2$ and chromaAVE is an average value of the saturation value of each pixel in one frame, and the function f(x) is used for calculation of the coefficient $\beta$.

16. The control signal generation circuit as claimed in claim 15, wherein the coefficient E is set as 0.5.

17. The control signal generation circuit as claimed in claim 1, wherein the each-pixel saturation calculation circuit comprises:

an each-pixel maximum value calculation section which calculates a maximum value of relative luminance of each pixel;

an each-pixel minimum value calculation section which calculates a minimum value of the relative luminance of each pixel;

an each-pixel saturation computing section which computes saturation of each pixel;

an each-pixel maximum value judging section which judges whether the maximum value of the relative luminance of each pixel is larger or smaller than a maximum threshold value set in advance; and an each-pixel saturation value outputting section which outputs saturation values calculated when judged as being equal to or less than the maximum threshold value and when judged as being larger than the maximum threshold value, by the each-pixel maximum value judging section, respectively.

18. The control signal generation circuit as claimed in claim 17, wherein the each-pixel saturation calculation circuit calculates the saturation value of each pixel as a saturation value that is smaller than an original saturation value in a case where the maximum value of the relative luminance of each pixel is equal to or less than the maximum threshold value.

19. The control signal generation circuit as claimed in claim 18, wherein provided that the saturation value of each pixel is defined as chroma, the maximum value of the relative luminance of each pixel is MAX, the minimum value of the relative luminance of each pixel is MIN, the maximum threshold value set in advance is F, and a coefficient within a range of $0\leq G\leq 0.5$ is G, the each-pixel saturation calculation circuit employs $chroma=(MAX-MIN)/MAX$ under a condition of $MAX>F$ while employing $chroma=G$ under a condition of $MAX\leq F$, and uses the values of chroma for the saturation value of each pixel.

20. The control signal generation circuit as claimed in claim 17, wherein when the maximum value of the relative luminance of each pixel is equal to or less than the maximum threshold value, the each-pixel saturation calculation circuit calculates the saturation value of each pixel to become decreased continuously according to the maximum value of the relative luminance and to continue at the maximum threshold value.

21. The control signal generation circuit as claimed in claim 20, wherein provided that the saturation value of each pixel is defined as chroma, the maximum value of the relative luminance of each pixel is MAX, the minimum value of the relative luminance of each pixel is MIN, and the maximum threshold value set in advance is F, the each-pixel saturation calculation circuit employs chroma=(MAX−MIN)/MAX under a condition of MAX>F while employing chroma=((MAX−MIN)/MAX)×(MAX/F) under a condition of MAX≤F, and uses the values of chroma for the saturation value of each pixel.

22. A video display device, comprising:

the display panel; the backlight, and the control signal generation circuit claimed in claim 1.

23. A control signal generation method using a control signal generation circuit which comprises a first circuit unit which controls, according to an inputted video signal, light-up amount of each pixel of a display panel where a plurality of pixels constituted by including a white sub-pixel are disposed; and a second circuit unit which controls luminance of a backlight that lights up the display panel from a back surface, wherein:

the first circuit unit supplements saturation of each pixel according to the light-up amount of the white-sub-pixel;

the second circuit unit calculates a saturation value of each pixel;

the second circuit unit calculates a saturation feature value in one frame by using the saturation value of each pixel;

the second circuit unit calculates luminance decrease amount of the backlight based on the saturation feature value;

the second circuit unit generates a signal for controlling the luminance of the backlight based on the luminance decrease amount of the backlight, and transmits the generated signal towards the backlight;

the second circuit unit calculates a luminance increase rate of each pixel by using the saturation value of each pixel and the saturation feature value; and the first circuit unit performs luminance decreasing processing of each pixel according to the luminance increase rate, wherein when calculating the saturation feature value, the second circuit unit calculates the luminance decrease amount of the backlight as a small value in a case where the video signal is a case of a high saturation color display, calculates the luminance decrease amount of the backlight as a large value in a case where the video signal is a case of low saturation color display or a case of intermediate saturation color display containing primary color display in a part thereof, and calculates the luminance decrease amount of the backlight as a small value in a case where the video signal is a case of achromatic display containing primary color display in a part thereof.

24. The control signal generation method as claimed in claim 23, wherein when calculating the saturation feature value, the second circuit unit:

judges whether the saturation value of each pixel is larger or smaller with respect to a saturation threshold value set in advance;

individually calculates sum total of saturation deviation regarding a case where the saturation value is judged as being equal to or less than the saturation threshold value and a case where the saturation value is judged as being larger than the saturation threshold value, respectively;

calculates a saturation deviation average value of total pixels by using the sum total of the each saturation deviation and number of resolution of the display panel; and calculates the saturation feature value by using the saturation deviation average value of the total pixels, a saturation maximum value of the total pixels, and a coefficient regarding luminance control of the backlight.

25. The control signal generation method as claimed in claim 23, wherein when calculating the saturation value, the second circuit unit: calculates the maximum value of relative luminance of each pixel; computes the saturation of each pixel; judges whether the maximum value of relative luminance of each pixel is larger or smaller with respect to a maximum threshold value set in advance; and outputs the saturation value calculated, respectively, when judged as being equal to or less than the maximum threshold value and when judged as being larger than the maximum threshold value as a final saturation value.

* * * * *